US010279874B1

(12) United States Patent
Field

(10) Patent No.: US 10,279,874 B1
(45) Date of Patent: May 7, 2019

(54) QUICK-CONNECT FIN RETENTION SYSTEM FOR A WATER CRAFT

(71) Applicant: John Field, Hong Kong (HK)

(72) Inventor: John Field, Hong Kong (HK)

( * ) Notice: Subject to any disclaimer, the term of this patent is extended or adjusted under 35 U.S.C. 154(b) by 0 days.

(21) Appl. No.: 15/801,117

(22) Filed: Nov. 1, 2017

(51) Int. Cl.
*B63B 35/79* (2006.01)

(52) U.S. Cl.
CPC ..... *B63B 35/793* (2013.01)

(58) Field of Classification Search
CPC ..... B63B 35/7926; B63B 35/793
See application file for complete search history.

(56) References Cited

U.S. PATENT DOCUMENTS

| | | | | |
|---|---|---|---|---|
| 3,516,099 | A | 6/1970 | Morey et al. | |
| 3,564,632 | A | 2/1971 | Bahne, Jr. | |
| 3,579,681 | A | 5/1971 | Pope, III et al. | |
| 3,585,663 | A | 6/1971 | Johnson | |
| 3,659,300 | A | 5/1972 | Johnson | |
| 3,965,514 | A | 6/1976 | Shafer et al. | |
| 4,044,416 | A | 8/1977 | Brewer et al. | |
| 4,379,703 | A | 4/1983 | Mizell | |
| 4,421,492 | A * | 12/1983 | Leva | B63B 35/793 114/127 |
| 5,464,359 | A | 11/1995 | Whitty | |
| 5,830,025 | A | 11/1998 | Fleming | |
| 5,975,974 | A | 11/1999 | McCausland | |
| 6,752,674 | B2 | 6/2004 | Jolly | |
| 6,896,570 | B1 | 5/2005 | O'Keefe et al. | |
| 7,182,661 | B2 | 2/2007 | Sams et al. | |
| 8,393,928 | B2 | 3/2013 | Kumano et al. | |
| 9,688,365 | B2 | 6/2017 | Norrie et al. | |
| 9,957,021 | B2 * | 5/2018 | Scott | B63B 35/793 |
| 2003/0092333 | A1 | 5/2003 | McCausland et al. | |
| 2007/0202760 | A1 | 8/2007 | Caldwell et al. | |
| 2010/0120305 | A1 | 5/2010 | Posner et al. | |
| 2010/0178820 | A1 | 7/2010 | Kumano et al. | |

(Continued)

FOREIGN PATENT DOCUMENTS

| | | |
|---|---|---|
| AU | 84471/82 | 1/1983 |
| DE | 38 01 747 | 8/1989 |

(Continued)

*Primary Examiner* — Andrew Polay
(74) *Attorney, Agent, or Firm* — Nixon & Vanderhye P.C.

(57) ABSTRACT

A fin system for releasibly securing a fin to a water craft the system including: a fin box with at least one elongated slot open at a first surface of the fin box and extending a depth inward towards a closed base opposite the first surface; one or more fixed securing features in the fin box, below the first surface and adjacent and open to the at least one elongated slot; one or more vertical access slots in the fin box, open at one end to the first surface, adjacent and open to the at least one elongated slot and extending the depth inwards towards the closed base; and, a fin with a fin base dimensioned to be slideably received by the at least one elongated slot of the fin box, wherein the fin base includes one or more fixed fin attachment mechanisms each having at least one tab or recess dimensioned to be received first by the one or more vertical access slots and received subsequently by the fixed securing features, wherein an engagement of the at least one fin tab or fin recess with the securing features secures the fin in the fin box.

16 Claims, 73 Drawing Sheets

(56) References Cited

U.S. PATENT DOCUMENTS

| | | | |
|---|---|---|---|
| 2010/0233921 | A1 | 9/2010 | Kumano et al. |
| 2010/0273373 | A1 | 10/2010 | Field |
| 2010/0311294 | A1 | 12/2010 | Foulke |
| 2011/0028058 | A1 | 2/2011 | Kumano |
| 2011/0039463 | A1 | 2/2011 | Hort et al. |
| 2011/0053443 | A1 | 3/2011 | McTavish |
| 2011/0070787 | A1 | 3/2011 | Lausman |

FOREIGN PATENT DOCUMENTS

| | | |
|---|---|---|
| DE | 10 2009 051 964 | 6/2011 |
| GB | 2489607 | 10/2012 |
| WO | 01/70565 | 9/2001 |
| WO | 2006/077470 | 7/2006 |
| WO | 2009/021267 | 2/2009 |
| WO | 2009/023933 | 2/2009 |
| WO | 2009/076706 | 6/2009 |
| WO | 2009/100479 | 8/2009 |
| WO | 2009/142479 | 11/2009 |
| WO | 2010/022904 | 3/2010 |
| WO | 2010/115242 | 10/2010 |
| WO | 2011/050378 | 3/2011 |

* cited by examiner

QUICK-CONNECT FIN RETENTION SYSTEM FOR A WATER CRAFT

BACKGROUND OF THE INVENTION

The present invention relates to water craft, such as surfboards and surf skis, and particularly relates to fins on water craft.

DESCRIPTION OF THE BACKGROUND ART

Various water craft are provided with one or more fins secured to their underside. These fins provide for safety and stability and to allow a user better control of direction and maneuverability. Water crafts that employ the use of fins may include hulled crafts such as boats, kayaks or shell or one or more elongated platform crafts including, for example, surfboards, paddleboards, surf skis and wind surfers.

The present invention relates to fins and their attachment to small water craft and, more particularly to a system for quickly securing a releasable fin or fins to elongated platform crafts, such as surfboards.

As it has become commonplace for riders of all levels to prefer certain fin profiles for particular conditions or riding styles, it also became more practical and desirable to provide such craft with integrated slots or fin boxes capable of accepting interchangeable fins. Recently, the use of recreational water crafts, especially surfboards and paddleboards, has become more accessible to even casual users. This rise in accessibility and popularity as an everyday recreational activity has also led to the emergence of large multi-purpose recreational sites, schools, clubs and programs. Group classes or sessions at these locations may see a single instructor responsible for a dozen or more users at one time. In addition, large group events held on- or off-site by these clubs and programs may be predicated on the on-demand assembly and concurrent use of a large number of individual finned water craft. The challenges now faced by users now shifts to one of bulk transportation, assembly, storage and maintenance.

To address the newly realized transportation and storage needs that arose with this increase in popularity, it is envisioned that there is a need for an improved water craft fin attachment or fix box system. This improved fin box must provide a reliable, safe and secure attachment for one or more fins, without compromising durability, control or maneuverability of the craft. In addition, in many cases, it may be advantageous to minimize device complexity. In certain instances, an improved fin box should be quickly operable without the use of additional devices including screws, locking-pins or tools. When employed, additional devices including screws, locking-pins or tools may be relatively simple, but remain durable to allow for repetitive use. Finally, the improved fin box should be dimensioned with minimal tapering to minimize absolute reliance upon on a press or friction fit, which through repeated use may wear down a traditional fin box and fin, rendering the craft unsafe or inoperable. In instances, where a tapered, press or friction fit may be advantageous, it is envisioned that the improved fin box be configured to minimize the wear resulting from repetitive use. Furthermore, where friction is used to secure the fin to the fin box, it may be desired that the surface be formed of a replaceable material to maximize friction without compromising device operation and safety.

The present applicant disclosed in WO2006/077470 arrangements of fin boxes adapted to accept a variety of proprietary fin tab configurations.

A common feature of traditional fin systems, which provide for replaceable fins to be retained within a fin box, is the securing of the fin base which contacts the craft in a fin box by means of one or more screws. These screws may be grub screws and are generally provided with a hexagon drive socket at one end and threaded for their entire length. One problem with this arrangement is that a user may easily over-drive the screw against the fins or tabs. In addition, it is common for use to result in damage to the fin tabs and/or the fin box. Specifically, boards used in school or group classes require the additional safety aspect of using a soft flexible fin to prevent accidental injury to novice surfers. These soft flexible fins is that they are even more easily damaged by securing mechanism using screws and locking pins, requiring repeated replacement, an unnecessary and costly disruption to the group activities. Repetitive tightening or loosening of screws may also affect the threads/socket by wearing down or stripping the mechanism, rendering the entire fin attachment area inoperable.

Another further issue that may arises with fin boxes adapted to accept various fin tab configurations is that the length of slot required to access such a fin. Distortion of the box may occur when heavy lateral loads are applied to large fins housed within similarly large boxes. This lateral load can be further exacerbated by the over-tightening of retention or grub screws or by placing unintended weight on the fin while the craft is not in use. While these loads are typically minor when the crafts are in use in the water, transportation and storage, especially in bulk, can result in unintentional strain on the fin and fin box, resulting in fin box distortion and damage to the fin, fin box or craft itself. In many cases, damage to the fin box generally manifests itself as irreparable distortion to the walls of the fin box in the form of widening or spreading of the walls of the slot of the fin box.

The fin box disclosed herein addresses or at least ameliorates all or some of the above disadvantages.

The term "comprising" (and grammatical variations thereof) is used in this specification in the inclusive sense of "having" or "including", and not in the exclusive sense of "consisting only of".

The above discussion of the prior art in the Background of the invention, is not an admission that any information discussed therein is citable prior art or part of the common general knowledge of persons skilled in the art in any country.

In this specification, terms such as upper, under, lower and vertical etc. refer to surfaces and directions when a water craft is oriented for use with its median plane substantially horizontal.

SUMMARY OF THE INVENTION

A fin attachment system for a water craft is disclosed including a fin box adapted for recurring insertion and releasable attachment of a fin to an underside of said craft by a combination of vertical and horizontal action; said fin box comprising a centrally located elongated slot dimensioned to slideably receive a fin base comprising at least one fin attachment mechanisms, a forward fin attachment mechanism that may comprise a forward lateral extension tab, and an optional rear fin attachment mechanism may also comprise a lateral extension tab, the rear lateral extension tab.

In some cases, a single fin attachment mechanism is preferred for simplicity and ease of construction or use. In other aspects, at least two fin attachment mechanisms (located relatively forward and rearward) are preferred along the fin base and may be used for insertion and attachment to the fin box. A second attachment point would not only increase holding strength but also act to provide resistance to lateral forces that may be applied to the fin. With both types of attachment mechanisms, the fin and fin base may enter the fin box through one or more vertical access slots. Once the fin is at least partially placed within the fin box to begin the insertion sequence, the fin may be maneuvered over one or more steps to lock securely into a final attached position. Based on the specific interaction of the fin base and fin box, the angle and position of the fin base and fin box relative to one another may determine the specific insertion and locking sequence needed to operate the fin.

Typically, in one of the final steps of the insertion sequence, the lateral extension tab or tabs of the fin base may be pulled along the base of the elongated slot to fit together with the corresponding lateral groove. The lateral groove is located at the base of the fin box and is configured in line with the elongated slot with a shape corresponding to the extension tab or tabs. Once fully inserted into the fin box, the fin would be secured by one or more reversible mechanisms. In addition to any fin securing or locking features, simply using the craft with attached fin will apply a drag factor to the fin to help maintain its final rearward position. As needed, the release of the fin can be accomplished by performing the steps of the insertion sequence in reverse order.

In at least one attachment system with a single forward fin attachment, the forward fin attachment mechanism may comprise a lateral extension tab and be dimensioned to have a rectangular plan shape complimentary to be received in the forward vertical access slot of the fin box. The forward vertical access slot may be dimensioned to vertically receive the forward fin attachment. Once inserted into the fin box, the fin would be secured following a specific predetermined locking sequence. To secure the fin base to the fin box using a single fin attachment, the fin base or fin box may be configured to apply vertical pressure to the fin in an upward direction when the fin attachment mechanism is inserted into the lateral groove of the fin box.

It is envisioned, for example, that a fin may comprise a fin base configured with a shape, feature or combination thereof to provide upward vertical pressure biased against the base of the fin box. Some shape features that may apply such pressure include a slight curved longitudinal profile in the fin base or a slight upward curve within the fin box. Features within the fin that would provide biasing may include a small friction pad along the fin base, an expandable material along the fin base or within fin box, or detent configured on the fin or within the fin box, with a corresponding groove (matching the shape opposite the detent). A small detent or raised surface within the lateral groove or elongated slot may additionally secure the forward or rear fin attachment mechanism once positioned following the insertion sequence. Additional features may be configured along the fin base or fin box to accommodate these features or may be dimensioned to securely accept these features when the fin is positioned in its final rearward position following the steps of the insertion sequence.

In an alternative attachment system, one or more fin attachments may enter the same vertical access slot of a fin box. The vertical access slot provides access to an elongated slot with a single lateral groove. In some cases, the rear fin attachment mechanism would gain entry into the vertical access slot from an angled position. The forward fin attachment mechanism may comprise a lateral extension tab be dimensioned with a shape (e.g. rectangular plan shape) complimentary to the forward vertical access slot of the fin box. The forward vertical access slot would therefore be dimensioned to receive the forward fin attachment. Once inserted into the fin box, the fin would be secured following a predetermined insertion and locking sequence specific to that particular fin and fin box configuration.

In a further attachment system, both the forward and the rear fin attachment mechanism with their respective lateral extension tab may be dimensioned to have a shape complimentary to the respective vertical access slot of the fin box, such that the tabs may be slideably received in the slot in a normal or near-normal orientation. It is further envisioned in some instances that the distance between access slots may be greater than the distance between the forward and rear fin attachment mechanism(s), requiring the user to insert each fin attachment mechanism sequentially. The fin would then be secured by following an insertion sequence specific to that particular fin and fin box configuration.

In a further attachment system, at least one, but not all the fin attachment mechanisms of the fin base may be dimensioned to have a shape complimentary to the respective vertical access slot of the fin box to be slideably received in the slot in a near normal (perpendicular) orientation. The distance between access slots may be greater than the distance between the forward and rear fin attachment mechanism, requiring the user to insert each fin attachment mechanism sequentially and to follow a predetermined insertion and locking sequence specific to that particular fin and fin box configuration.

In addition, as further precautionary and safety feature, the attachment mechanism (either forward or rear) of the fin base that is not dimensioned with a shape complimentary to its respective vertical access slot of the fin box may instead be dimensioned with a shape to be slideably received in the slot at an angled or vertical orientation. The elongated slot of the this fin box design would be configured to allow the fin to return to a near normal orientation after the entry of one (e.g. the rear) fin attachment mechanism and subsequently receive the remaining (e.g. forward) fin attachment mechanism in its respective vertical access slot. A specific insertion and locking sequence particular to the fin and fin box configuration would then be used to secure the fin.

Specifically, in at least one aspect, the rear fin attachment mechanism and lateral extension tab may be dimensioned with a length greater than its height, such that the fin attachment mechanism may only be slideably received by the rear vertical access slot from an angled or vertical orientation. The height of the lateral extension tab is complimentary to the lateral groove and once inserted into the fin box, the fin would be secured following a specific predetermined locking sequence. In some instances, this variable height may also be applied to the front fin attachment mechanism.

For more complex and higher performance crafts, the ability to attach additional fins may be desirable. In addition, it may be advantageous or desirable to the user to add fins at a canted and angled orientation. In further crafts, it may be advantageous or desirable to enable a user to add multiple fins at various angles and shapes in a single universal fin box.

In order to attach additional fins, additional fin boxes may be added to the craft. In addition, it is envisioned that single compound fin box with multiple elongated slots may be used to accommodate more than a single fin. Based on the configuration of the fin(s) and fin box(es), each may be secured following a specific predetermined locking sequence for a single individual fin, as described herein.

To achieve insertion of canted or angled fins relative to a water craft, a fin box with a vertical slot may be inserted at an angle into a core of said water craft for a left or right side canted fin. Alternatively, a fin box with at least one canted slot may be inserted vertically into a core of said water craft for a right or left-side canted fin. Several fins may be attached to the board in this manner with specific severity of angle. Combinations of the embodiments described herein may be used to secure fins, as needed, for their particular or desired advantages.

A fin system is disclosed herein for releasibly securing a fin to a water craft the system including: a fin box with at least one elongated slot open at a first surface of the fin box and extending a depth inward towards a closed base opposite the first surface; one or more fixed securing features in the fin box, below the first surface and adjacent and open to the at least one elongated slot; one or more vertical access slots in the fin box, open at one end to the first surface, adjacent and open to the at least one elongated slot and extending the depth inwards towards the closed base; and, a fin with a fin base dimensioned to be slideably received by the at least one elongated slot of the fin box, wherein the fin base includes one or more fixed fin attachment mechanisms each having at least one tab or recess dimensioned to be received first by the one or more vertical access slots and received subsequently by the fixed securing features, wherein an engagement of the at least one fin tab or fin recess with the securing features secures the fin in the fin box.

DESCRIPTION OF PREFERRED EMBODIMENTS

Figure 1:
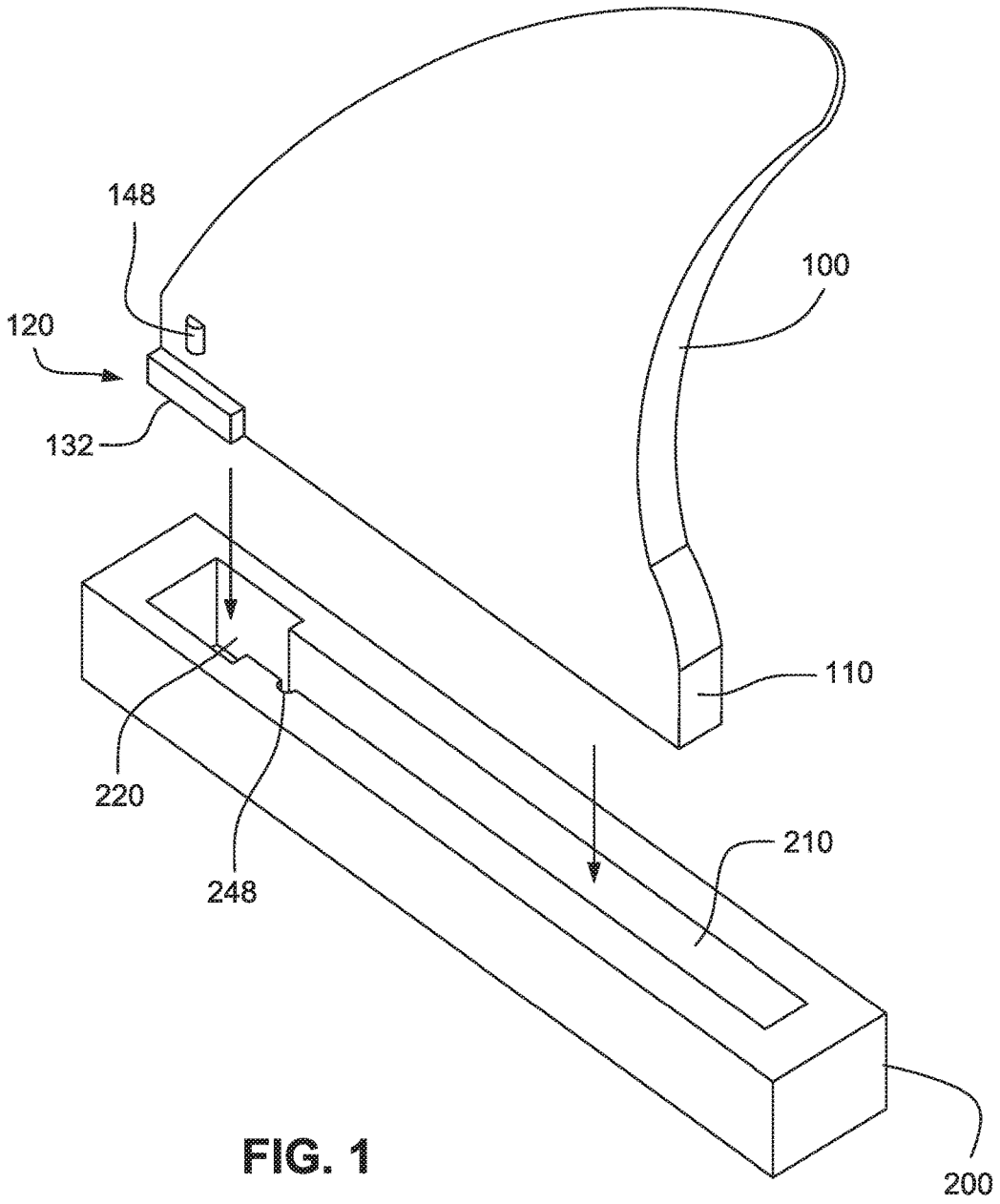
FIG. 1 is a right-side perspective view of a fin with a single fin attachment mechanism and corresponding fin box.

The quick-connect fin system disclosed herein generally comprises a fin and a complementary fin box comprising a housing body portion where a fin with fin base may be inserted and secured. The fin box generally consists of a substantially rectangular block with a closed base (that may be sealed to the interior of the craft installed and in use) of the block in which is provided at least one elongated slot extending longitudinally along the centerline of the box. This elongated slot may have a shape similar to the substantially rectangular block, but at a reduced size. The slot may further comprise one or more vertical access slots, widened portions along the length of the elongated slot that may be dimensioned to accept the fin and fin base. From the complementary configuration of the fin and fin box, the system provides a mechanism to secure a fin within a fin box for quick release or connections, as needed.

Additionally, the fin box can comprise a peripheral flange at or adjacent to the surface with the elongated slot extending outwardly from the housing body. The installation of the fin box into a water craft may be performed by cutting a body portion recess in the core of the craft for the nesting of the body portion, and a peripheral recess to accommodate the flange. The flange may be offset a little from the surface with the elongated slot to allow glassing over of the flange to lock the fin box within the underside of the craft, creating a water-proof seal over the fin box and leaving only an area around the slot exposed.

The fin box may include a mid-height center cross-brace to minimizes distortion of the fin box. Tapered flanges on the fin box allow the fin box to have multiple orientations for the varying bottom contours on different surfboards. Angled fin box shapes may allow for the installation of canted fins with a normal or near-normal fin box orientation. Perforations in the flange may allow resin around the base of the fin box to pass through the perforations and create a bond with the fiberglass skin of the surfboard surface. Flange surface grooves increase the bonding area for resin saturated fiberglass skin.

The fin box, which may be partially or fully imbedded within the core of a water craft or surfboard may be further secured with the use of one or more deck pins attached to the inner wall of the box. The deck pin is generally envisioned to be a long cylindrical fastener that may be threaded along the body and it is envisioned that use of the pin does not have an effect on the insertion sequence of the fin. In some embodiments, the deck pin may comprise a bugle or countersunk head to be flush with the inner wall of the box. Several common drive shapes may be rotate the pin, and this rotation is used to tighten or loosen the pin. In some instances a hexagonal shape may be preferred to reduce slippage when operating the deck pin. When only a single pin in employed, the pin may be positioned near the center of the fin box to maximize the stability of the box. In some embodiments, the pin may be further equipped or combined with a feature (e.g. spacer, belleville washer, wave washer, wear pad, locking device, etc.). Operation of the pin to cause it to tighten or loosen may be performed, as usual, to secure the fin box for use.

While it is envisioned that an attachment mechanism such as a deck pin may be used to attach to any portion of water craft or surfboard that is configured to receive the point or cylinder of the pin, it advantageous in some instances to secure certain sections of the fin box. It may be preferred that the mechanism enter the fin box and water craft or surfboard in a normal (perpendicular) orientation to maximize the force of the pin and box against the water craft or surfboard. However, if such an orientation is not possible, the orientation of the mechanism (e.g. pin) or fin box may be modified to satisfy the dimensional requirements. In addition, anchoring mechanisms that possess a large cross sectional areas (e.g. a disk, washer, plate, etc.) may be present within the core of the water craft or surfboard may be attached to any deck pins used to secure the box. In some embodiments, it may be advantageous to secure one or more pins to the fin box and/or water craft or surfboard. In combination, or alternatively (e.g. where the depth of the fin box in not uniform), it may be advantageous to secure the deck pin within the fin box in sections capable of accommodating the pin, but where the thickness of the fin box wall is also greatest.

Generally, the fin used in the system disclosed herein comprises a body formed of moldable material, such as molded plastic (or fiberglass, metal or a combination of materials) formed to extend outwardly from the body of the craft to provide an outwardly extending external contour and fin profile so as to reduce drag on said fin while imparting stability or other desired characteristics to the to the water craft or surfboard. The fin may further comprise a fin base configured with fin attachment mechanisms, in some instances, in the shape of tabs, the fin base dimensioned to complement the width of the elongated slot of a fin box, such that the fin base may be inserted, and secured to or subsequently removed from the fin box by performing or reversing the steps of a unique insertion sequence.

This system allows for one or more fins to be secured to a water craft quickly and reversibly. Following the insertion sequence, additional measures may be used in combination to further secure the fin base to the box and craft. The quick-release fin system also through these measures (grub screws, bolts, pins, or combinations thereof) may reduce the operating speed and simplicity of the system, but the benefits in terms of security and permanence may be desired in some embodiments. Additional features within the fin or fin box may be added to increasingly support the fin base in the fin box, to secure the fin within the fin box, and to reduce the risk of breakage, distortion or damage to the fin, fin box or water craft.

A. Single Access Slot with Single Fin Mechanism

In at least one envisioned embodiment, the fin 100 comprises a fin base 110 with a single fin attachment mechanism 120, as shown in FIG. 1. A fin attachment mechanism 120 may be located at the front or rear (forward or rear) of the fin base 110. In FIG. 1, the single forward fin attachment mechanism 120 is located near to or at the front of the fin base 110 and corresponds to a fin box 200 with an elongated slot 210. The fin attachment mechanism may be a lateral extension tab 132 and a detent 148 on one or both sides of the fin. In this embodiment, the lateral extension tab 132 of the fin attachment mechanism 120 provides a widened rectangular footprint that corresponds specifically to the shape of the fin box 200.

Figure 2:
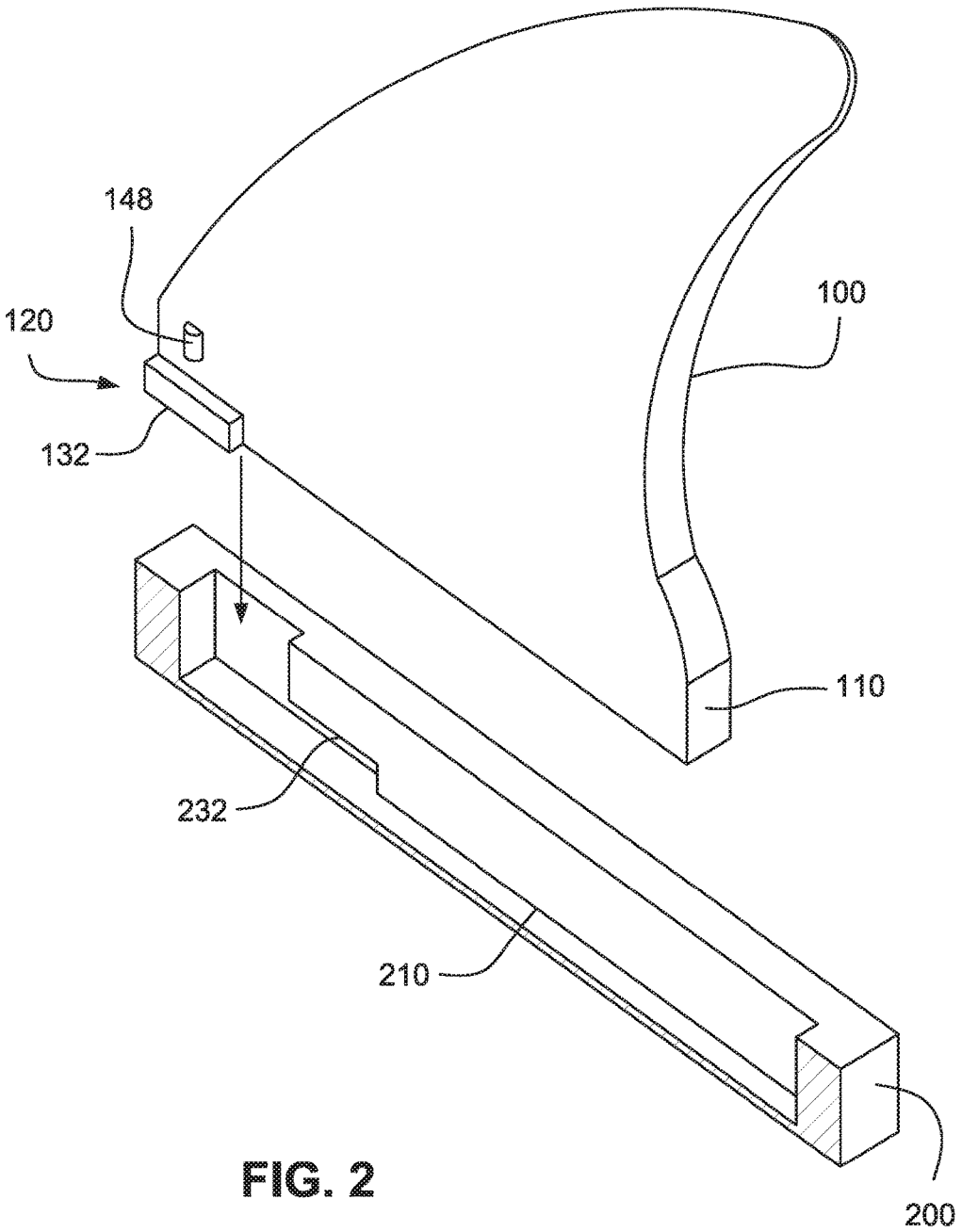
FIG. 2 is a right-side perspective view of a fin with a single fin attachment mechanism with a cross sectional view of the corresponding fin box.

The fin box 200 of FIG. 1 is also configured with a vertical access slot 220, shown in additional detail along the cross-section provided in FIG. 2. The vertical access slot 220 is dimensioned to slideably receive the fin attachment mechanism 120 with the lateral extension tab 132 or tabs (one of each side), as shown in FIG. 3.

Figure 3:
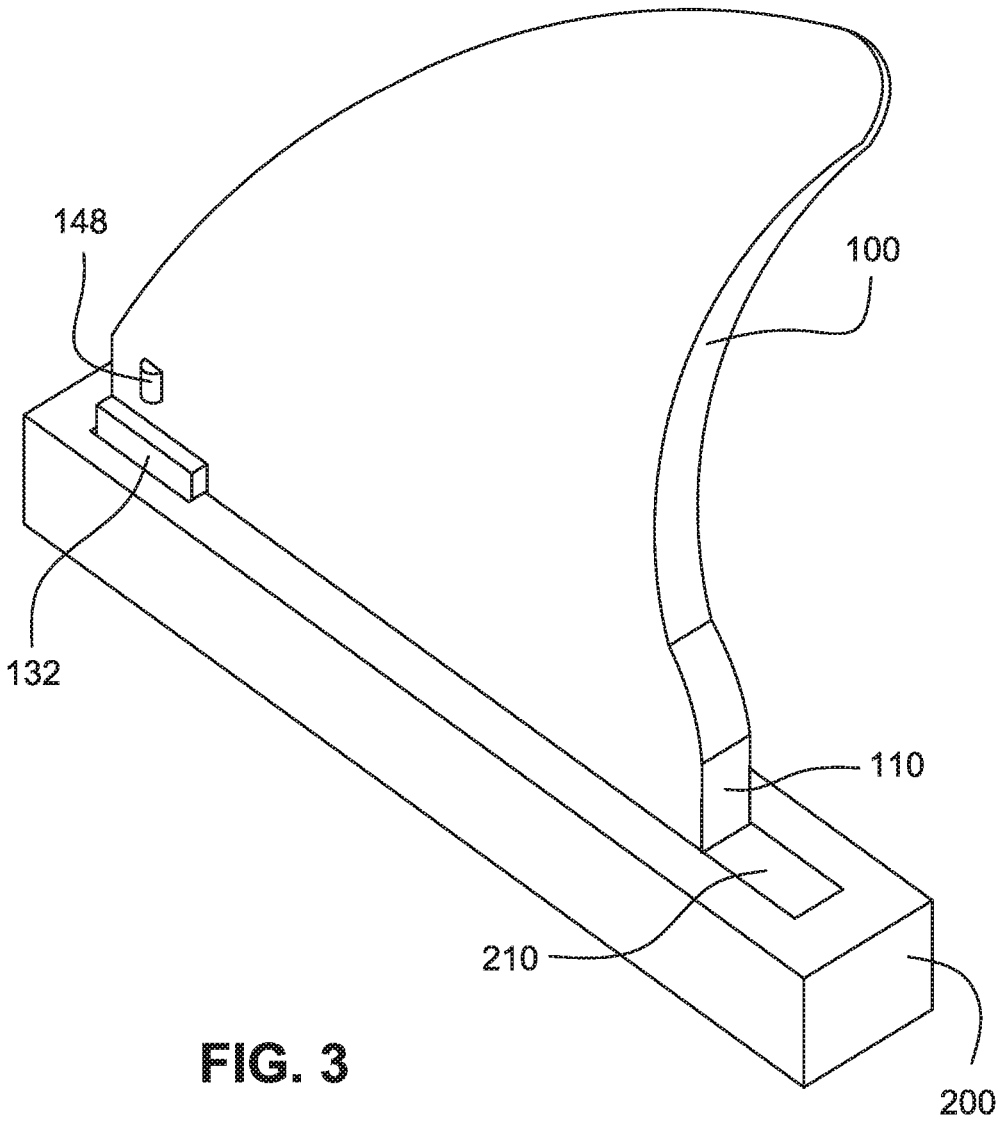
FIG. 3 is a right-side perspective view of a fin showing interaction with fin box initiating the fin insertion sequence.
Figure 4A:
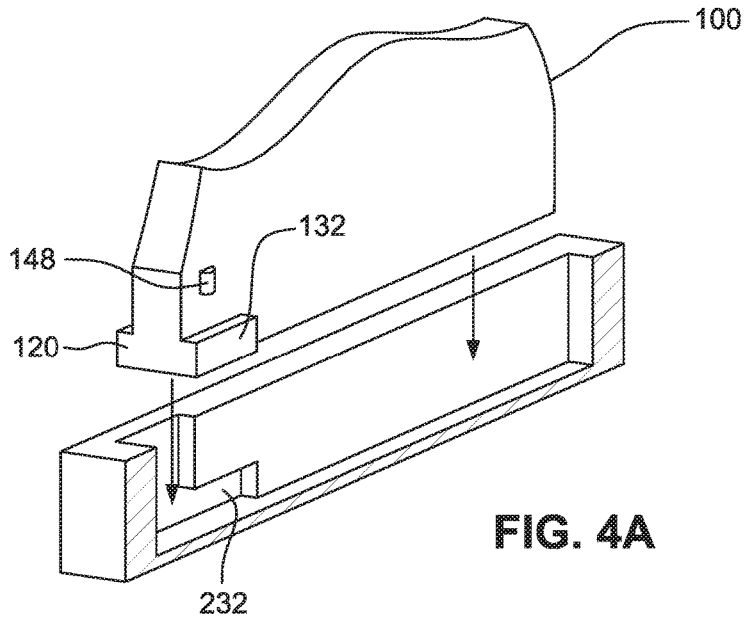
FIG. 4A is a left-side perspective view of a fin with a single fin attachment mechanism oriented to be slideably received by the fin box shown in cross section, just prior to the initiation of the fin insertion sequence.
Figure 4B:
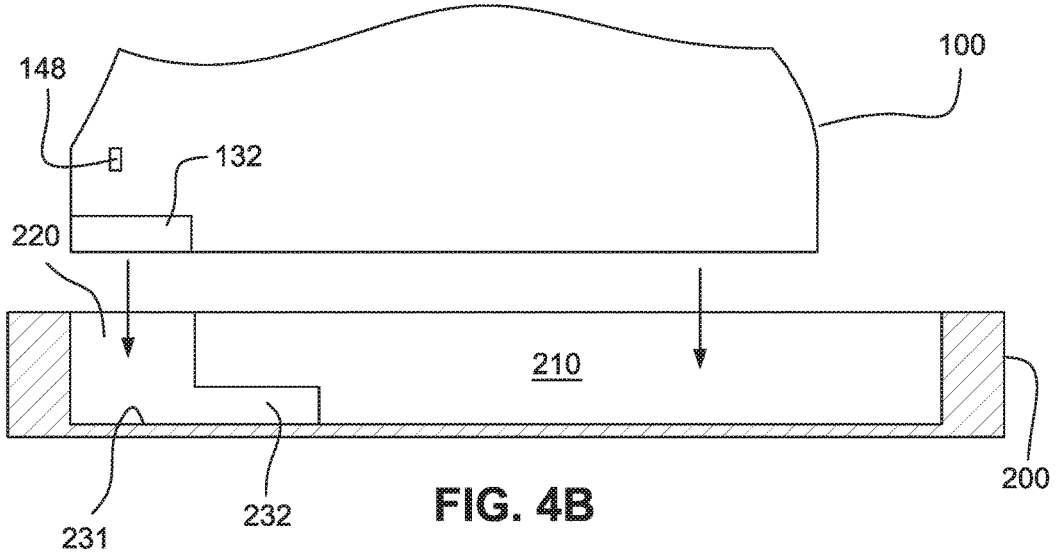
FIG. 4B is a side elevation view of a fin with a single fin attachment mechanism oriented to be slideably received by the fin box shown in cross section, just prior to the initiation of the fin insertion sequence.
Figure 5A:
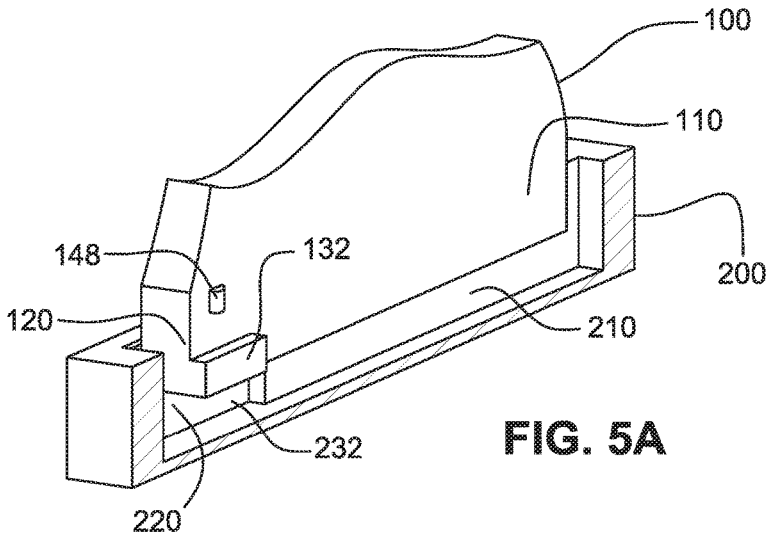
FIG. 5A is a left-side perspective view of a fin with a single fin attachment mechanism configured within a cross sectional fin box, the fin shown in an intermediate step of the fin insertion sequence.
Figure 5B:
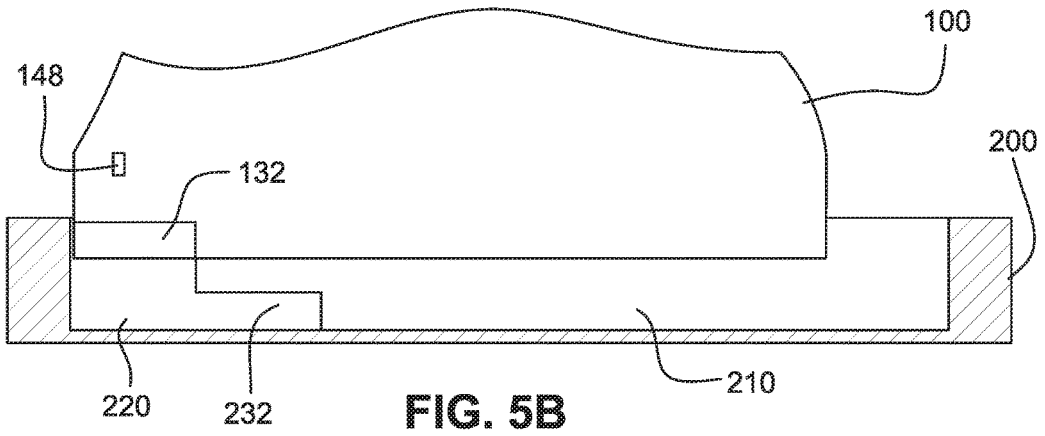
FIG. 5B is a side elevation view of a fin with a single fin attachment mechanism configured within a cross sectional fin box, the fin shown in an intermediate step of the fin insertion sequence.
Figure 6:
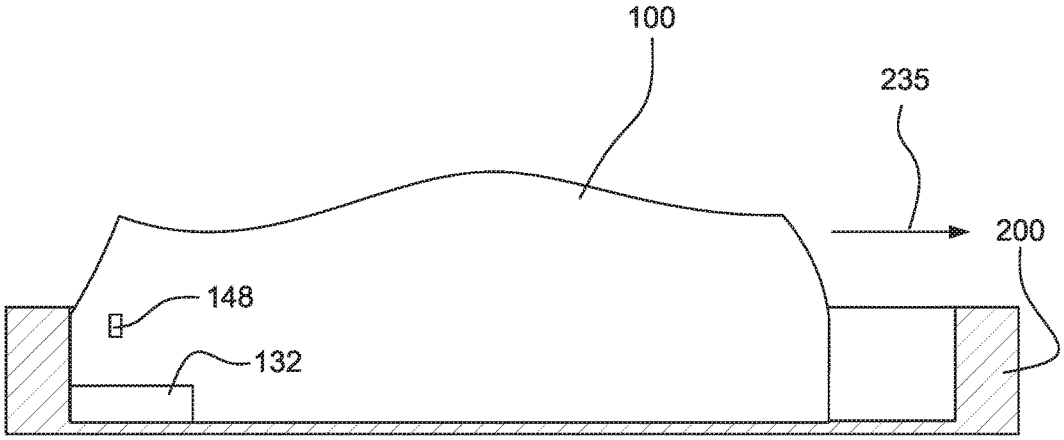
FIG. 6 is a side elevation view of a fin with a single fin attachment mechanism configured within a cross sectional fin box, the fin shown in an intermediate step of the fin insertion sequence.

The insertion sequence is shown in FIGS. 3, 4A, 4B, 5A, 5B, 6, 7A and 7B. To begin the insertion sequence, as shown in FIGS. 3, 4A and 4*b*, the fin 100 is positioned above the open slot 210 of the fin box and the lateral extension tab 132 is aligned with the vertical access slot 220 of slot 210. The lateral extension tab 132 slides down into the vertical access slot 220 as shown in FIGS. 5A and 5B.

The downward sliding movement of the lateral extension tab 132 in the vertical access slot 220 continues until the bottom edge of the fin base reaches the bottom 321 of the slot 210. When the fin base is at the bottom of the slot 210, the lateral extension tab(s) 132 may be slid into a lateral groove(s) 232 on one or both sides of the slot 210. The upper edges of the lateral grooves 232 prevent the lateral extension tab(s) 132 and thus the entire fin from being pulled vertically out of the slot 210 in the fin box. The lateral extension tab(s) 132 are slid into the lateral groove(s) 232 by sliding the fin in an axial direction 235 (FIG. 6), such as rearward, along the slot while the fin base is at the bottom of the slot 210.

Figure 7A:
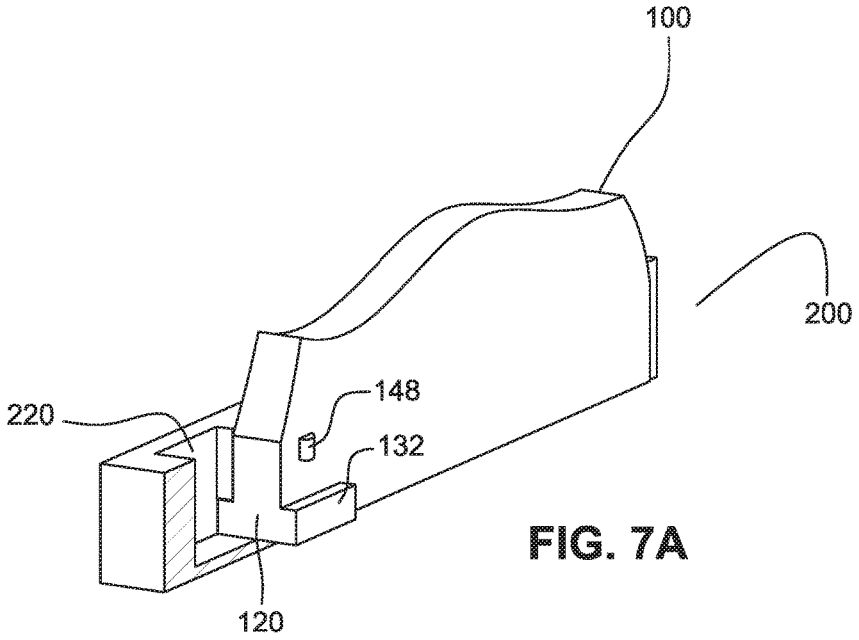
FIG. 7A is a left-side perspective view of a fin with a single fin attachment mechanism configured within a cross sectional fin box, the fin shown fully inserted and secure following the intermediate steps of the fin insertion sequence.
Figure 7B:
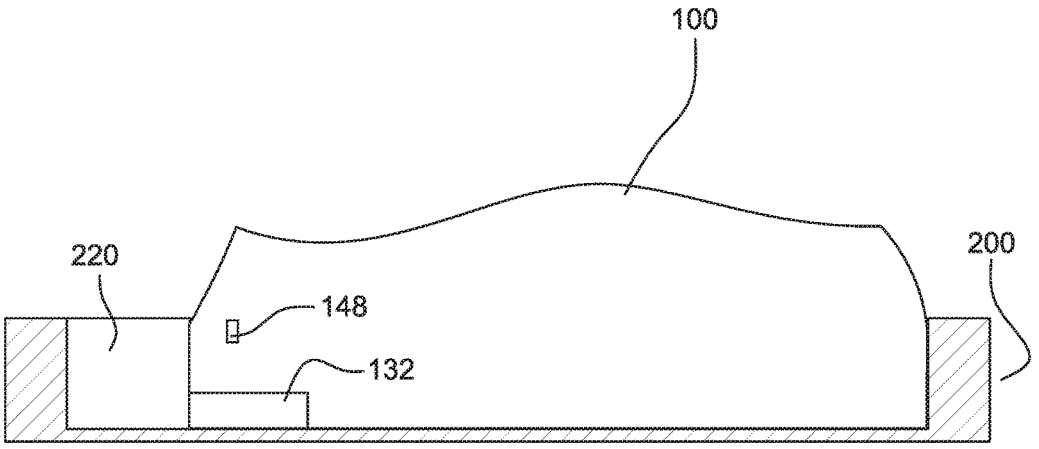
FIG. 7B is a side elevation view of a fin with a single fin attachment mechanism configured within a cross sectional fin box, the fin shown fully inserted and secure following the intermediate steps of the fin insertion sequence.
Figure 8:
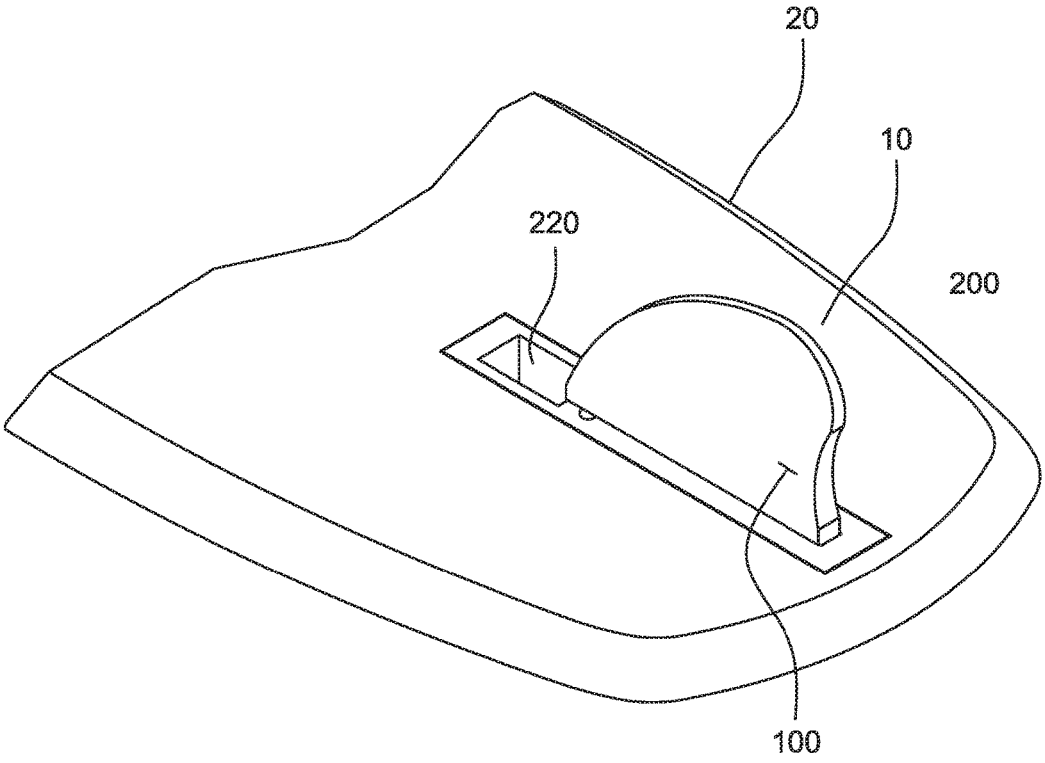
FIG. 8 is a right-side perspective view of a fin with a single fin attachment mechanism and fin box, the fin shown fully inserted and securely oriented toward the stern of the water craft following the steps of the fin insertion sequence.

In FIGS. 7A and 7B, the lateral extension tab 132 has been brought rearward into the complementary lateral groove 232 of the fin box 200, securing the fin 100. FIG. 8 shows the full assembly 10 with a partial board or craft 20 shown surrounding the fin 100 and fin box 200, with the fin 100 secured.

In at least one further embodiment, it is envisioned that an optional fin securing mechanism 148 in the form of a small, curved vertical detent (shown in FIGS. 1-8) may be positioned approximately midway the longitudinal length of the fin attachment mechanism 120. The detent may be positioned on either the left, right or both sides of the fin. As shown in FIG. 1, the detent 148 may be curved and would interact with a corresponding detent groove in the form of a shallow vertical cavity (in this case a semicircular) on one side of the elongated slot 210. When fully inserted toward the rear of the fin box 200, the fin 100 would be locked by the detent mechanism 148 preventing undesired forward movement of the fin 100 in a longitudinal direction.

B. Single Access Slot with Other Fin Mechanism(s)

Figure 9:
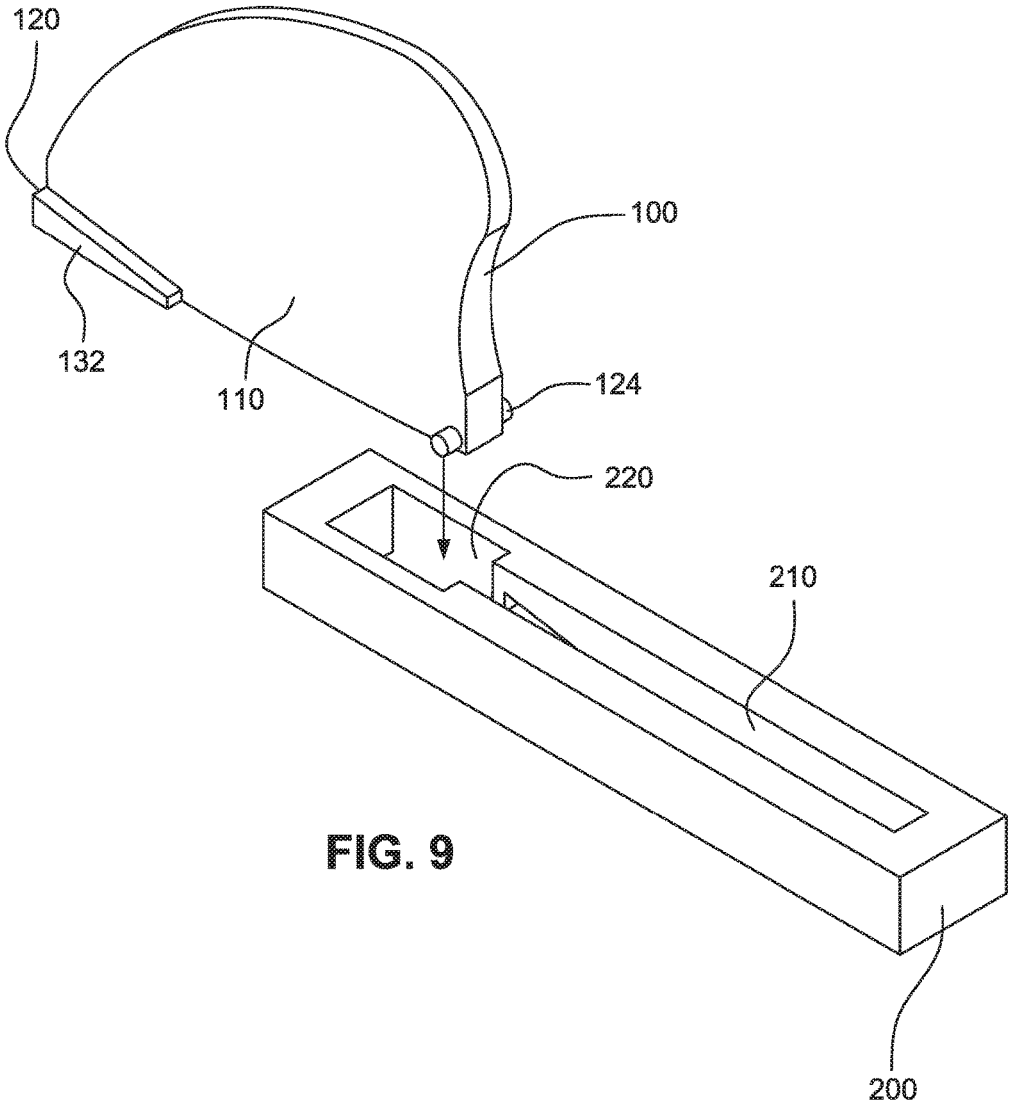
FIG. 9 is a right-side perspective view of a fin with multiple fin attachment mechanisms and a corresponding fin box with a single vertical access slot.
Figure 10:
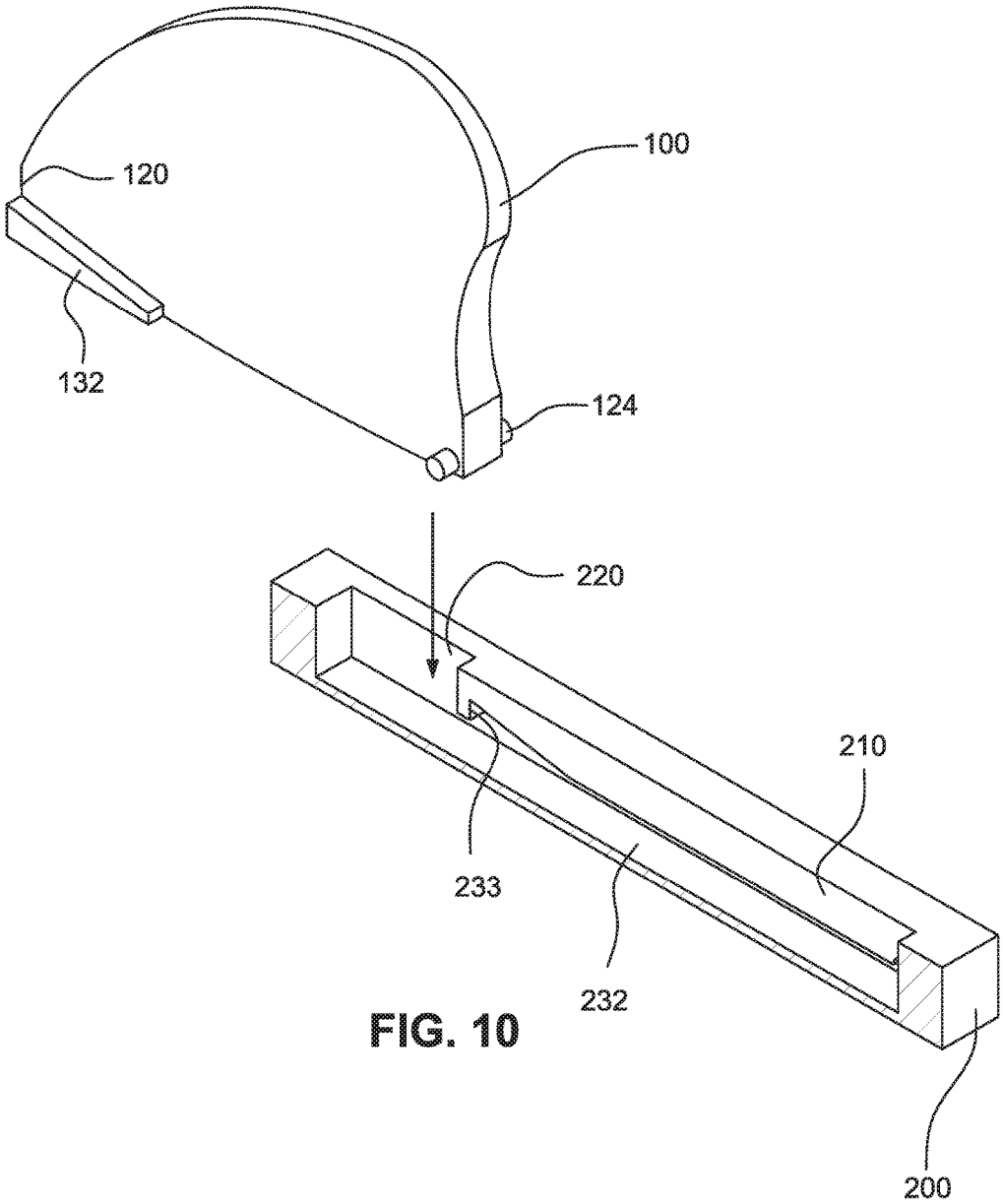
FIG. 10 is a right-side perspective view of a fin with multiple fin attachment mechanisms with a cross sectional view of the corresponding fin box with a single vertical access slot.

In at least one envisioned embodiment, the fin system 10 comprises a fin 100 and a fin base 110 with one fin attachment mechanism 120 along with one or more other attachment mechanisms 124, as seen in FIG. 9. The fin attachment mechanism (forward 120 and rear 124) may be located substantially at the front and rear of the fin base 110. In FIG. 9, the fin attachment mechanism 120 is located at or towards the front of the fin base 110 and corresponds to a fin box 200 with a similarly configured elongated slot 210. A second fin mechanism 124 is shown with a rounded cylindrical shape. Notably, in FIG. 9, as the length and width of the rear attachment mechanism 124 shown are equal and less than the length of the vertical access slot 220, the mechanism 124 may be slideably received by the access slot 220, and travel the substantial length of the fin box 200 through a lateral groove(s) 232 on one or both sides of an elongated slot 210 of the box. FIG. 10 provides a detailed cross sectional view of internal components of the fin box 200.

Figure 11:
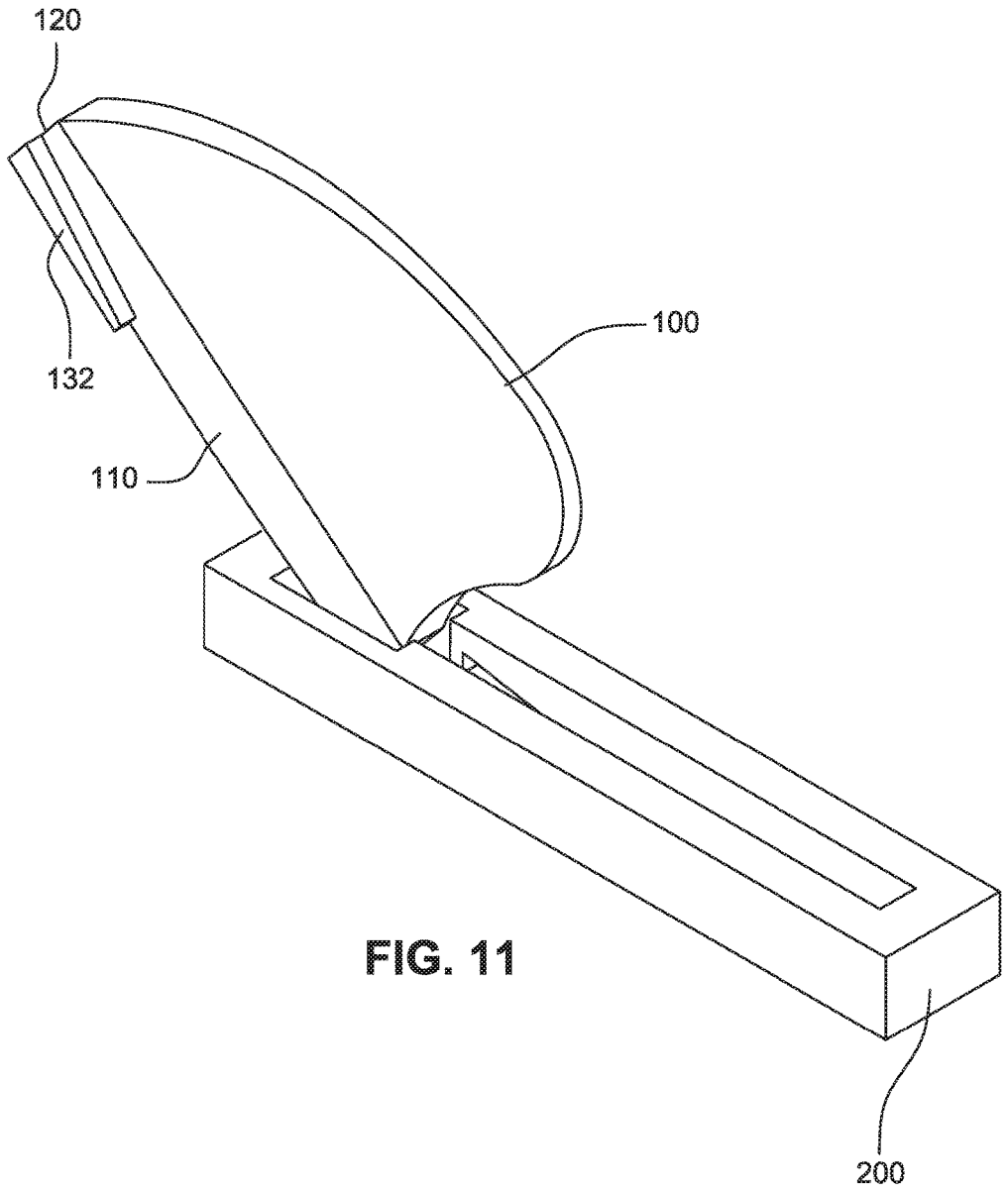
FIG. 11 is a right-side perspective view of a fin with multiple fin attachment mechanisms, showing the interaction with the vertical access slot of a fin box needed in order to initiate the fin insertion sequence.
Figure 12A:
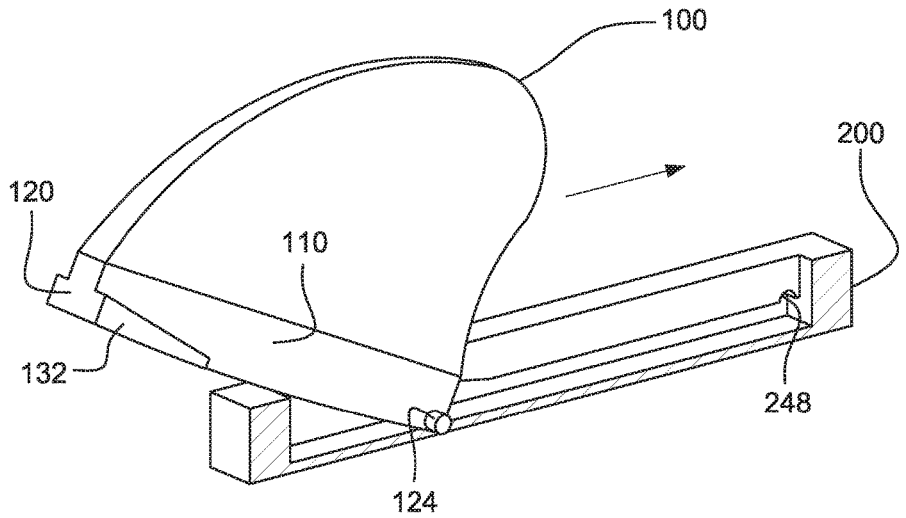
FIG. 12A is a left-side perspective view of a fin with multiple fin attachment mechanisms oriented to be slideably received in sequential order by the fin box shown in cross section, the fin shown in an intermediate step of the fin insertion sequence.
Figure 12B:
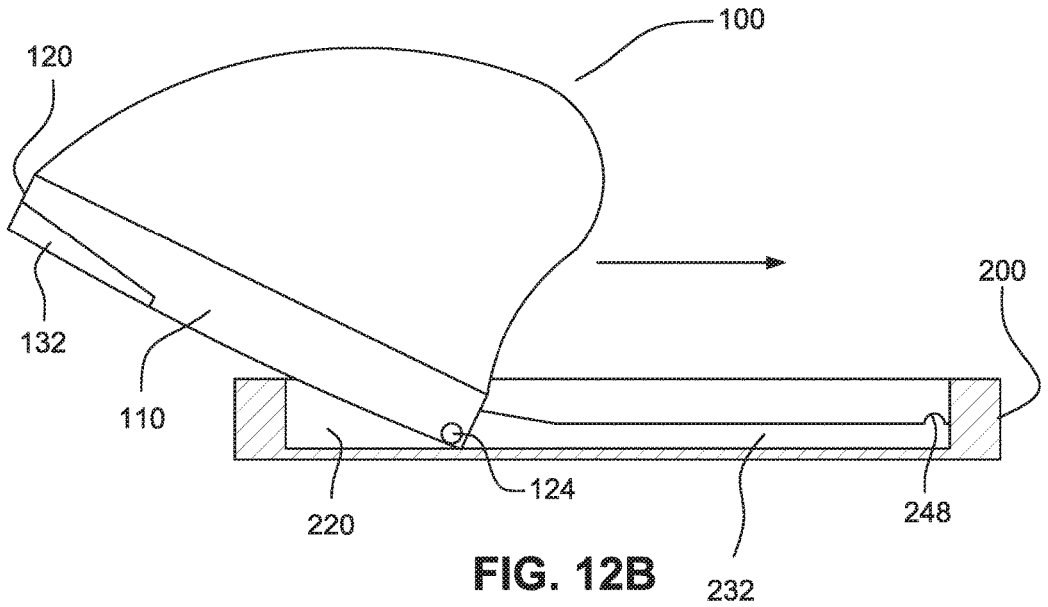
FIG. 12B is a side elevation view of a fin with multiple fin attachment mechanisms oriented to be slideably received in sequential order by the fin box shown in cross section, the fin shown in an intermediate step of the fin insertion sequence.
Figure 13A:
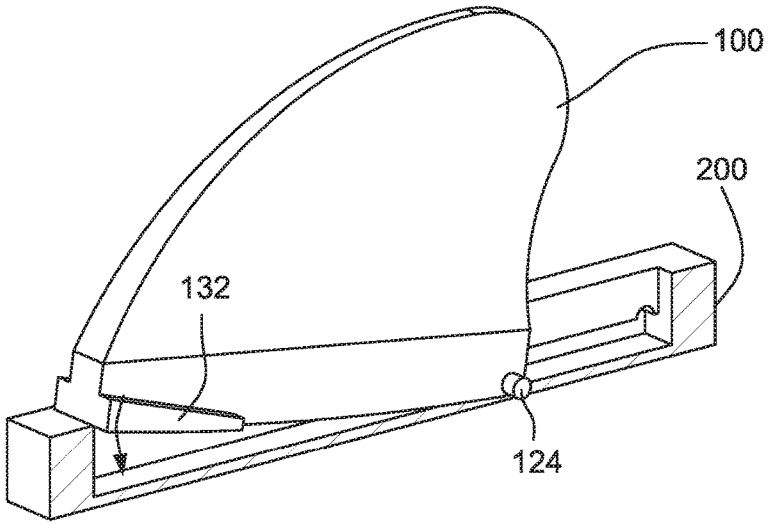
FIG. 13A is a left-side perspective view of a fin with multiple fin attachment mechanisms oriented to be slideably received in sequential order by the fin box shown in cross section, the fin shown in an intermediate step of the fin insertion sequence.
Figure 13B:
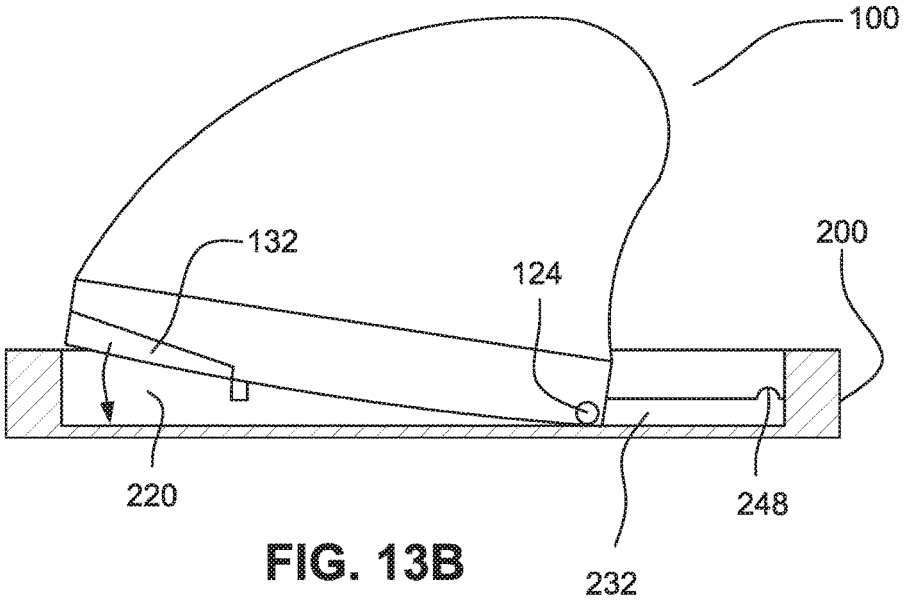
FIG. 13B is a side elevation view of a fin with multiple fin attachment mechanisms oriented to be slideably received in sequential order by the fin box shown in cross section, the fin shown in an intermediate step of the fin insertion sequence.

The vertical access slot 220 of the fin box 220 is dimensioned to first accept one fin attachment mechanism, followed by the acceptance of the second mechanism. Particularly, FIG. 11 shows the rear attachment mechanism 124 of a fin 100 being lowered into the vertical access slot 220. The insertion of the rear fin attachment mechanism 124 initiates the insertion sequence to secure the fin 100. The fin attachment mechanism 124 slides through the groove(s) 232 as the fin is slid to the rear of the fin box. The insertion of the second fin attachment mechanism 120 follows sequentially to allow both mechanisms 124, 120 to enter the elongated slot 210 of the fin box 200. Once the second fin attachment mechanism 124 is seated at the bottom of the vertical access slot 220, the fin 100 is shifted longitudinally (e.g. in a rearward direction) to secure the lateral extension tab or tabs 132 within the lateral groove or grooves 232. An edge or lip 233 with an associated ramp at a forward region of the groove 232 (FIG. 10) provides a catch or latch to lock the front edge of the lateral extension tab 132 in the groove 232. In at least one envisioned embodiment, the lateral extension tabs 132 may be tapered, but with a height greater near the front of the fin 100 and fin box 200. During use, the force of the water upon the fin 100 of the water craft 20 would help to maintain the position of the fin 100 and particularly bias the lateral extension tab 132 against the edge or lip 233. This embodiment may be advantageous as the fin 100 would be secured by both the lateral extension 132 (and corresponding fin box 200 shape) in addition to a passive mechanism, which takes full advantage of a force that in contemporary fins might otherwise be responsible for dislodging the fin. Alternatively, as shown in this particular embodiment one or more tabs may be shaped to be slideably received by the lateral groove 232 or other securing mechanism or detent-specific groove 248 of the elongated slot 210 of the respective fin box 200.

The insertion sequence is initiated, as shown in FIG. 11, with the fin base 110 in a position entering into the fin box 200. FIGS. 12A, 13A, 14A and 15A provide cross-sections of the fin box 200 and show the steps of the insertion sequence from a left-side perspective view, while 12B, 13B, 14B and 15B provide cross-sectional views of the same sequence from a side elevation view.

Figure 14A:
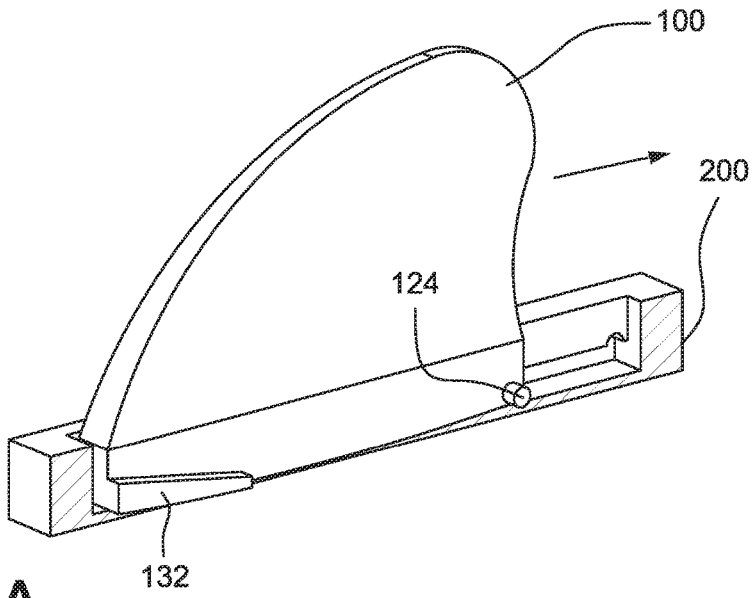
FIG. 14A is a left-side perspective view of a fin with multiple fin attachment mechanisms oriented to be slideably received in sequential order by the fin box shown in cross section, the fin shown in an intermediate step of the fin insertion sequence.
Figure 14B:
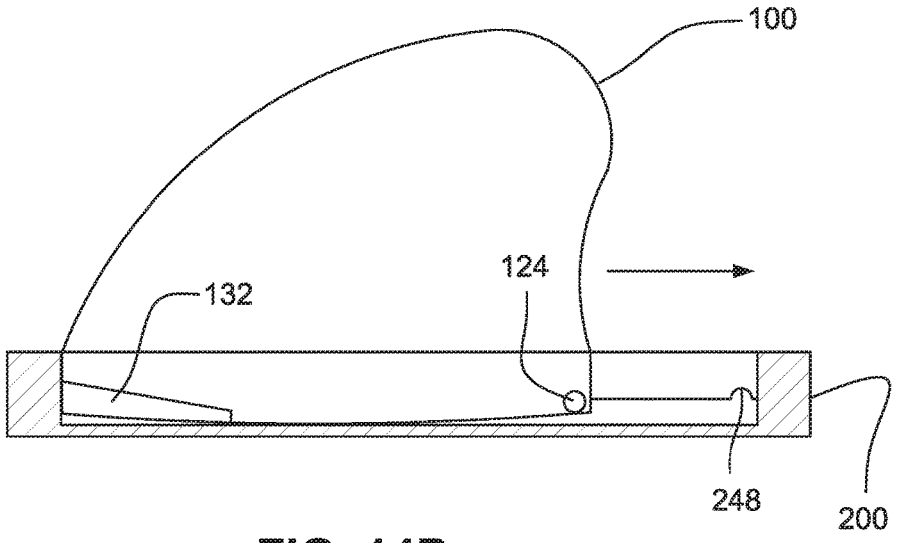
FIG. 14B is a side elevation view of a fin with multiple fin attachment mechanisms oriented to be slideably received in sequential order by the fin box shown in cross section, the fin shown in an intermediate step of the fin insertion sequence.

To secure the device shown in FIGS. 14A and 14B, the forward lateral extension tab 132 of the fin attachment mechanism may be positioned towards the rear of the fin box 200, away from the vertical access slot 220. In addition, a fin securing mechanism 148 (e.g. in the form a small ridge, divot or detent) may be configured along a lateral groove 232 or the elongated slot 210 to accept, brace or bias the fin 100, fin base 110, or one (or more) fin attachment mechanism 120. Envisioned for use alternatively or in combination with a detent 148 or other mechanism, the body of the fin base 110 may also be curved or otherwise configured to create a bias force from the fin box 200 against the fin 100, thereby securing the fin 100 and preventing unwanted release through the use of a friction fit.

The lateral extension tab or tabs 132 of the fin attachment mechanism 120, 124 may be rounded to reduce wear resulting from normal use. It may be preferred in one or more embodiments that the features of the device that are configured to be slideably positioned may be slightly rounded or curved. In addition to reducing wear over time, curved surfaces in the fin box 200 or on the fin may more easily interact with one another and may produce a slight bias force or friction fit.

Figure 15A:
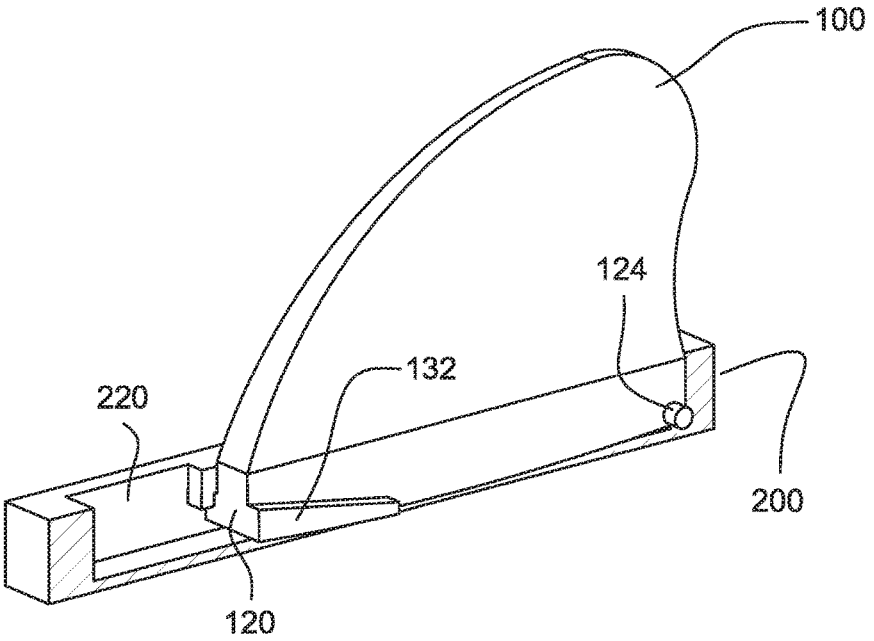
FIG. 15A is a left-side perspective view of a fin with multiple fin attachment mechanisms oriented to be slideably received in sequential order by the fin box shown in cross section, the fin shown fully inserted and secure following the intermediate steps of the fin insertion sequence.
Figure 15B:
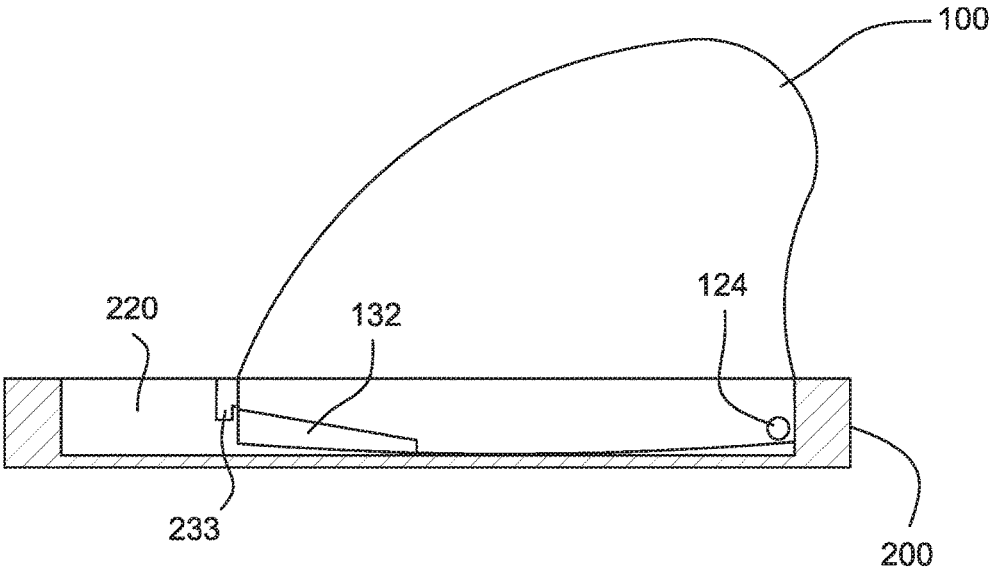
FIG. 15B is a side elevation view of a fin with multiple fin attachment mechanisms oriented to be slideably received in sequential order by the fin box shown in cross section, the fin shown fully inserted and secure following the intermediate steps of the fin insertion sequence.

Specifically, in FIGS. 15A and 15B, the lateral extension tab 132 has been brought rearward into the lateral groove of the fin box 200, securing the fin. As shown, the fin base 110 of the embodiment shown in FIGS. 15A and 15B further comprises a detent 148 and corresponding notch or groove 248 in the fin box 200 to help secure the fin in the rearward position.

Figure 16:
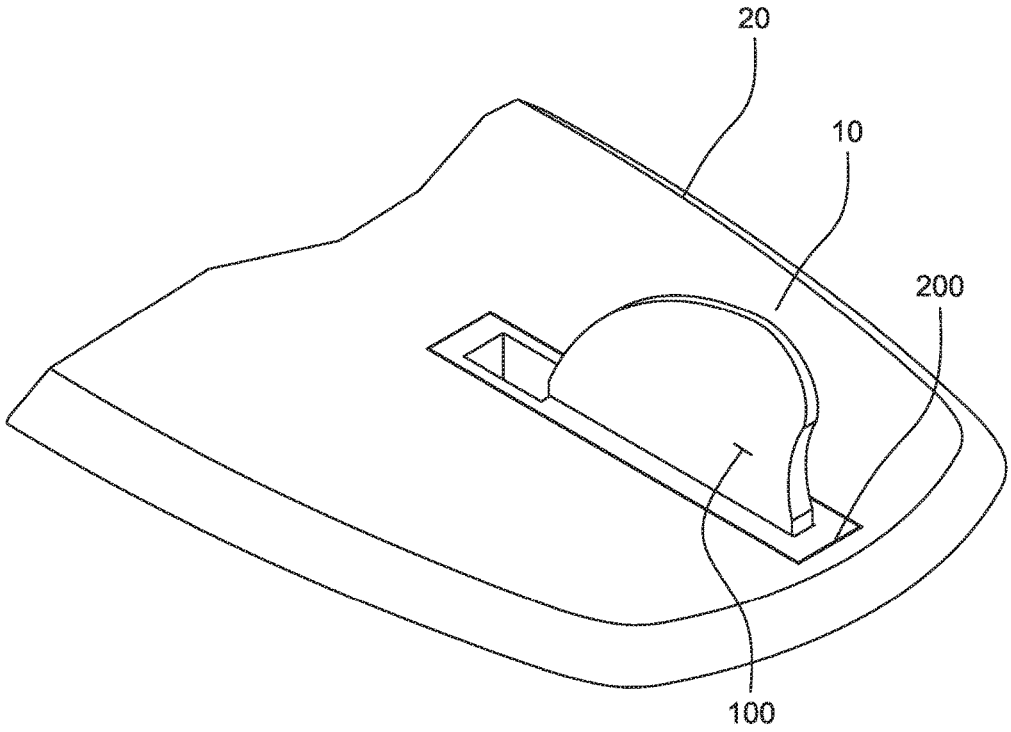
FIG. 16 is a right-side perspective view of a fin with multiple fin attachment mechanisms and fin box, the fin shown fully inserted and securely oriented toward the stern of the water craft following the steps of the fin insertion sequence.
Figure 17A:
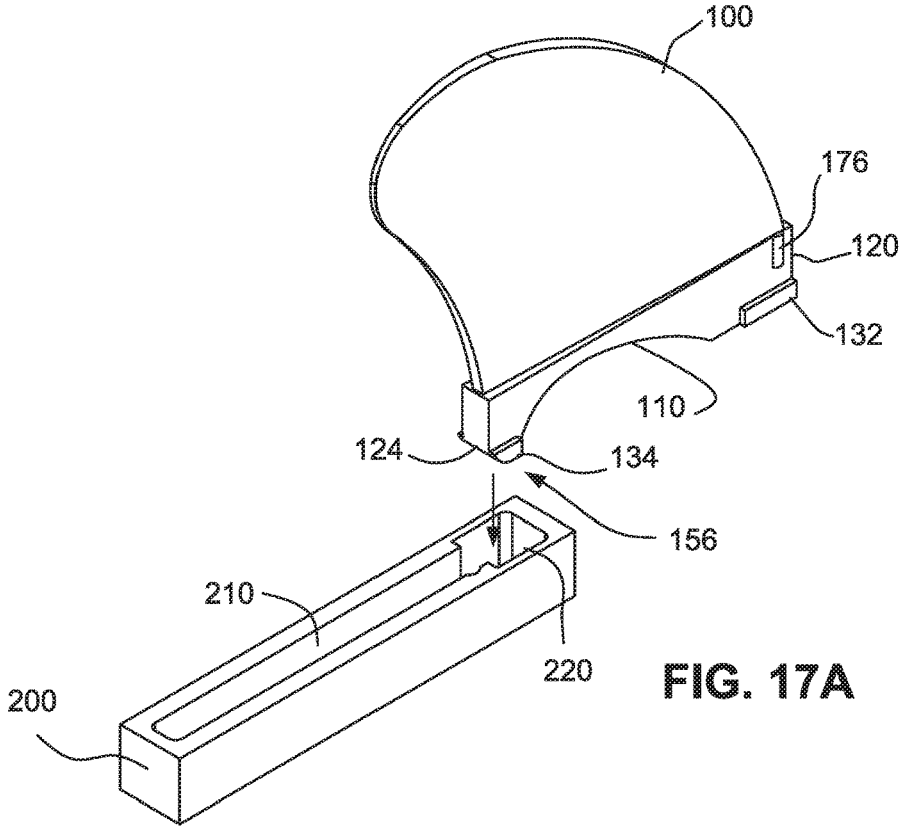
FIG. 17A, 17B are right-side and left-side perspective views of a fin with two fin attachment mechanisms shown with a corresponding fin box with a single vertical access slot.
Figure 17B:
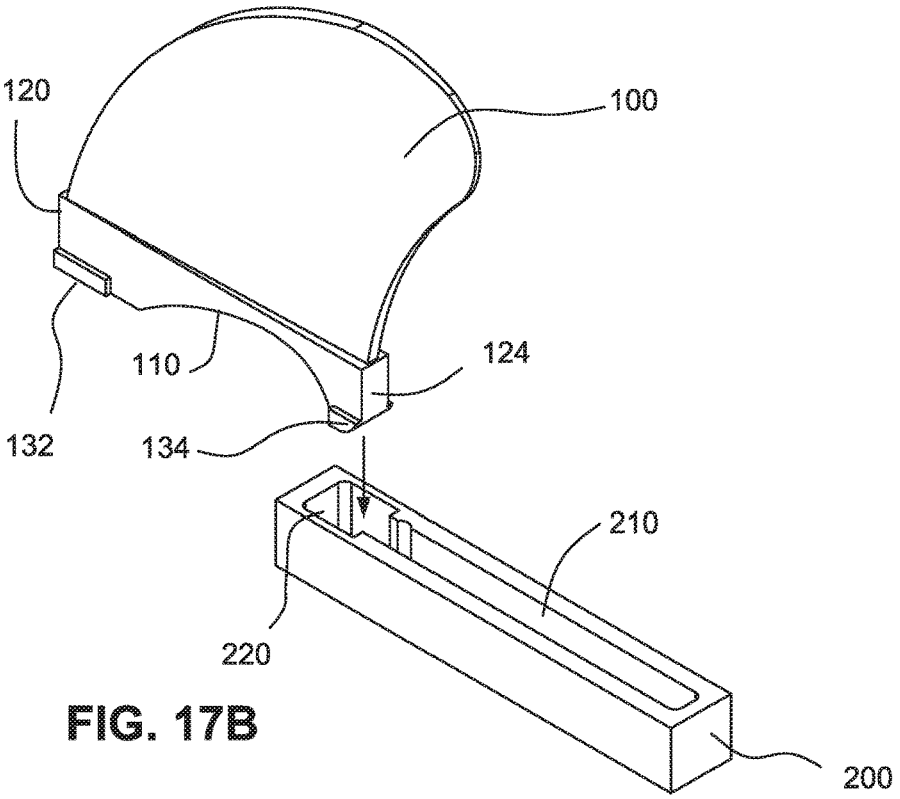
Figure 18A:
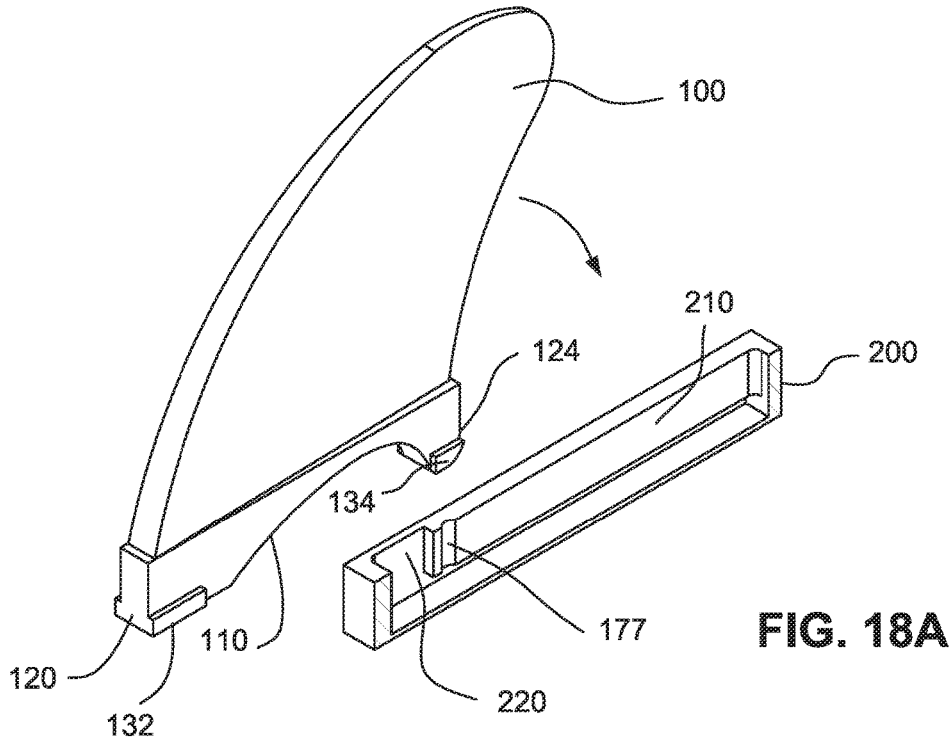
FIG. 18A is a left-side perspective view of a fin with two fin attachment mechanisms shown with the corresponding fin box with a single vertical access slot.
Figure 18B:
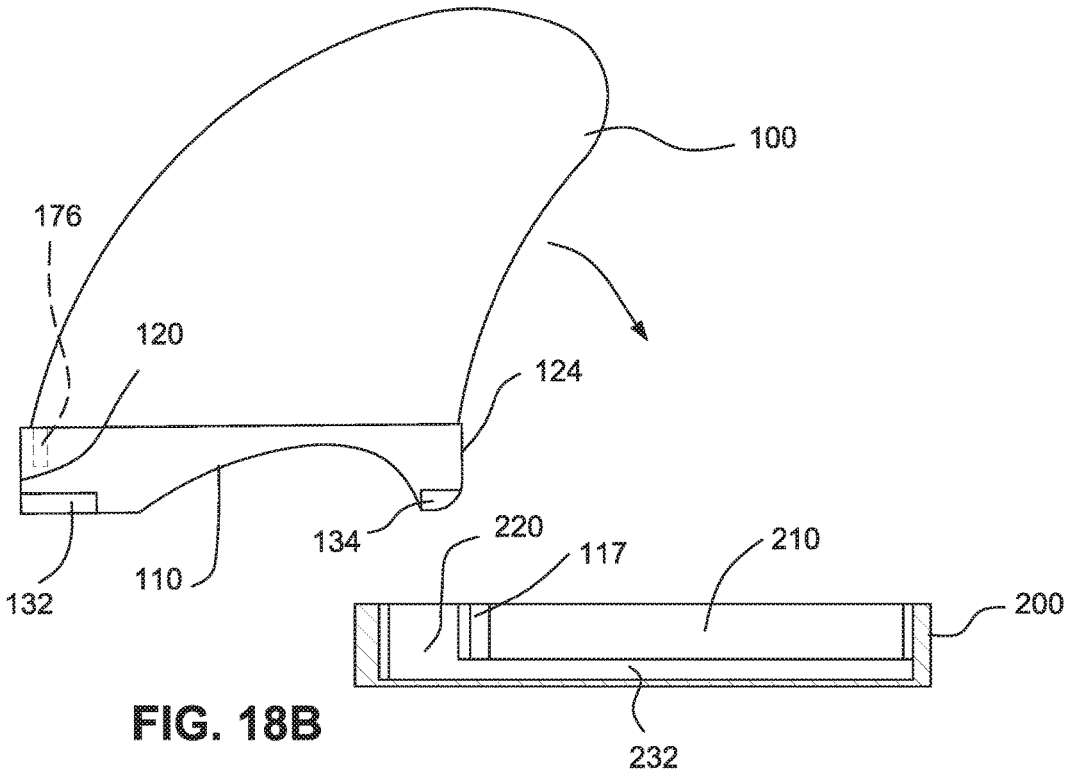
FIG. 18B is a side elevation view of a fin with two fin attachment mechanisms oriented to be slideably received in sequential order by the fin box shown in cross section, the fin shown in an alignment step (part of the insertion sequence) of the fin insertion sequence.

In at least one envisioned embodiment, the fin system 10 comprises a fin 100 and fin base 110 with one substantially rectangular fin attachment mechanism 120, a second cylindrical rear attachment mechanism 124, and a friction pad 156 to bias the fin 100 in a direction away from the base of the elongated slot 210 of the fin box 200. This combination is shown in FIGS. 16A and 16B. When used, the friction pad 156 may be placed on any surface of either the fin 100 or fin box 200 that remains in contact once the insertion sequence is complete. The pad 156 increases the static friction between the fin 100 and fin box 200 to prevent the unintentional release of the fin 100.

In at least one embodiment, it is envision that the friction pad 156 may be placed on the bottom of the front or rear (or both) attachment mechanisms. The pad 156, therefore, would contact the inner wall of the fin box 200 to increases static friction upon completion of the insertion sequence.

In at least one envisioned embodiment, the fin system 10 comprises a fin 100 and fin base 110 with one substantially rectangular fin attachment mechanism 120, a second substantially rectangular rear attachment mechanism 124. This combination is shown in FIGS. 17-20. In these figures, the fin attachment mechanism 120 is located at or toward the front of the fin base 110 and corresponds to a fin box 200 with an elongated slot 210.

The vertical access slot 220 is dimensioned to first accept the rear fin attachment mechanism 124, followed by the acceptance of the forward mechanism 120. FIGS. 19 and 20 shows the rear attachment mechanism 124 of an angled fin being lowered into the vertical access slot 220. The insertion of a fin attachment mechanism 124 initiates the insertion sequence to secure the fin 100. The insertion of the second fin attachment mechanism 120 follows sequentially to allow both mechanisms 124, 120 to enter the fin box 200. Once the mechanisms 124, 120 are slideably received, the fin 100 is then shifted longitudinally (e.g. in a rearward direction) to secure the lateral extension tabs 132 and 134 The lateral extension tabs envisioned are substantially rectangular in profile, but may be tapered or rounded-off to provide a better fit and to reduce wear over time.

Figure 19A:
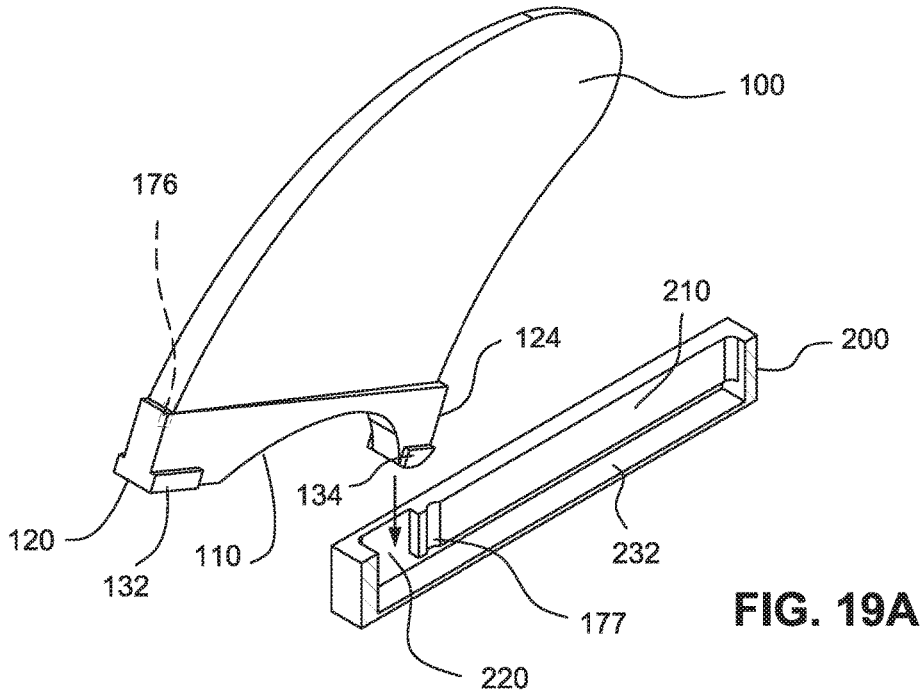
FIG. 19A is a left-side perspective view of a fin with two fin attachment mechanisms with a cross sectional view of the corresponding fin box with a single vertical access slot.
Figure 19B:
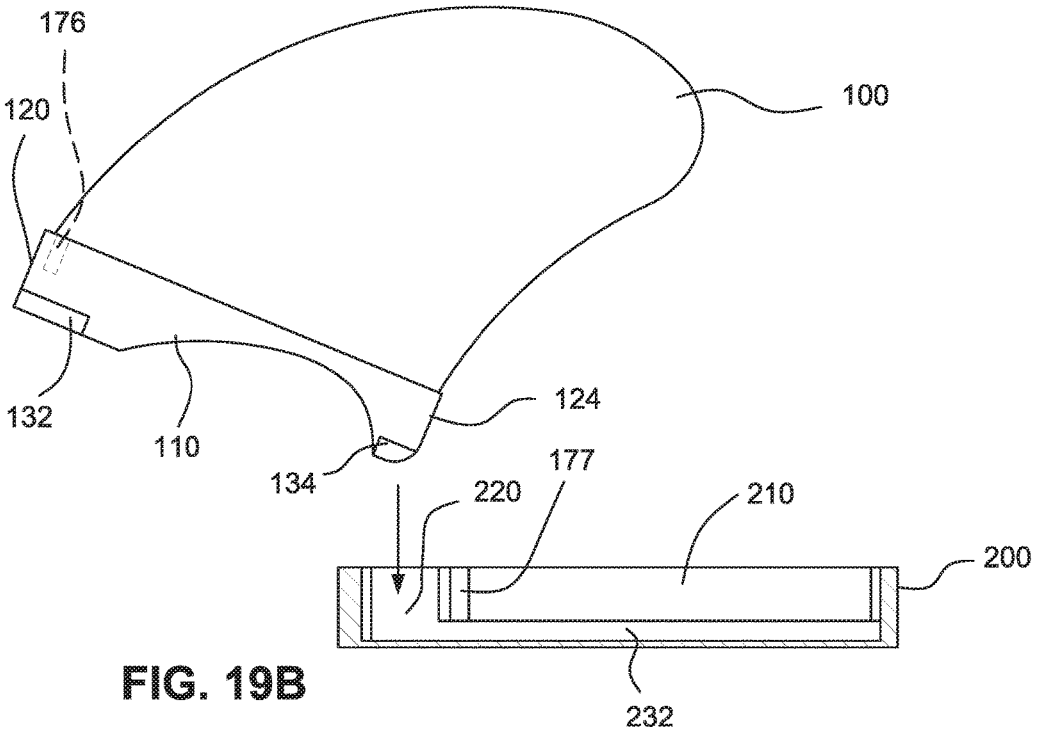
FIG. 19B is a side elevation view of a fin with two fin attachment mechanisms rotated at a forward angle to be slideably received in sequential order by the fin box shown in cross section, the fin shown in an intermediate step of the fin insertion sequence.
Figure 20A:
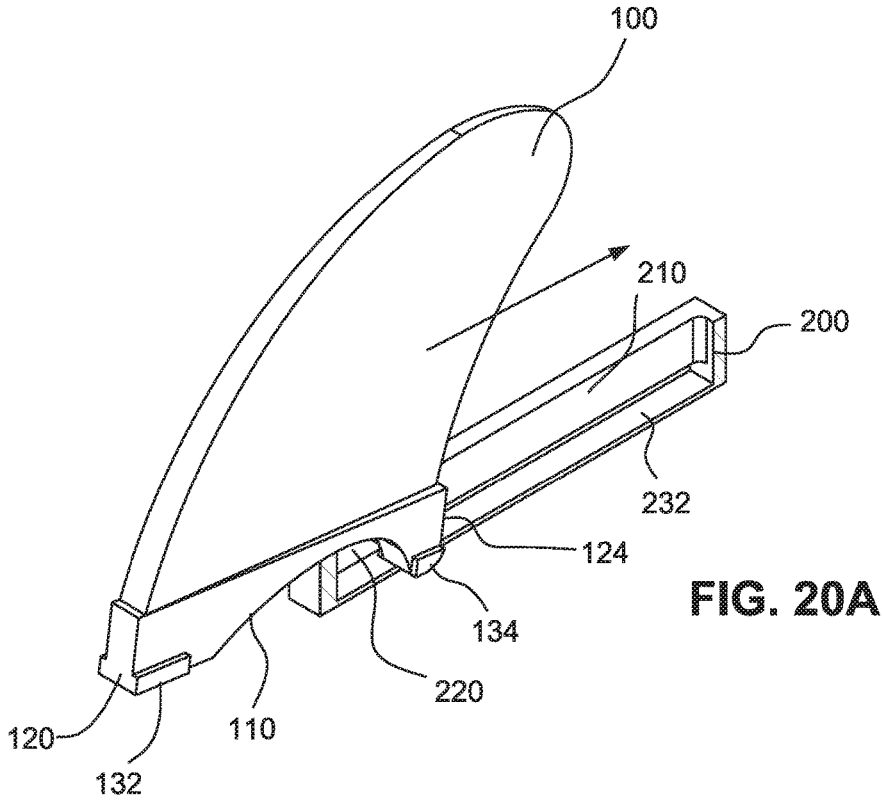
FIG. 20A is a left-side perspective view of a fin with two fin attachment mechanisms, showing the interaction with the vertical access slot of a fin box needed to initiate the fin insertion sequence.
Figure 20B:
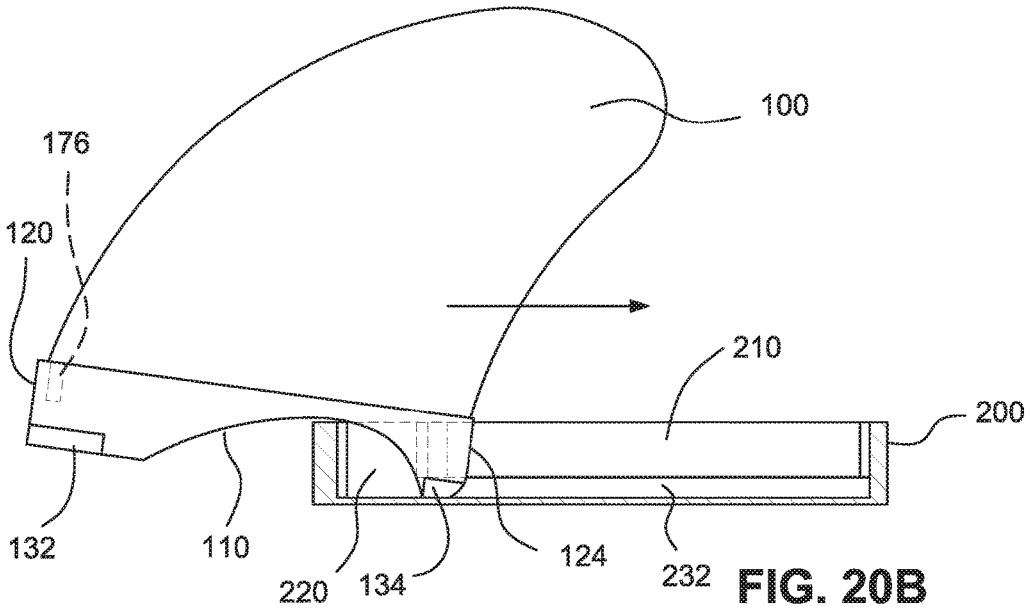
FIG. 20B is a side elevation view of a fin with two fin attachment mechanisms showing the insertion of the forward fin attachment mechanism into the vertical access slot of a fin box in sequential order by the fin box shown in cross section, the fin shown in an initial step of the fin insertion sequence.
Figure 21A:
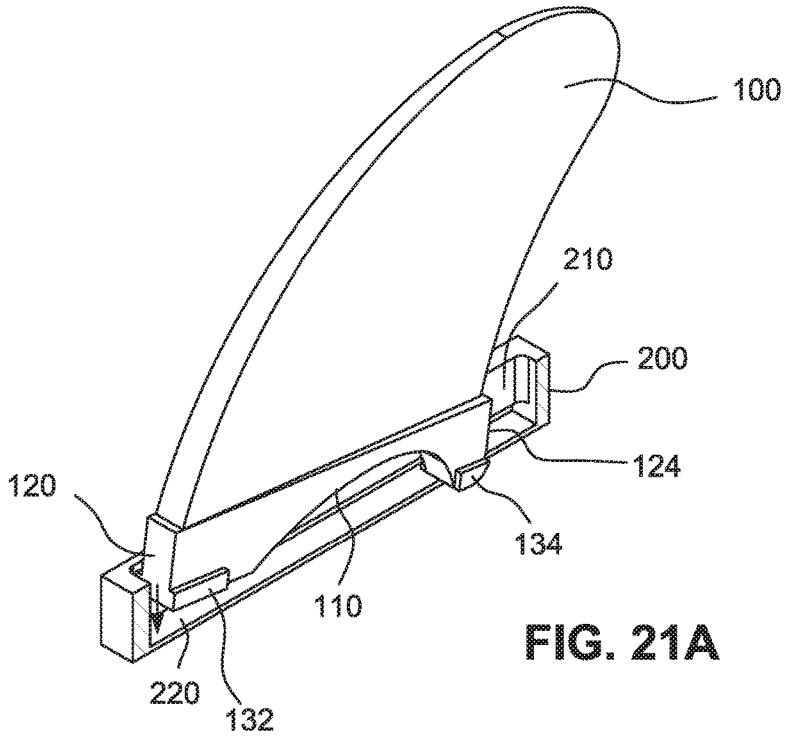
FIG. 21A is a left-side perspective view of a fin with two fin attachment mechanisms showing the longitudinal movement of the rear fin attachment mechanism oriented to be slideably received in sequential order by the fin box shown in cross section, the fin shown in an intermediate step of the fin insertion sequence.
Figure 21B:
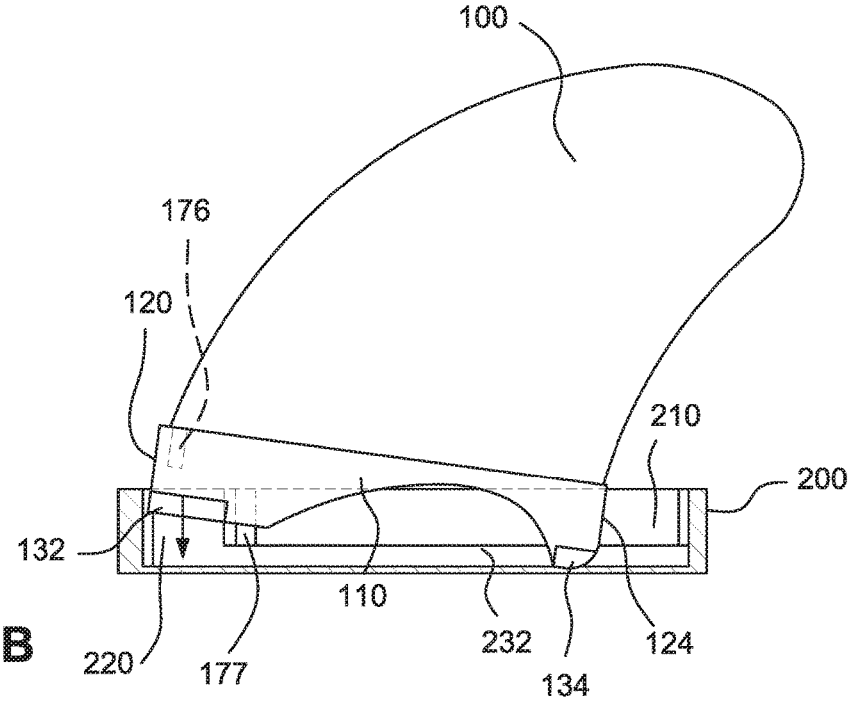
FIG. 21B is a side elevation view of a fin with two fin attachment mechanisms showing the rear fin attachment mechanism moving toward the rear of the fin box and allowing the forward fin attachment mechanism to be sequentially inserted into the vertical access slot of the fin box shown in cross section, the fin shown in an intermediate step of the fin insertion sequence.

The insertion sequence is initiated, as shown in FIGS. 19 and 20, with the fin base 110 rotated in a rear facing direction with the lateral tab 134 of rear fin attachment mechanism 124 in a position to be inserted into the vertical access slot 220 of the fin box 200. FIGS. 19A, 20A, 21A, 22A, and 23A provide cross-sections of the fin box 200 and show the steps of the insertion sequence from a left-side perspective view, while 19B, 20B, 21B, 22B, and 23B provide cross-sectional views of the same sequence from a side elevation view.

Figure 22A:
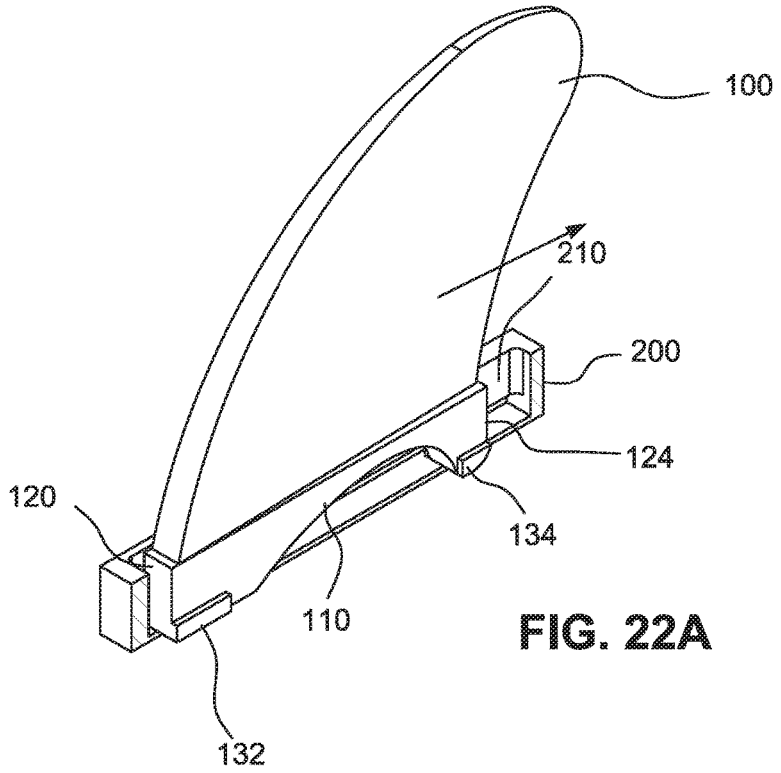
FIG. 22A is a left-side perspective view of a fin with two fin attachment mechanisms showing the full insertion of the forward fin attachment mechanism into the single vertical access slot of the fin box shown in cross section, in a sequential order the fin shown in a second intermediate step of the fin insertion sequence.
Figure 22B:
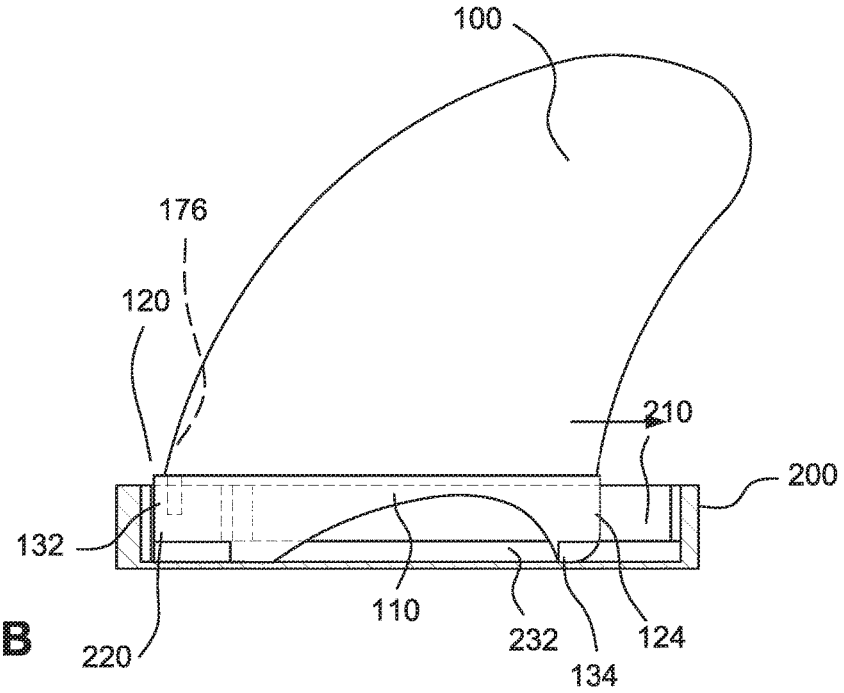
FIG. 22B is a side elevation view of a fin with two fin attachment mechanisms showing the rear fin attachment mechanism moving further to the rear of the fin box, allowing the forward fin attachment mechanism to be sequentially and fully inserted into the vertical access slot and the fin moving further toward the rear of the fin box shown in cross section, the fin shown in a second intermediate step of the fin insertion sequence.

To secure the device shown in FIGS. 22A and 22B, the lateral extension tab 134 of the rear fin attachment mechanism 124 may be positioned towards the rear of the fin box 200, away from the vertical access slot 220. The lateral extension tab of the forward fin attachment is also shown with a fin securing mechanism (e.g. in the form a small ridge, divot or detent) which may be optionally configured along the side wall(s) of the elongated slot 210 to accept, brace or bias the fin 100, fin base 110, or one (or more) fin attachment mechanism 120, 124. The corresponding portion of the detent mechanism may also be found on the fin base and interact generally with the corresponding detent groove or other portion of the elongated slot 210 to lock the fin in the fin box 200.

Figure 23A:
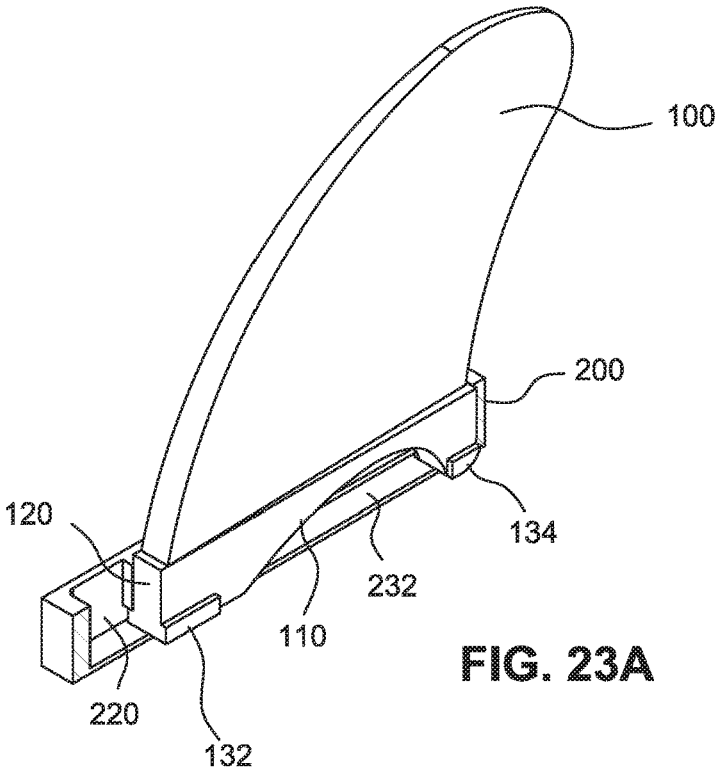
FIG. 23A is a left-side perspective view of a fin with two fin attachment mechanisms showing the fin attachment mechanisms fully inserted and secure with the lateral extensions and securing mechanisms positioned within the fin box following the intermediate steps of the fin insertion sequence.
Figure 23B:
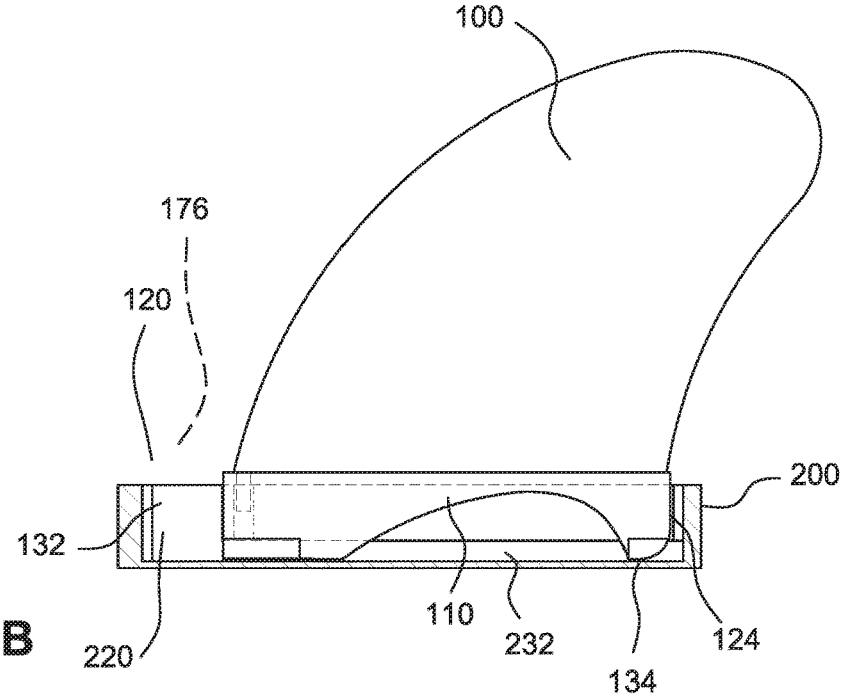
FIG. 23B is a side elevation view of a fin with two fin attachment mechanisms showing the rear and forward fin attachment mechanisms slideably received in a sequential order into the fin box shown in cross section, the fin shown fully inserted and secure following the intermediate steps of the fin insertion sequence.
Figure 24:
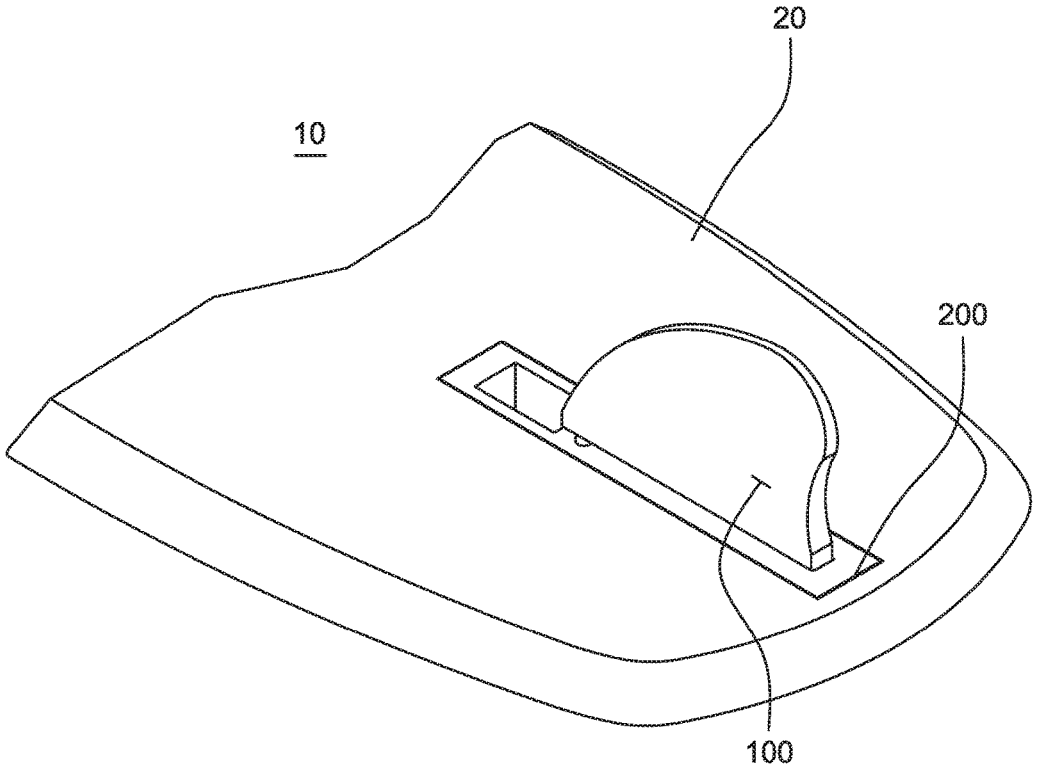
FIG. 24 is a right-side perspective view of a fin with two fin attachment mechanisms and fin box, the fin shown fully inserted and securely oriented toward the stern of the water craft following the steps of the fin insertion sequence.

In FIGS. 23A and 23B, the lateral extension tab 132 has been brought rearward into the lateral groove of the fin box 200, securing the fin. Specifically, the embodiment shown in FIGS. 23A and 23B further comprises a detent 176 and corresponding groove (i.e. notch) to secure the fin 100 in a rearward position. It is shown in subsequent illustrations that the FIG. 24 shows the full assembly and system 10 with a partial board 20 shown surrounding the fin 100 and fin box 200, with the fin 100 secured.

C. Multiple Access Slots and Normal-Oriented Insertion

In at least one envisioned embodiment, the fin comprises a fin base 100 with more than one (e.g. two or more) substantially rectangular fin attachment mechanisms 120, 124. In addition, the fin attachment mechanisms of these fins 100 are dimensioned to be slideably received in a sequential manner. The fin box comprises more than one (e.g. two or more) vertical access slots 220, 224, which correspond to the fin attachment mechanisms 120, 124 used.

Figure 25:
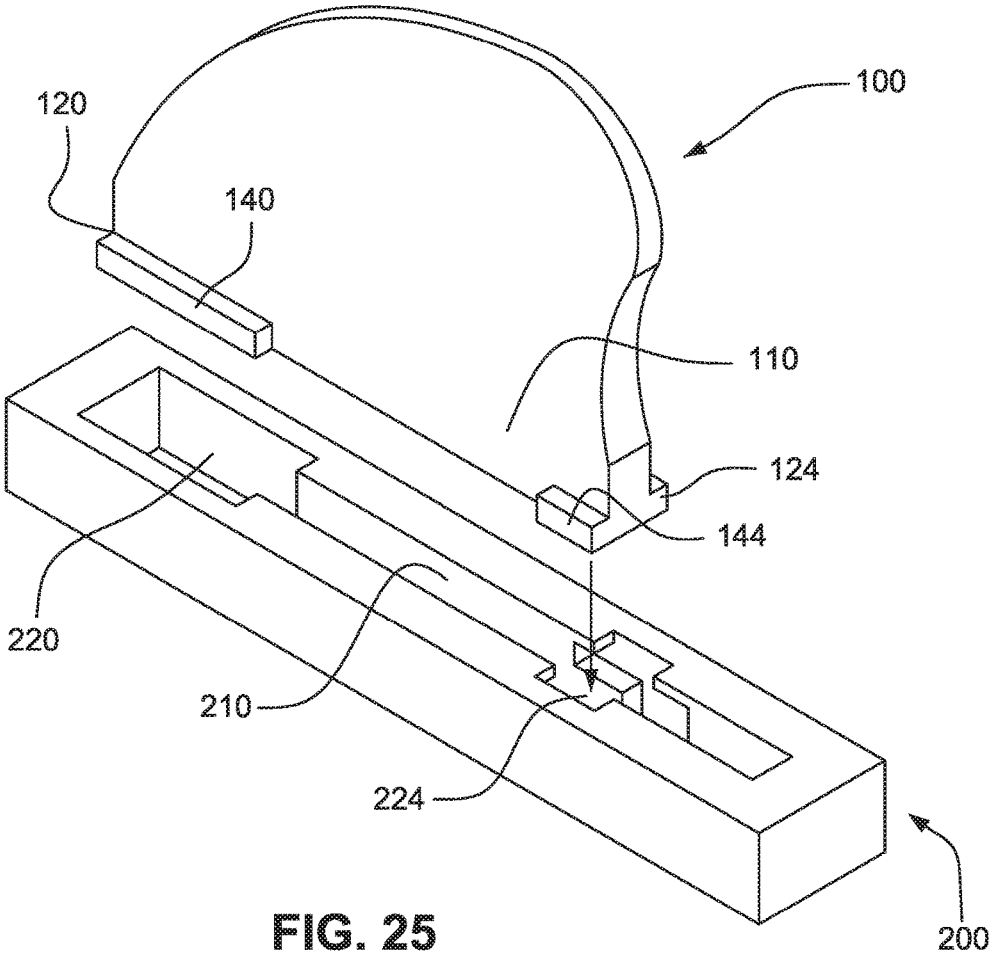
FIG. 25 is a right-side perspective view of a fin with multiple fin attachment mechanisms shown with a corresponding fin box with multiple corresponding vertical access slots.
Figure 26:
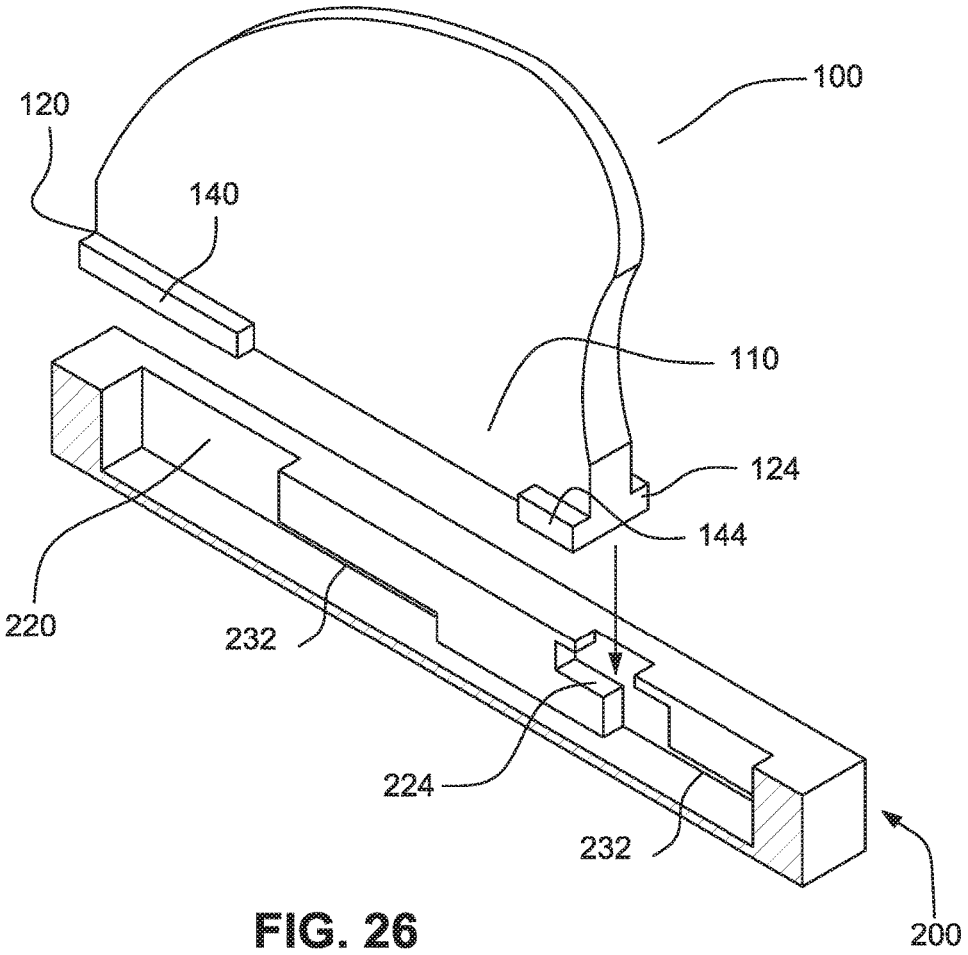
FIG. 26 is a right-side perspective view of a fin with multiple fin attachment mechanisms together with a corresponding fin box with corresponding vertical access slots shown in cross section.
Figure 27:
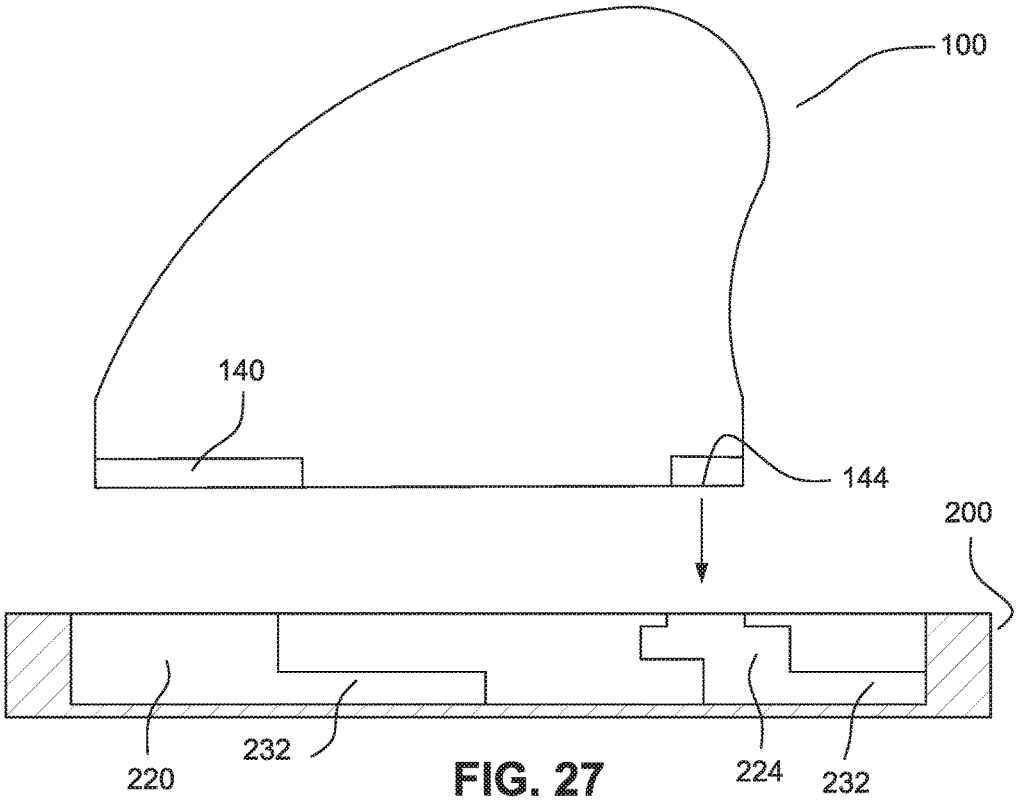
FIG. 27 is a side elevation view of a fin with multiple fin attachment mechanisms together with a corresponding fin box with corresponding vertical access slots shown in cross section.

In this embodiment, it is envisioned that the length of the fin base 100 between fin attachment mechanisms 120, 124 is different to the length between (in this case a shorter length) the vertical access slots 220, 224, thereby preventing the fin 100 from entering or exiting the fin box 200 without sequentially inserting (or removing) the fin attachment mechanisms 120, 124 and following the prescribed insertion sequence. Specifically, FIGS. 25 and 26 shows a fin 100 with a forward and rear fin attachment mechanisms 120, 124 (near the front and rear) of the fin base 110 that correspond in shape and dimension to the respective forward and rear vertical access slot 220, 224, when in a perpendicular or near-normal orientation. The vertical access slots 220, 224 are configured to receive the fin base in a specific sequence, allowing it to enter the elongated slot of the corresponding fin box. Further, the cross-section shown in FIG. 27 illustrates the difference in the length between the fin attachment mechanisms of the fin and the length between the vertical access slots 220, 224 of the fin box 200. Specifically, in FIG. 27, the rear fin attachment mechanism 124 is shown positioned over the rear vertical access slot 224, but it is clear that the fin attachment mechanisms 224 may not both enter the elongated slot 210 of the fin box 200 simultaneously.

Figure 28A:
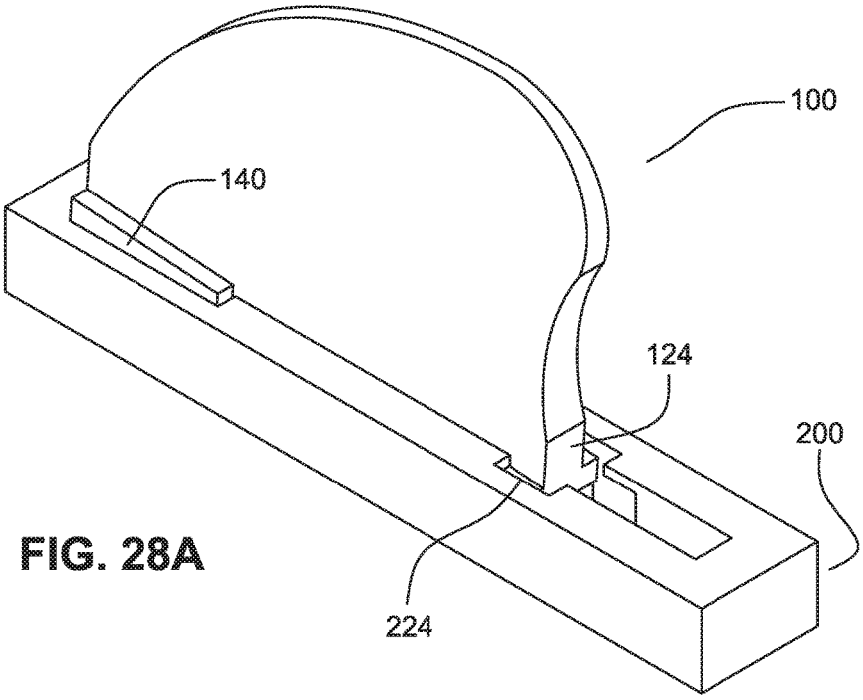
FIG. 28A is right-side perspective view of a fin with multiple fin attachment mechanisms together with a corresponding fin box with multiple corresponding vertical access slots, showing the interaction of a first attachment mechanism with its respective vertical access slot, needed in order to initiate the fin insertion sequence.
Figure 28B:
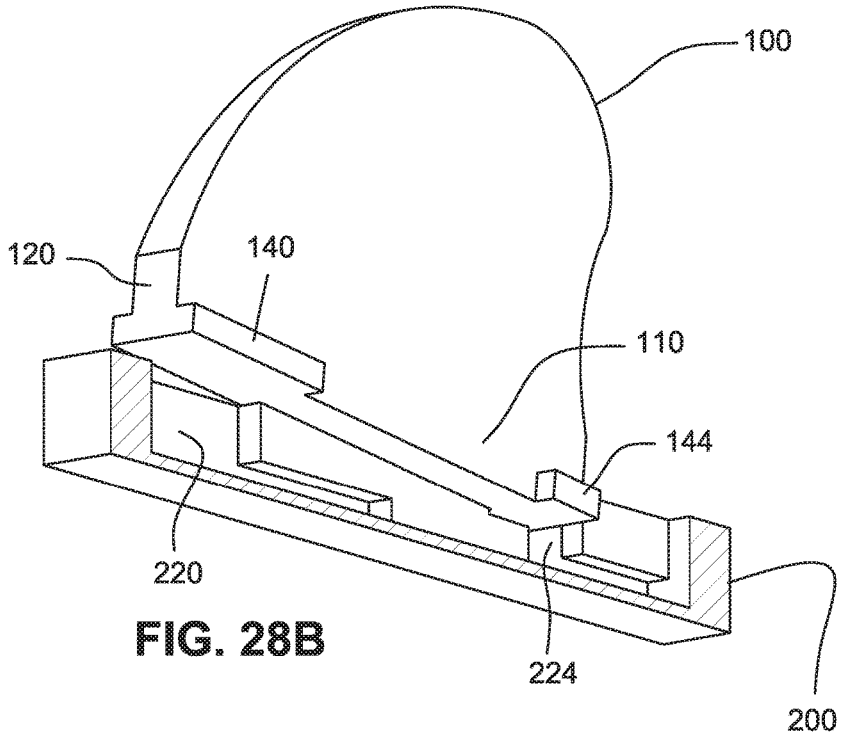
FIG. 28B is a bottom left-side perspective view of a fin with multiple fin attachment mechanisms together with a corresponding fin box with multiple corresponding vertical access slots oriented to be slideably received in sequential order by the fin box shown in cross section, the fin shown in an intermediate step of the fin insertion sequence.
Figure 28C:
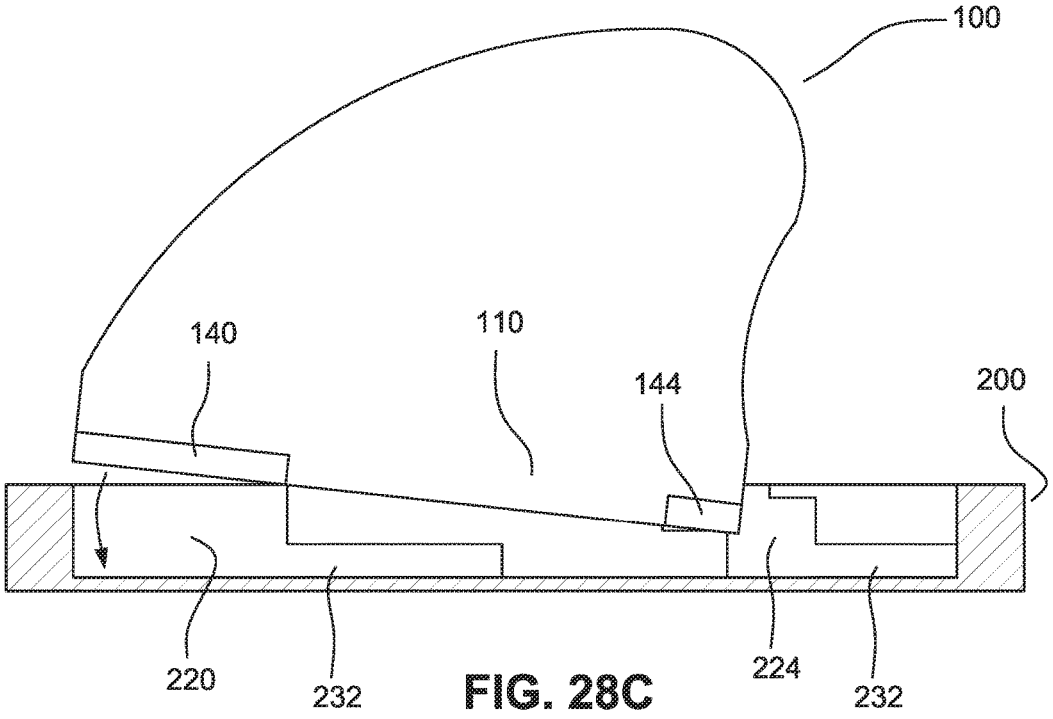
FIG. 28C is a side elevation view of a fin with multiple fin attachment mechanisms together with a corresponding fin box with multiple corresponding vertical access slots oriented to be slideably received in sequential order by the fin box shown in cross section, the fin shown in an intermediate step of the fin insertion sequence.
Figure 29A:
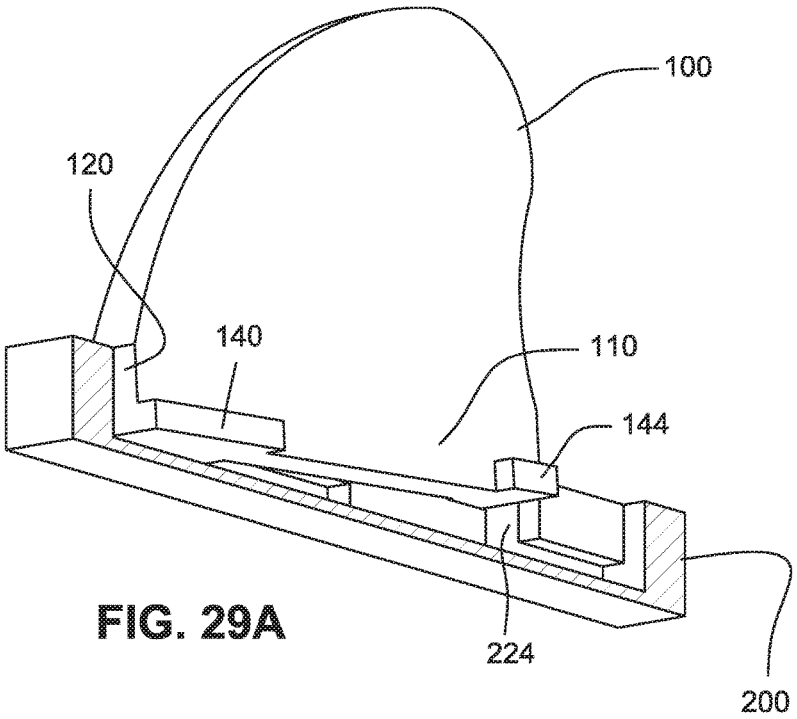
FIG. 29A is a bottom left-side perspective view of a fin with multiple fin attachment mechanisms together with a corresponding fin box with multiple corresponding vertical access slots oriented to be slideably received by the fin box shown in cross section, the fin shown in an intermediate step of the fin insertion sequence.
Figure 29B:
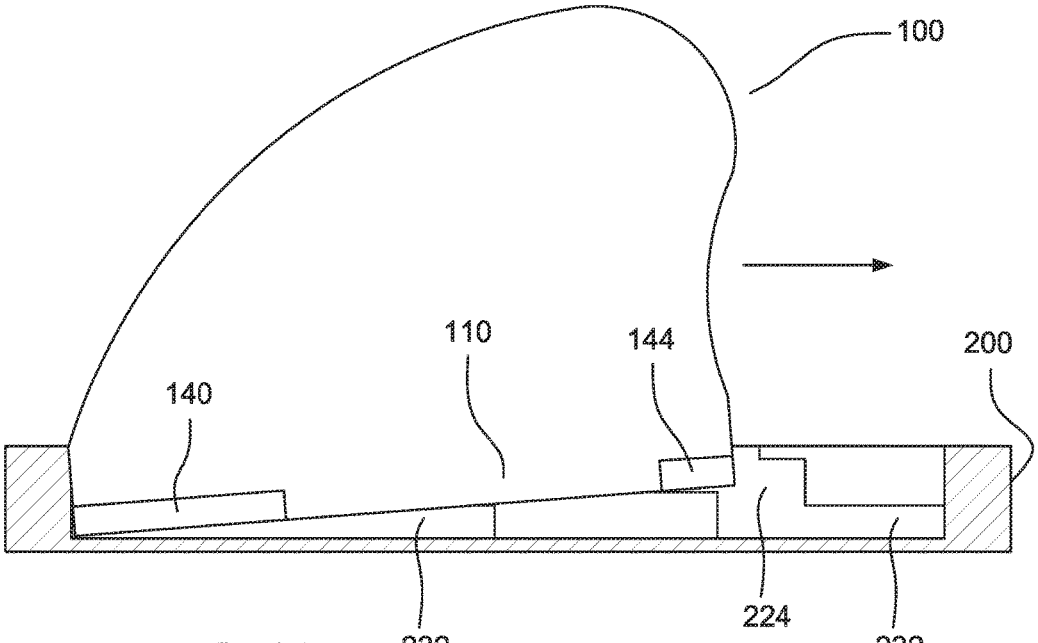
FIG. 29B is a side elevation view of a fin with multiple fin attachment mechanisms together with a corresponding fin box with multiple corresponding vertical access slots oriented to be slideably received by the fin box shown in cross section, the fin shown in an intermediate step of the fin insertion sequence.
Figure 30A:
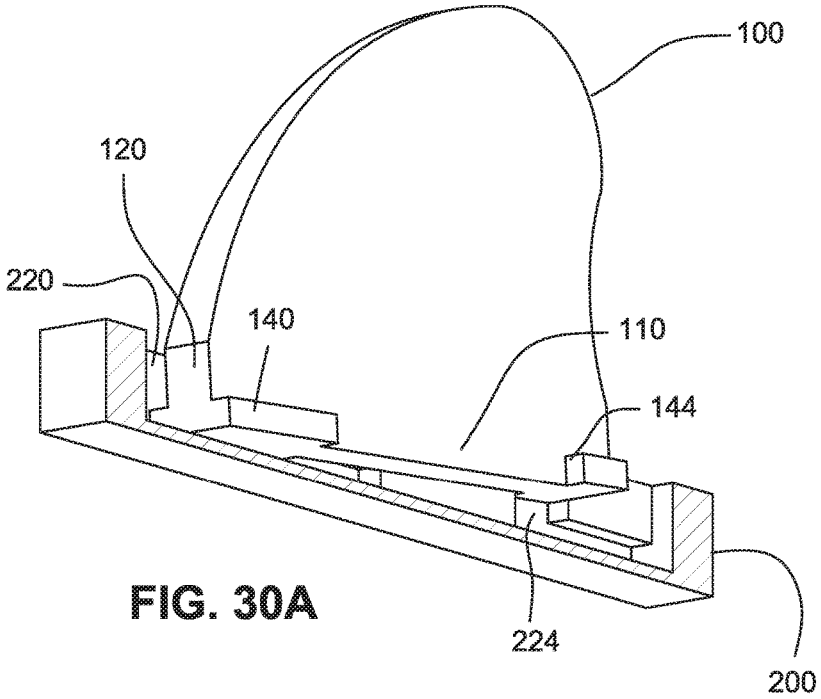
FIG. 30A is a bottom left-side perspective view of a fin with multiple fin attachment mechanisms together with a corresponding fin box with multiple corresponding vertical access slots oriented to be slideably received by the fin box shown in cross section, the fin shown in an intermediate step of the fin insertion sequence.
Figure 30B:
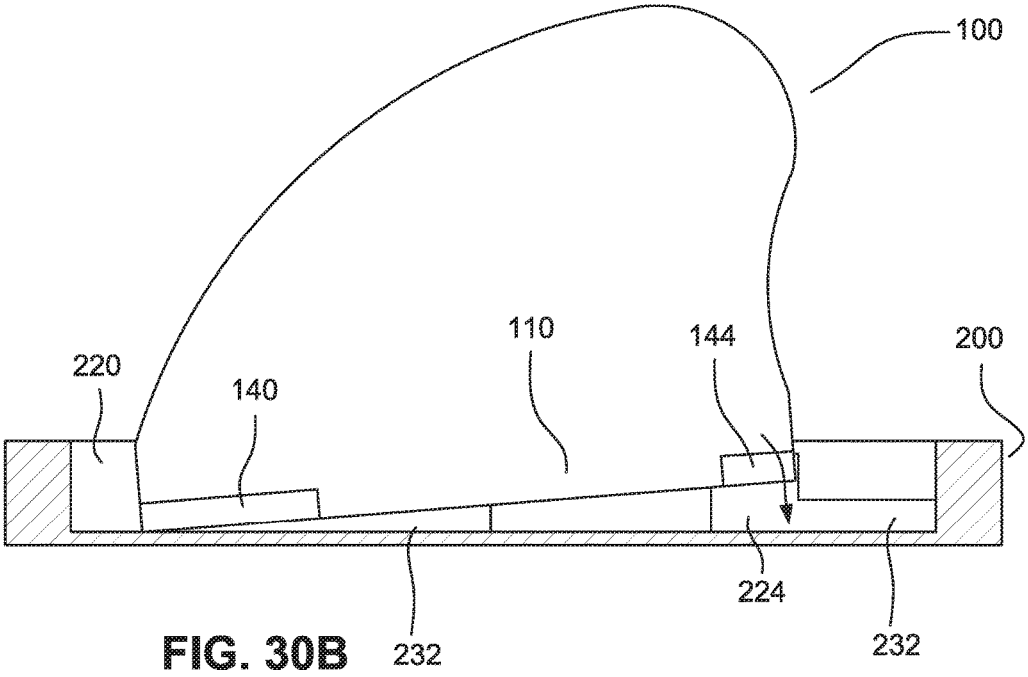
FIG. 30B is a side elevation view of a fin with multiple fin attachment mechanisms together with a corresponding fin box with multiple corresponding vertical access slots oriented to be slideably received by the fin box shown in cross section, the fin shown in an intermediate step of the fin insertion sequence.
Figure 31A:
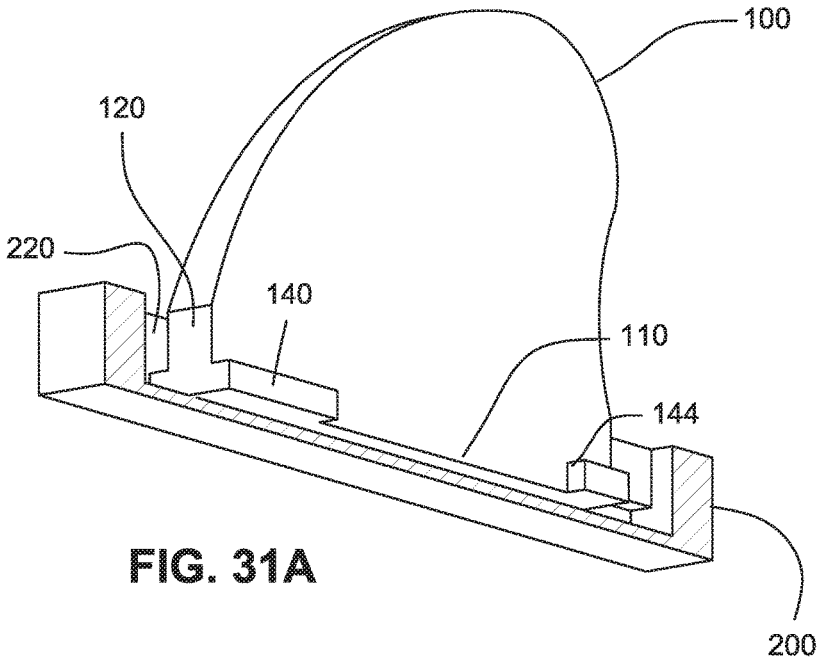
FIG. 31A is a bottom left-side perspective view of a fin with multiple fin attachment mechanisms together with a corresponding fin box with multiple corresponding vertical access slots oriented to be slideably received by the fin box shown in cross section, the fin shown in an intermediate step of the fin insertion sequence.
Figure 31B:
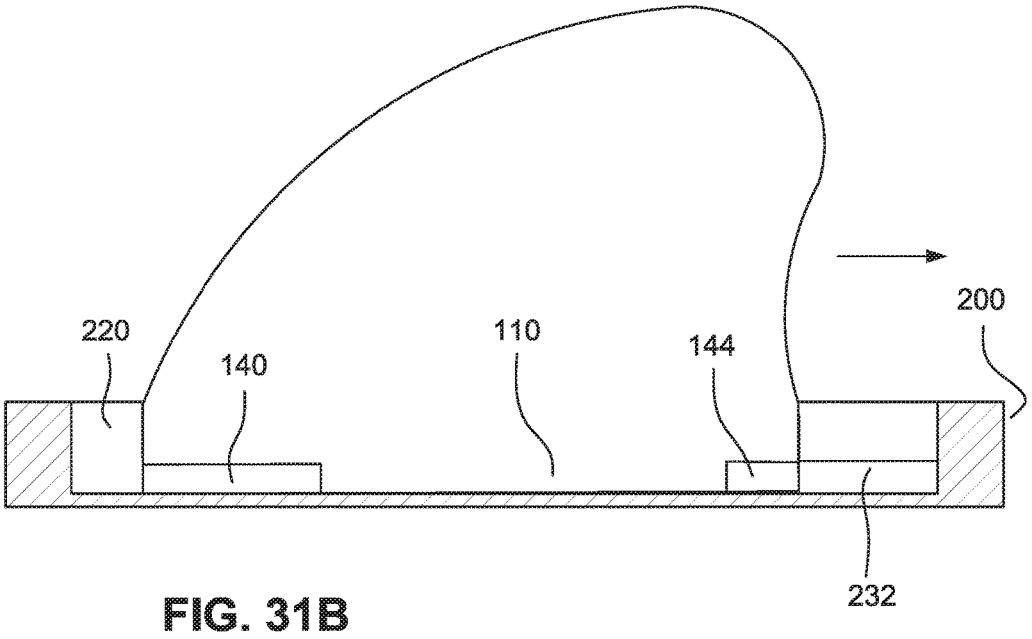
FIG. 31B is a side elevation view of a fin with multiple fin attachment mechanisms together with a corresponding fin box with multiple corresponding vertical access slots oriented to be slideably received by the fin box shown in cross section, the fin shown in an intermediate step of the fin insertion sequence.
Figure 32A:
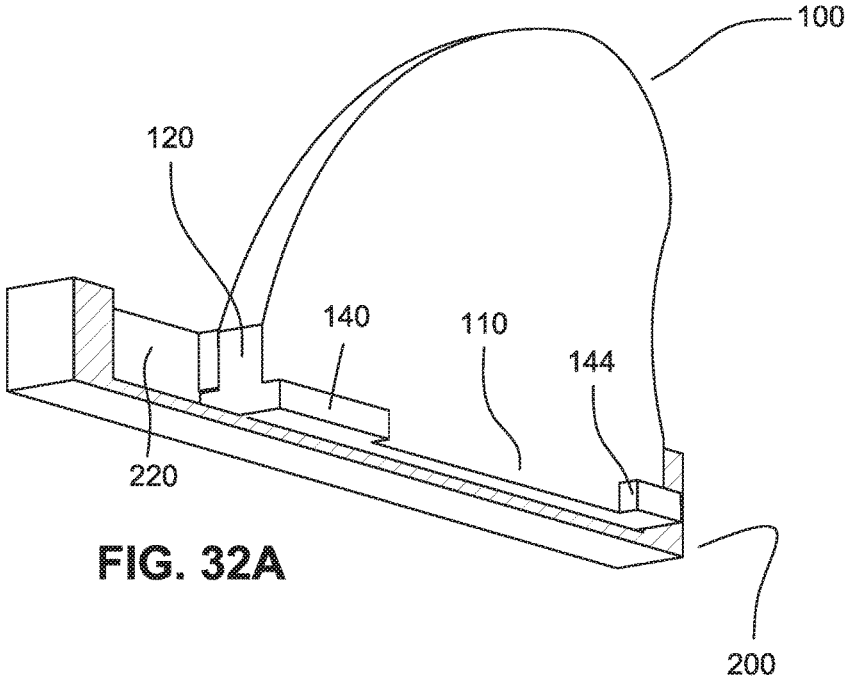
FIG. 32A is a bottom left-side perspective view of a fin with multiple fin attachment mechanisms together with a corresponding fin box with multiple corresponding vertical access slots oriented to be slideably received by the fin box shown in cross section, the fin shown fully inserted and secure following the intermediate steps of the fin insertion sequence.
Figure 32B:
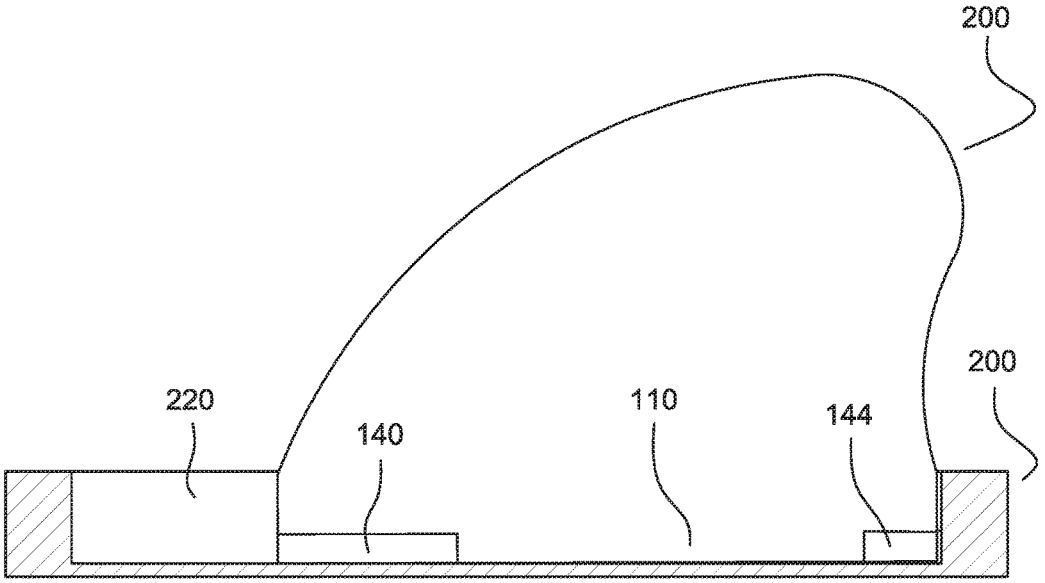
FIG. 32B is a side elevation view of a fin with multiple fin attachment mechanisms together with a corresponding fin box with multiple corresponding vertical access slots oriented to be slideably received by the fin box shown in cross section, the fin shown fully inserted and secure following the intermediate steps of the fin insertion sequence.

The insertion sequence is initiated, as shown in FIG. 28A, with the fin base 110 in a position entering into the rear vertical access slot 224 of the fin box 200. As envisioned, the fin 100 enters the fin box 200 in a near-normal orientation, as the lateral extension tabs 144 of the rear fin attachment mechanism 124 are dimensioned to be slideably received by the fin box 200. The fin 100 is then guided through the channels of the elongated slot 210 to a forward position that allows for the insertion of the full fin base 110 into the fin box 200. Once positioned within the fin box 200, the fin may follow the steps of the particular insertion sequence, shown in a left-side bottom perspective view, sequentially in FIGS. 28A, 29A, 30A, 31A and 32A with the fin box 200 in cross-section. The corresponding sequence of FIGS. 28B, 29B, 30B, 31B and 32B provide cross-sections of the fin box 200 and show the steps of the insertion sequence from a side elevation view. Specifically, FIGS. 32A and 32B show the lateral extension tabs 140, 144 of the fin attachment mechanisms 120, 124 positioned towards the rear of the fin box 200, away from the vertical access slots 220, 224. While the insertion sequence may be different to accommodate specific elongated slot configuration, the steps of the insertion sequence must be followed and reversed to insert and remove the fin, with the fin attachment mechanisms entering (and exiting) the base in a step-wise manner.

Figure 33:
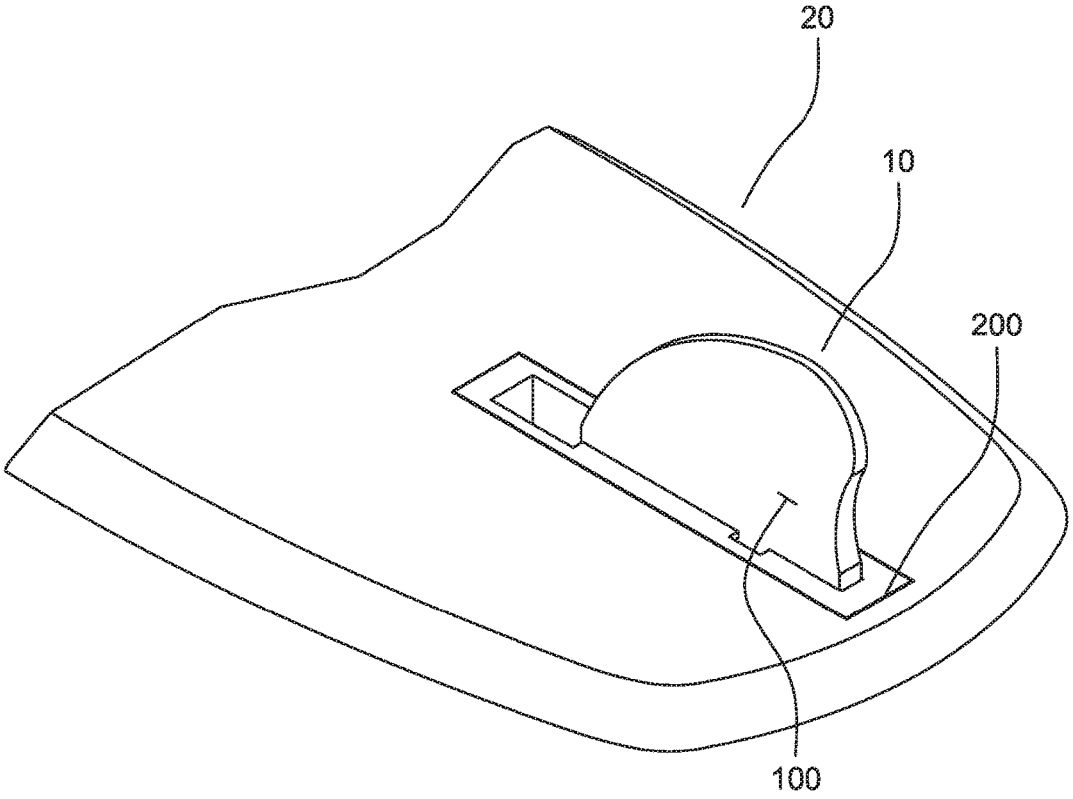
FIG. 33 is a right-side perspective view of a fin configured within a complete fin box, the fin shown fully inserted and securely oriented toward the stern of the surrounding water craft following the steps of the fin insertion sequence.

The lateral extension tabs of the fin attachment mechanisms may further interact with the fin box 200 or with one or more fin securing mechanisms (e.g. in the form a small ridge, divot or detent) which may be optionally configured to rest along the lateral groove in order to brace or bias the fin, fin base, or one (or more) fin attachment mechanism. The tabs are dimensioned to form a friction fit with one or more lateral grooves 232 extending from the elongated slot 210 of the fin box 200. Envisioned for use alternatively or in combination with a securing mechanism, the body of the fin base 110 may also be slightly curved or otherwise configured to create a bias force from the walls of the fin box 200 against the fin 100, thereby securing the fin 100 and preventing unwanted release through the use of a friction fit. FIG. 33 shows the full assembly 10 with a partial board 20 shown surrounding the fin 100 and fin box 200, with the fin 10 secured.

D. Multiple Access Slots with Variations

In at least one envisioned embodiment, the fin system comprises a fin box and a fin with a fin base with more than one (e.g. two or more) substantially rectangular fin attachment mechanisms. In addition, at least one fin attachment mechanisms of these fins are dimensioned to be slideably received in a near-normal orientation by the fin box before a second fin attachment mechanisms may be received in sequence in its respective vertical access slot.

Figure 34:
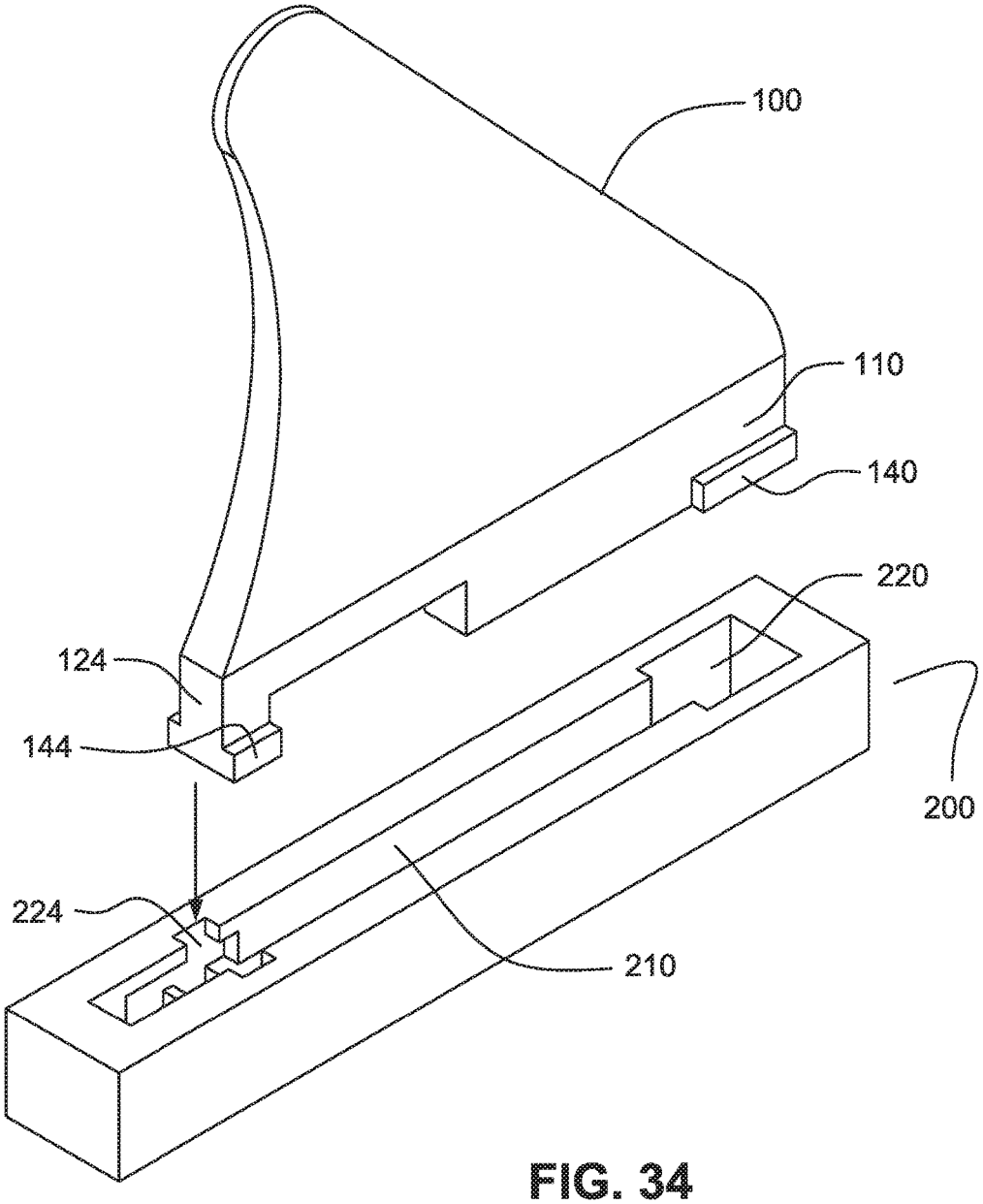
FIG. 34 is a left-side perspective view of a fin and a corresponding fin box.
Figure 35:
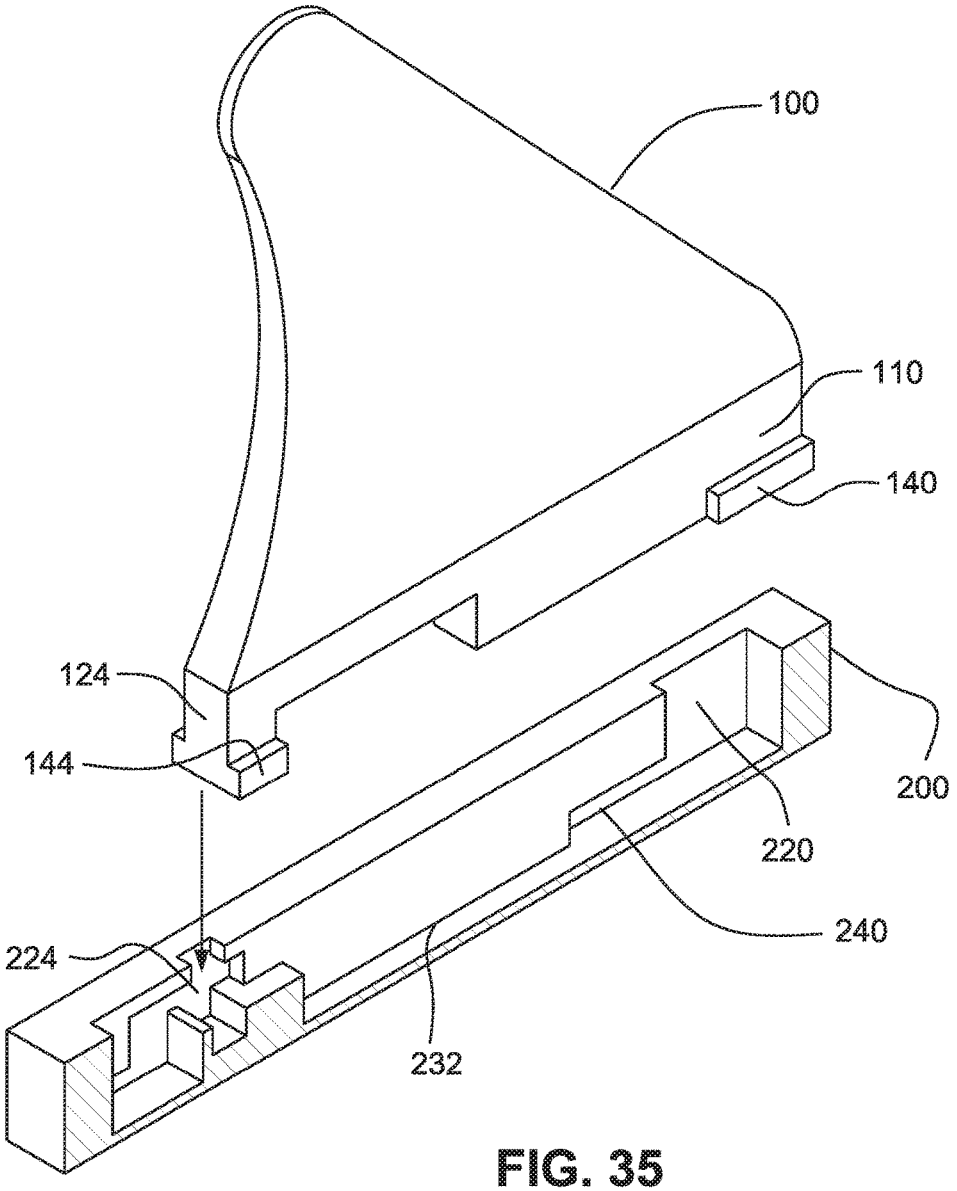
FIG. 35 is a left-side perspective view of a fin with a cross sectional view of the fin box.

In at least this embodiment, it is envisioned that the length of the fin base 110 between fin attachment mechanisms 120, 124 is different, such as shorter, than the length of the vertical access slots 220, 224, thereby preventing the fin from entering or exiting the fin box 200 without sequentially inserting (or removing) the fin attachment mechanisms 120, 124 and following the prescribed insertion sequence. In addition, as shown in FIGS. 34 and 35, the narrow configuration of the rear vertical access slot 224 relative to the normally-oriented rear fin attachment mechanism 124 prevents the fin base 110 from entering the fin box 200 in a normal or near-normal orientation.

Figure 36:
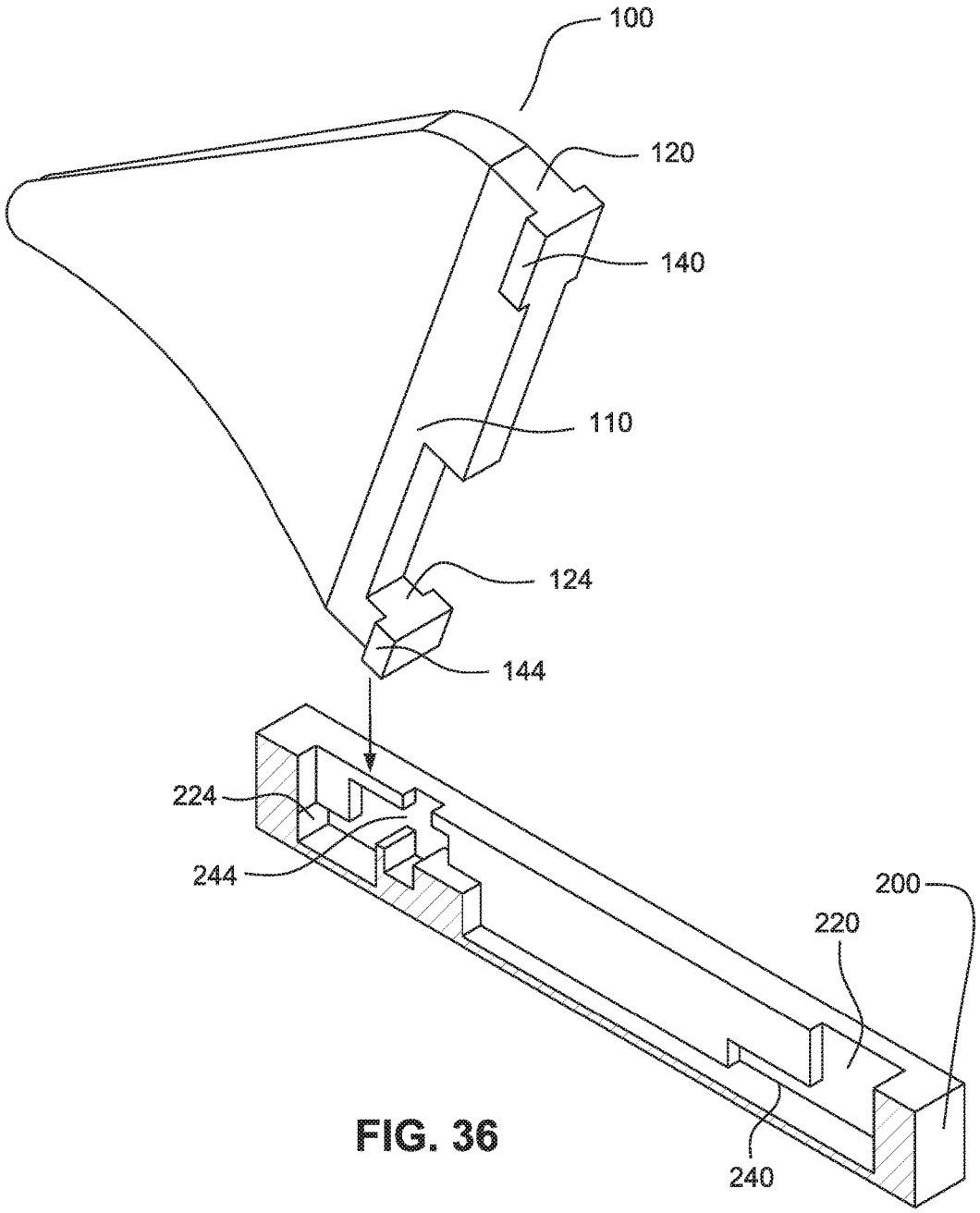
FIG. 36 is a right-side perspective view of a fin angled relative to the fin box shown in cross section, as required to insert the tab of the fin attachment mechanism into the respective vertical access slot.
Figure 37:
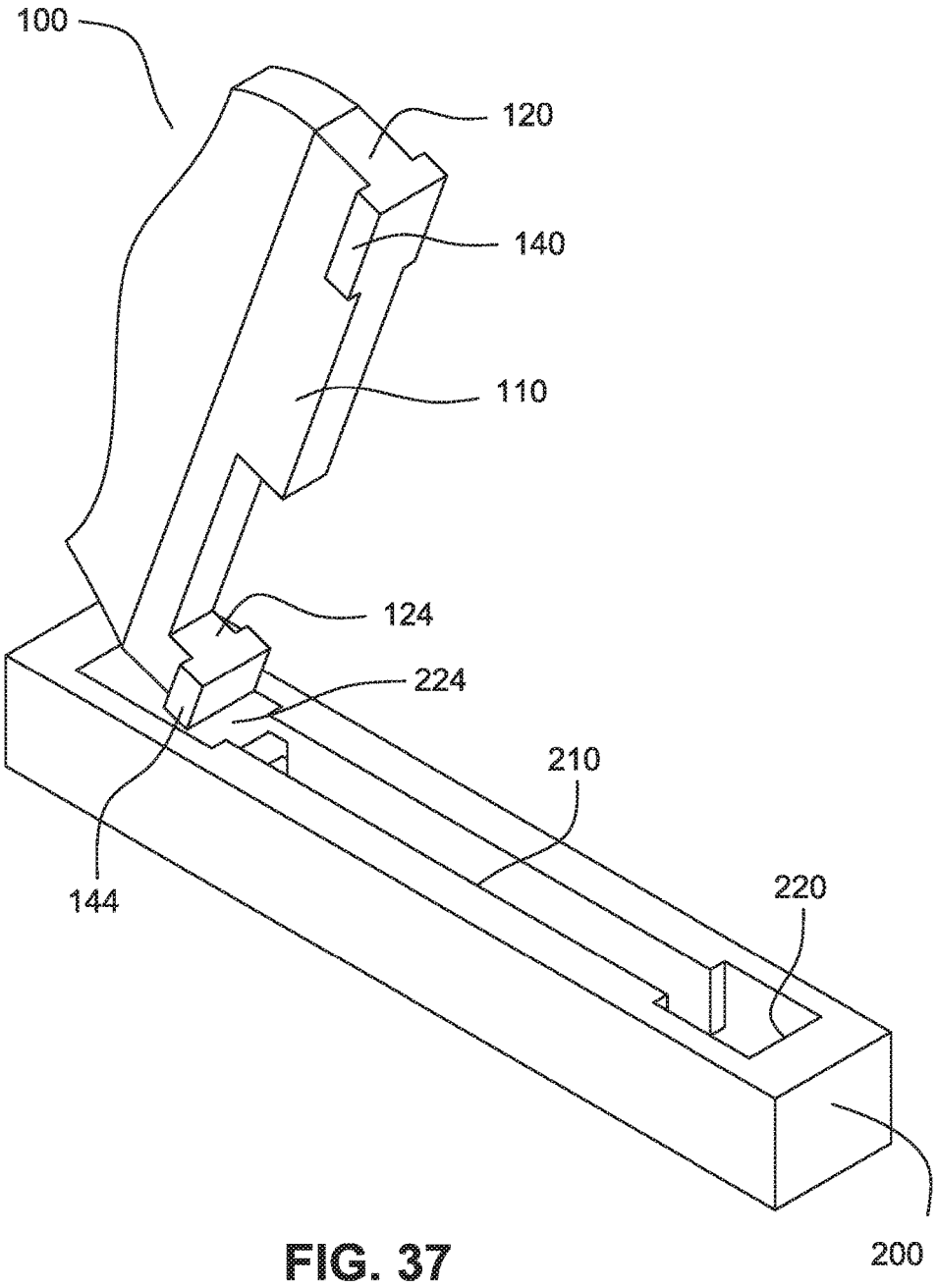
FIG. 37 is a right-side perspective view of a fin showing interaction with fin box initiating a fin insertion sequence.
Figure 38A:
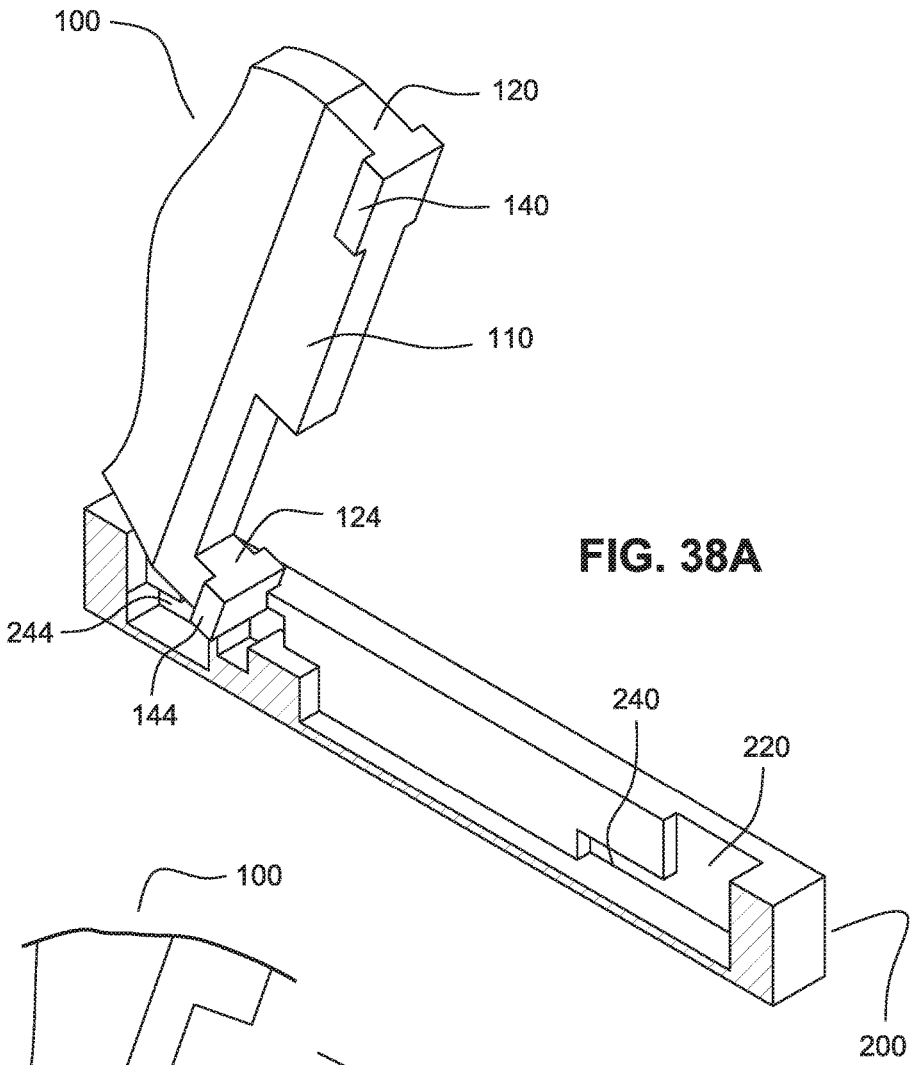
FIG. 38A is a right-side perspective view of a fin oriented to be slideably received the fin box shown in cross section, initiating the fin insertion sequence.
Figure 38B:
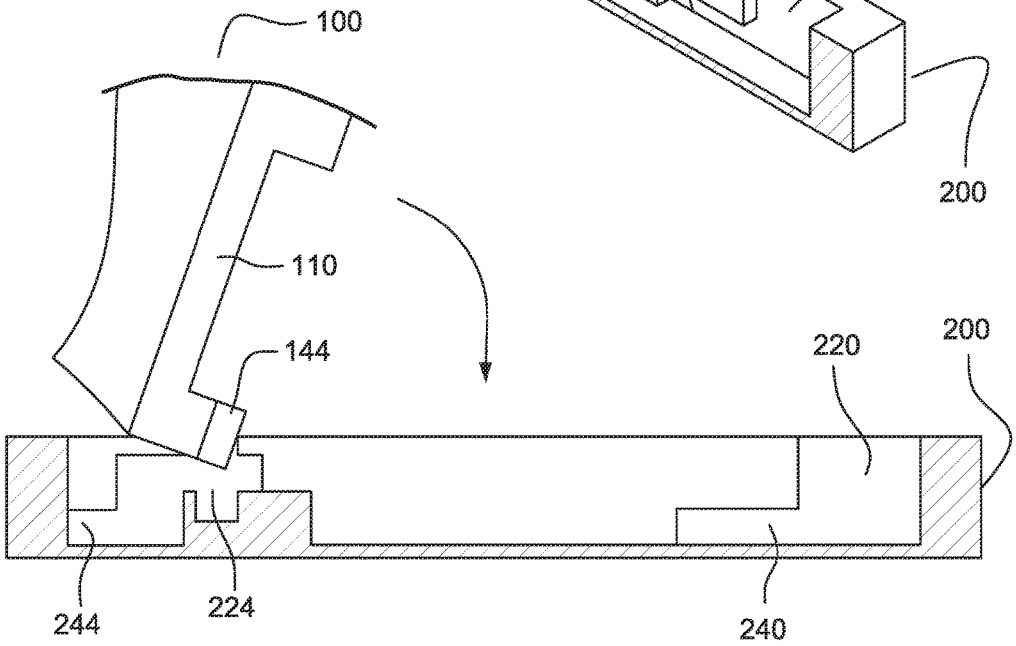
FIG. 38B is a side elevation view of a fin oriented to be slideably received a cross sectional fin box shown in, initiating the fin insertion sequence.
Figure 39A:
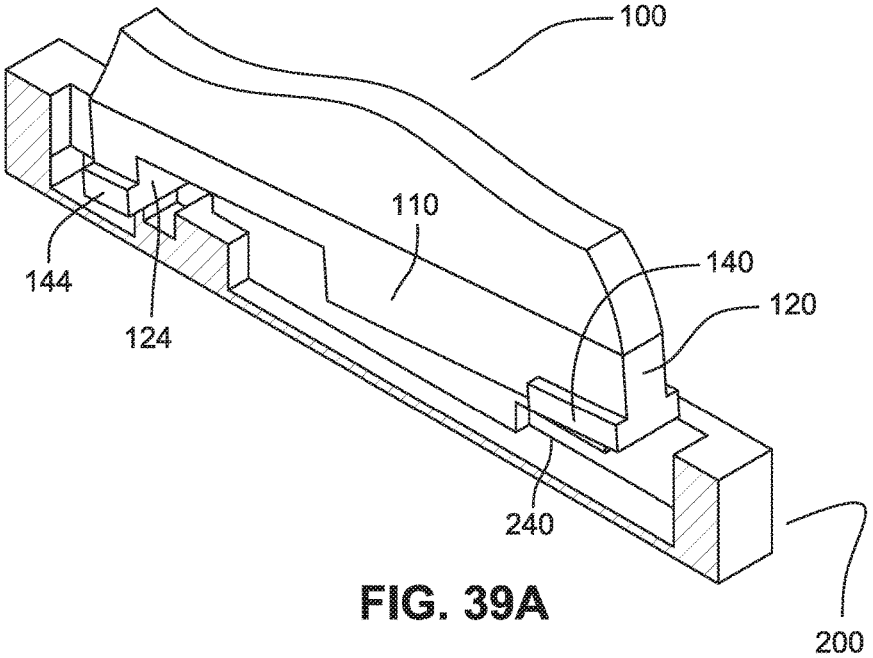
FIG. 39A is a right-side perspective view of a fin configured within a cross sectional fin box, the fin shown in an intermediate step of the fin insertion sequence.
Figure 39B:
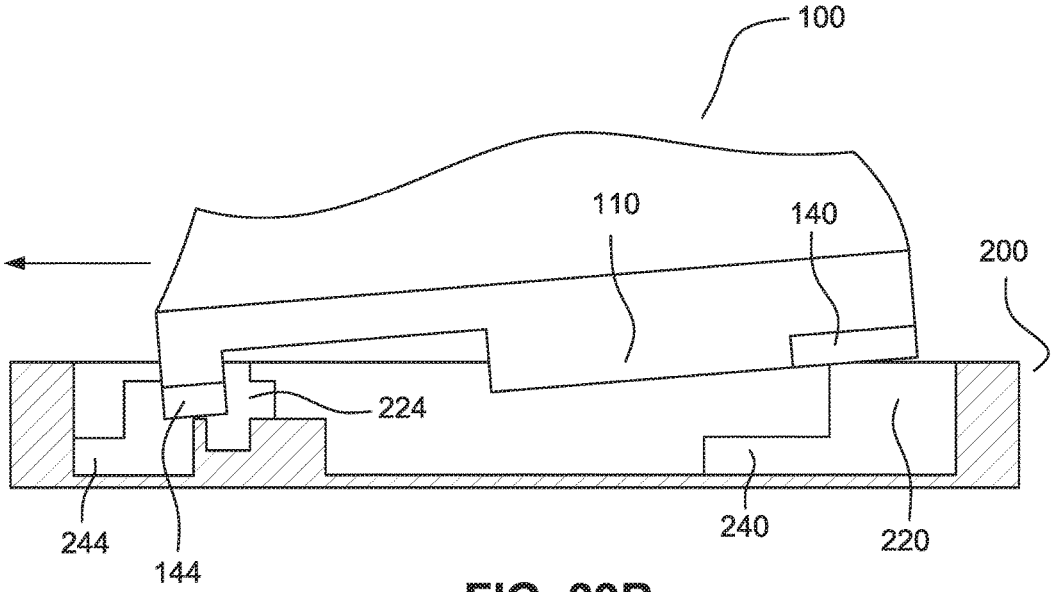
FIG. 39B is a side elevation view of a fin configured within a cross sectional fin box, the fin shown in an intermediate step of the fin insertion sequence.
Figure 40A:
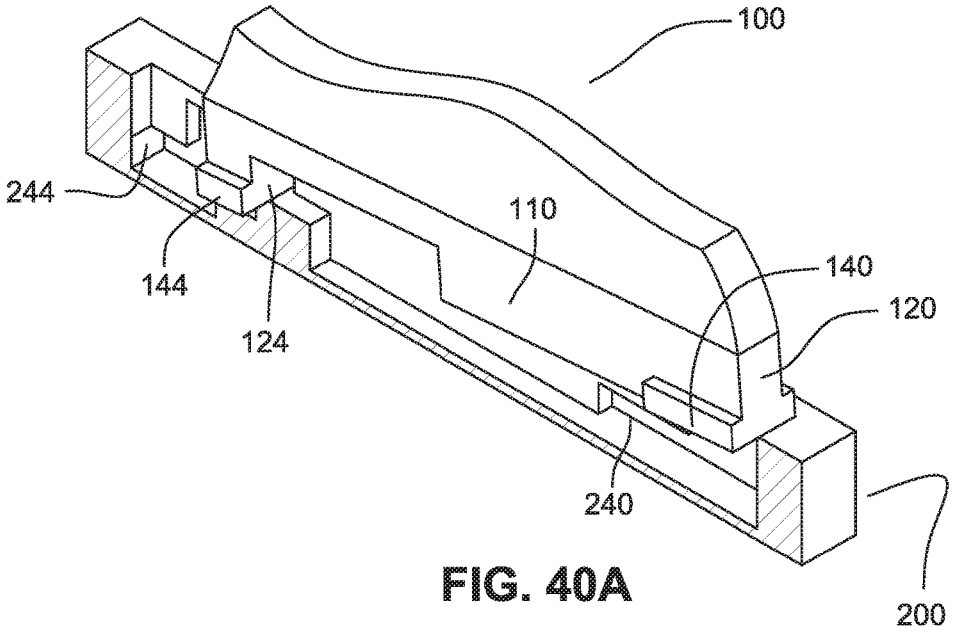
FIG. 40A is a right-side perspective view of a fin configured within a cross sectional fin box, the fin shown in a subsequent intermediate step of the fin insertion sequence.
Figure 40B:
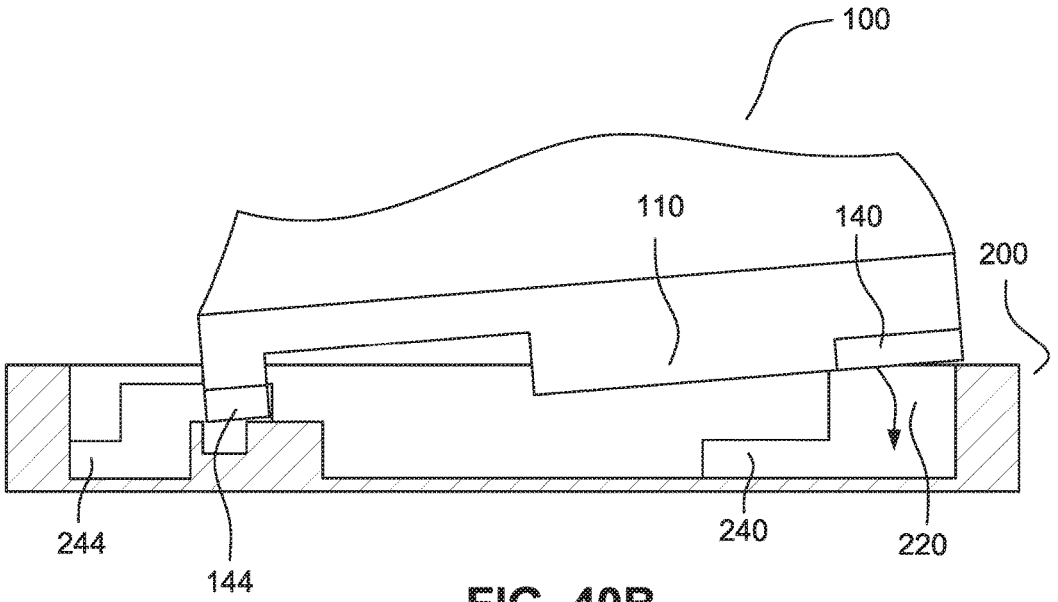
FIG. 40B is a side elevation view of a fin configured within a cross sectional fin box, the fin shown in a subsequent intermediate step of the fin insertion sequence.
Figure 41A:
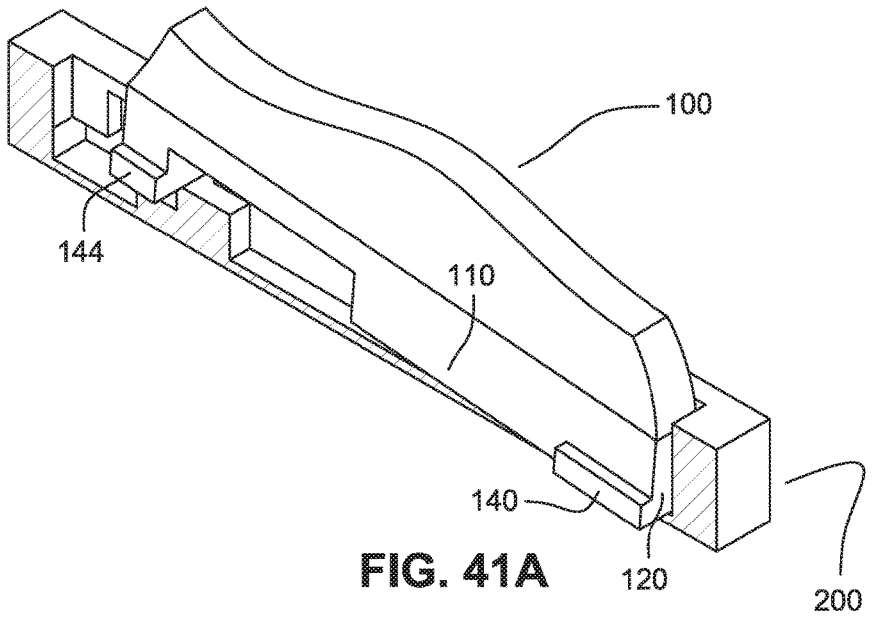
FIG. 41A is a right-side perspective view of a fin configured within a cross sectional fin box, the fin shown in a subsequent intermediate step of the fin insertion sequence.
Figure 41B:
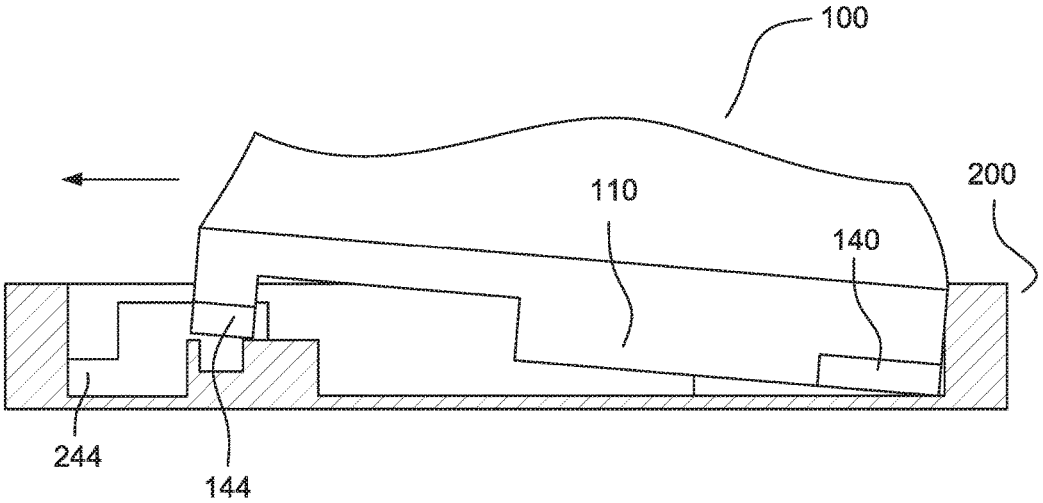
FIG. 41B is a side elevation view of a fin configured within a cross sectional fin box, the fin shown in a subsequent intermediate step of the fin insertion sequence.
Figure 42A:
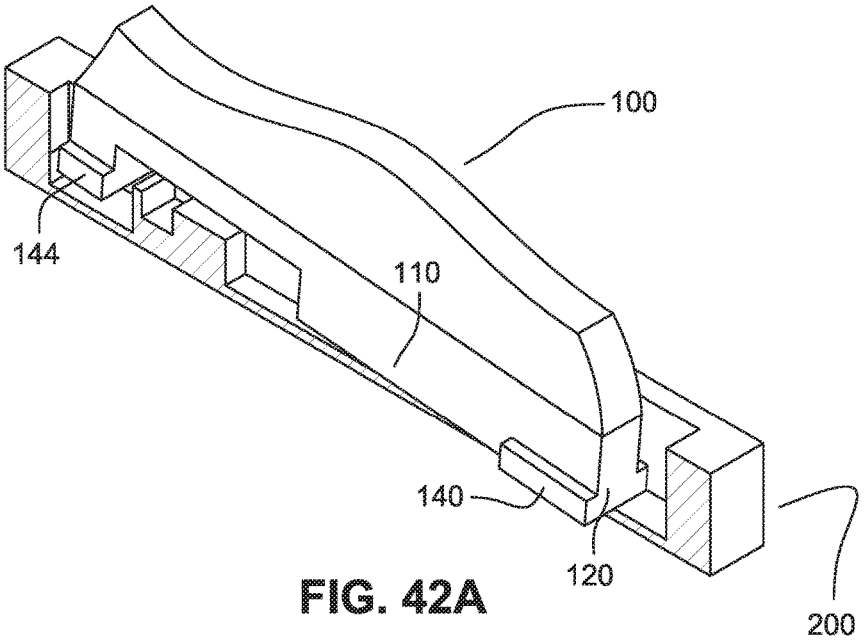
FIG. 42A is a right-side perspective view of a fin configured within a cross sectional fin box, the fin shown in a subsequent intermediate step of the fin insertion sequence.
Figure 42B:
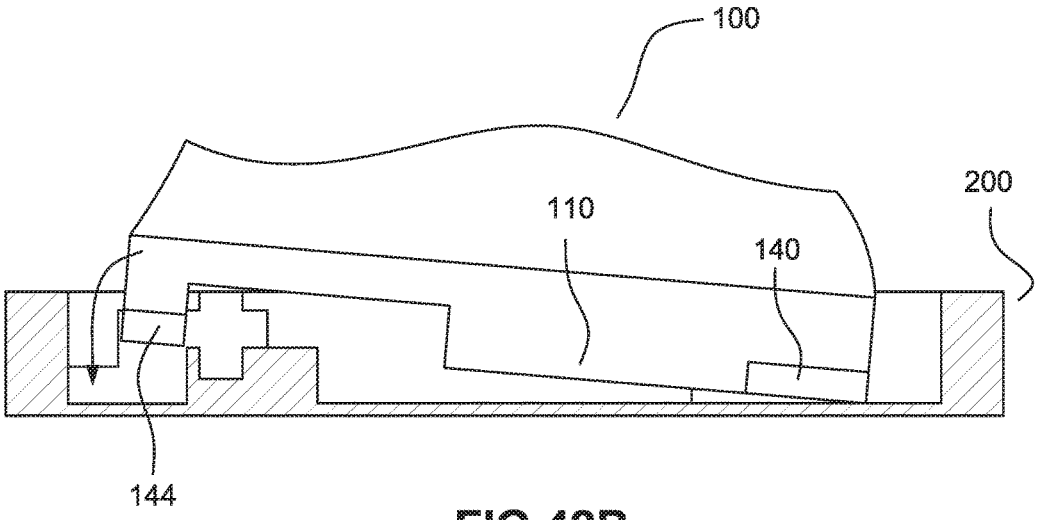
FIG. 42B is a side elevation view of a fin configured within a cross sectional fin box, the fin shown in a subsequent intermediate step of the fin insertion sequence.
Figure 43A:
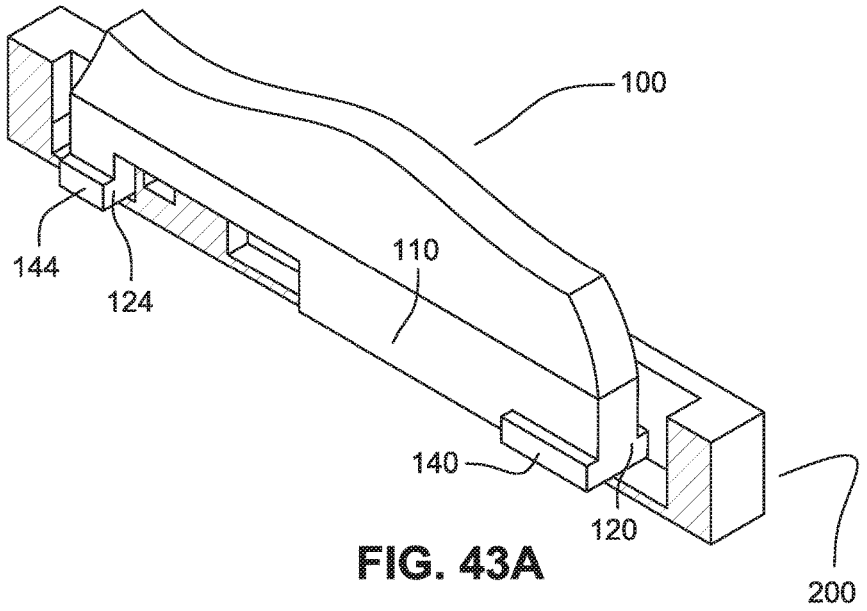
FIG. 43A is a right-side perspective view of a fin configured within a cross sectional fin box, the fin shown in a subsequent intermediate step of the fin insertion sequence.
Figure 43B:
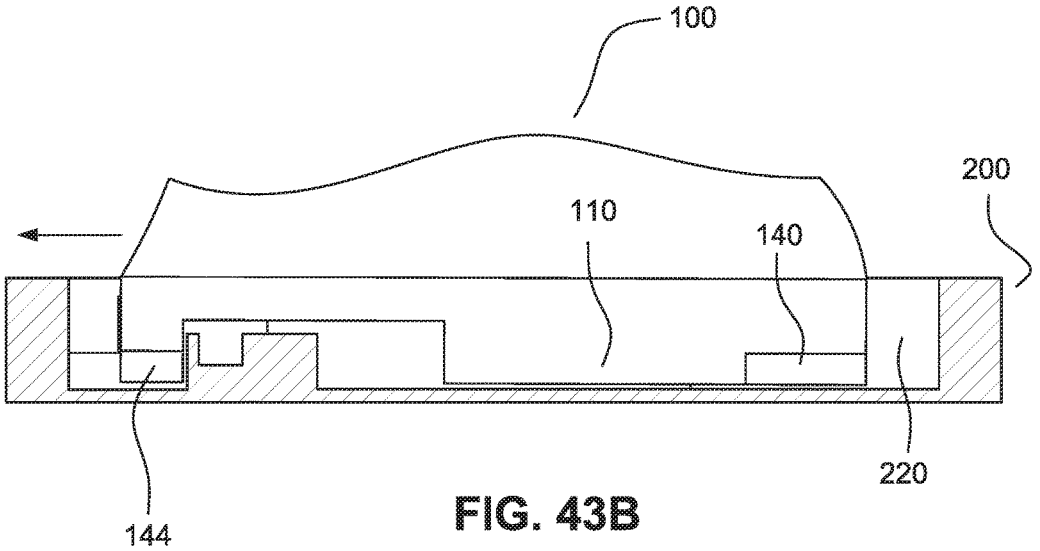
FIG. 43B is a side elevation view of a fin configured within a cross sectional fin box, the fin shown in a subsequent intermediate step of the fin insertion sequence.

Specifically, FIG. 36 shows a fin 100 with forward and rear fin attachment mechanisms 120, 124 at the front of the fin base 110 that corresponds (by shape and dimension) to the vertical access slot 220 of the fin box leading to the elongated slot 210 of the correspondingly dimensioned fin box 200. To prevent the fin 100 from releasing unintentionally, the height of the rear fin attachment mechanisms 124 corresponds with width of the rear vertical access slot 224, thereby restricting the removal of the rear fin attachment mechanism 124 when in a normal or near-normal orientation. That is, in at least this embodiment, the fin attachment mechanisms 120, 124 and any lateral extensions 140, 144 have a base (width) greater than the width of the vertical access slots, 220, 224, specifically the rear vertical access slot 224. In some embodiments, the entry and removal angle of the fin 100 may range between approximately 30°-90°, 45°-90°, 60°-90, be substantially perpendicular (90°), or slightly greater than normal or near-normal orientation in ranges advantageous to secure the fin.

It is envisioned that to begin the insertion sequence in this embodiment, the fin base 110 must be angled or canted into a position that allows the rear fin attachment mechanism 120 to enter the rear vertical access slot 224 of the fin box 200.

Figure 44A:
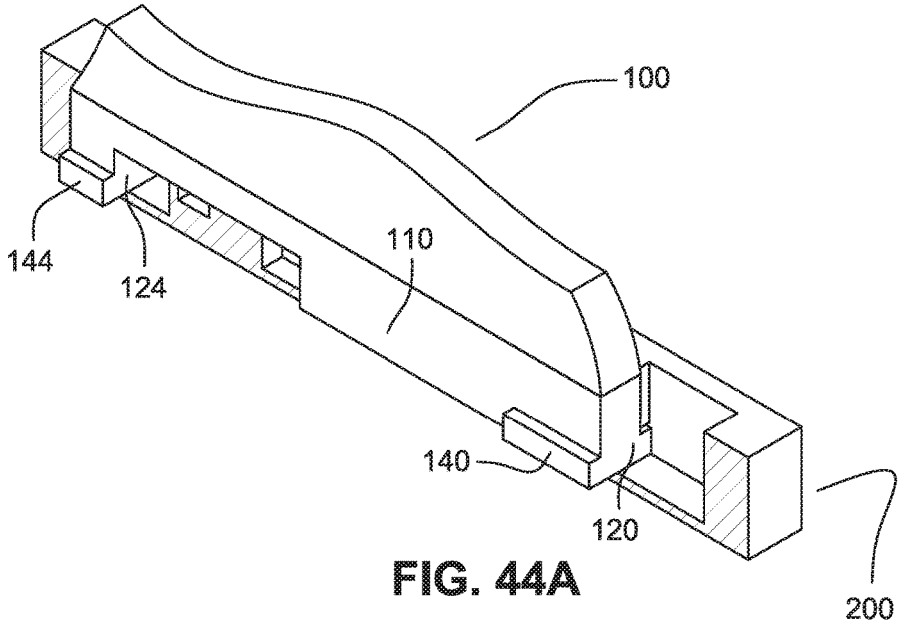
FIG. 44A is a right-side perspective view of a fin configured within a cross sectional fin box, the fin shown fully inserted following the intermediate steps of the fin insertion sequence.
Figure 44B:
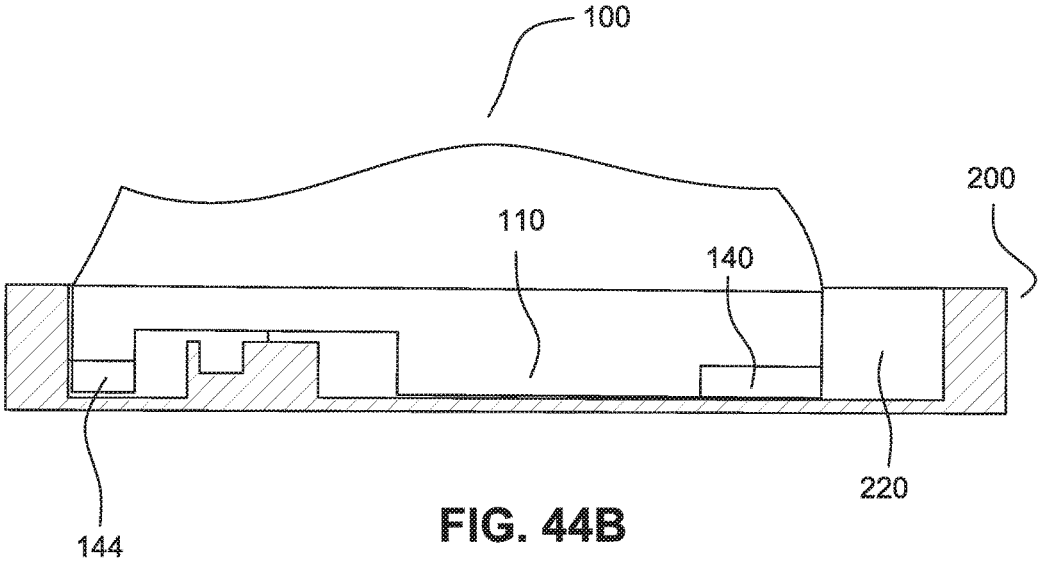
FIG. 44B is a side elevation view of a fin configured within a cross sectional fin box, the fin shown fully inserted following the intermediate steps of the fin insertion sequence.
Figure 45:
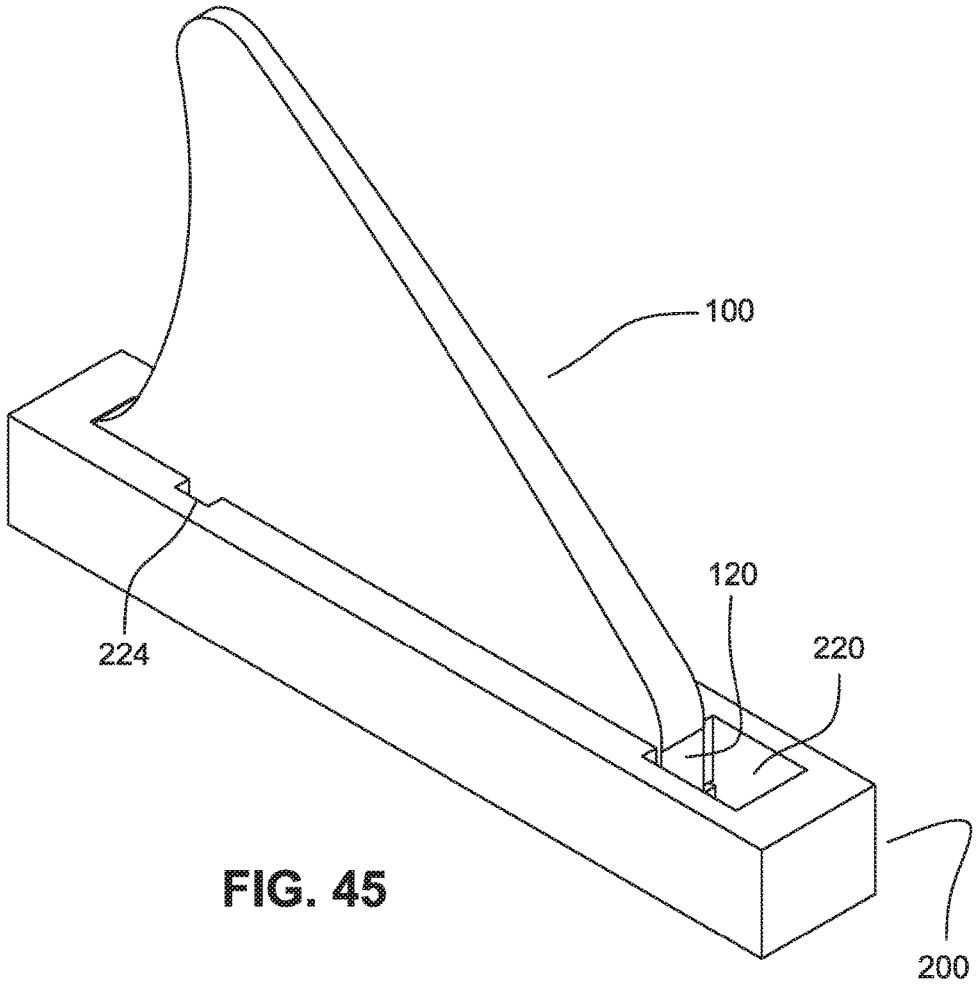
FIG. 45 is a right-side perspective view of a fin configured within a complete fin box, the fin shown fully inserted and secure following the steps of the fin insertion sequence.

In addition, as the fin 100 enters the fin box 200 in this angled orientation, the lateral extension tabs 144 of the rear fin attachment mechanism 124 are dimensioned to be slideably received by the fin box 200. The fin 100 is then guided through the channels of the elongated slot 210 to a forward position that allows for the insertion of the full fin base 110 into the fin box 200. Once positioned within the fin box 200, the fin 100 may follow the steps of the particular insertion sequence, shown in a right-side perspective view, sequentially in FIGS. 38A, 39A, 40A, 41A, 42A, 43A and 44A with the fin box in cross-section. The corresponding sequence of FIGS. 38B, 39B, 40B, 41B, 42B, 43B and 44B provide cross-sections of the fin box and show the same steps from a side elevation view. Specifically, FIGS. 44A and 44B show the lateral extension tab of the fin attachment mechanism positioned towards the rear of the fin box, away from the vertical access slot. FIG. 45 shows the full assembly 20 with a fin 100 and fin box 200.

Figure 46:
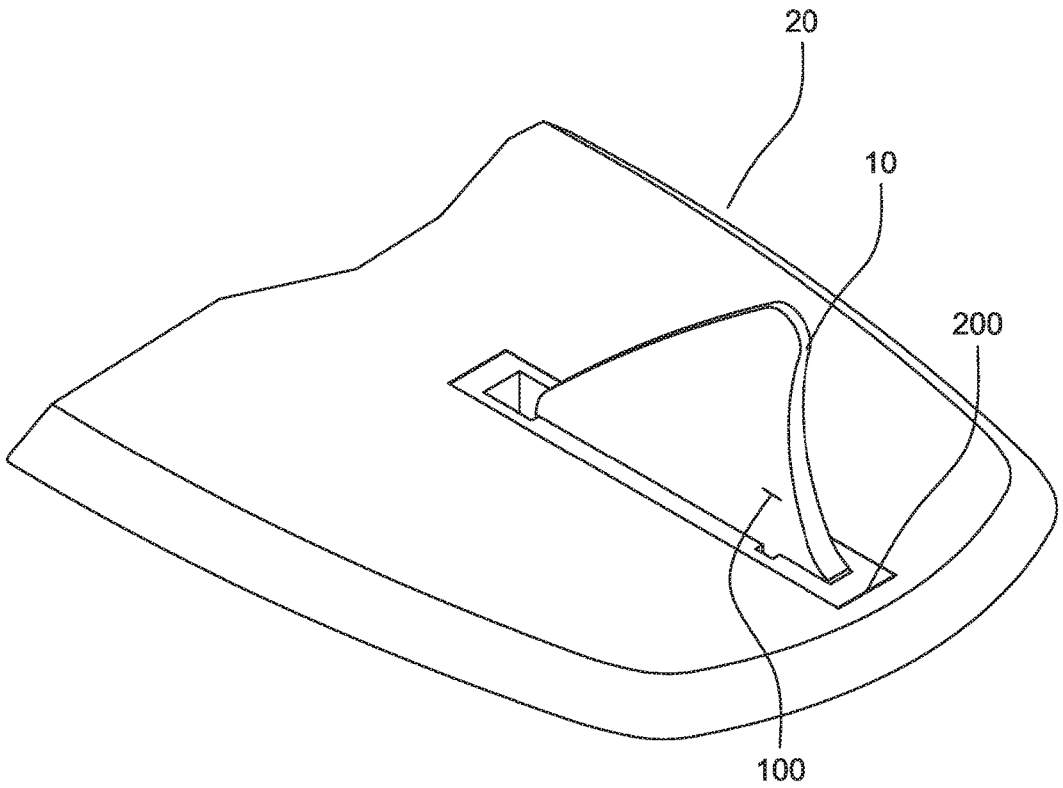
FIG. 46 is a right-side perspective view of a fin configured within a complete fin box, the fin shown fully inserted and securely oriented toward the stern of the surrounding water craft following the steps of the fin insertion sequence.

While the insertion sequence may be different to accommodate specific elongated slot configuration, the steps of the insertion sequence must be followed and reversed to insert and remove the fin, with the fin attachment mechanisms entering (and exiting) the base in a step-wise manner. The lateral extension tabs of the fin attachment mechanisms may further interact with the fin box or with one or more fin securing mechanisms. FIG. 46 shows the full assembly 10 with a partial board 20 shown surrounding the fin 100 and fin box 200, with the fin 100 secured.

E. Single or Multiple Access Slots with Other Securing Mechanism(s)

In various embodiments envisioned or described herein, it may be possible or preferred to secure the device by positioning the fin towards the rear of the fin box, away from the one or more vertical access slot. This position secures the fin within the fin box, allowing for the use of the fin in one or more water craft applications. During use, the force that the water exerts against the fin as the craft is in motion, specifically, as forward motion is maintained, may also help to maintain this secure position. It is understood that the water crafts in which these fins may be deployed are typically propelled in the forward direction and that any rearward movement is generally brief or limited in nature.

Figure 47:
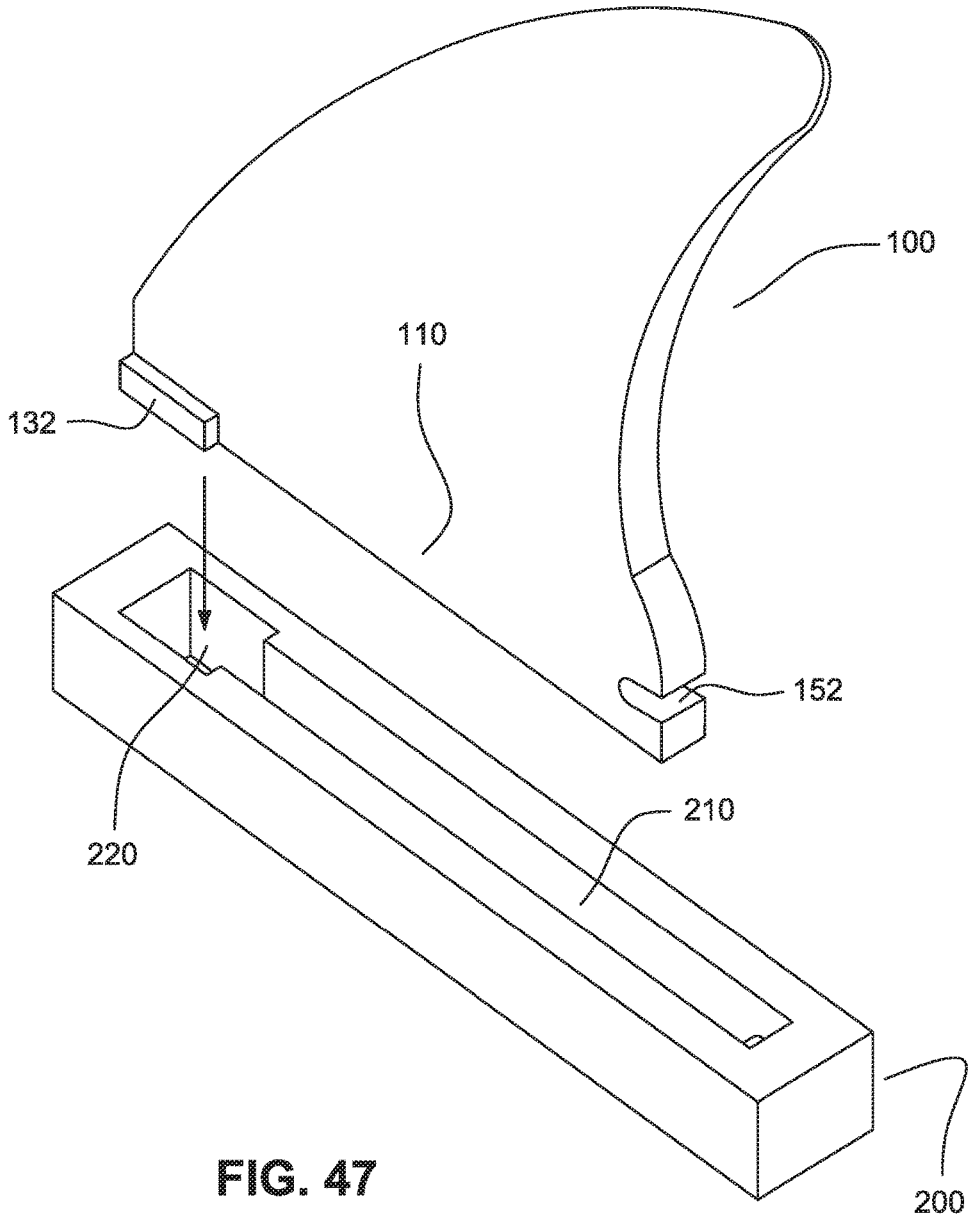
FIG. 47 is a right-side perspective view of a fin with a single fin attachment mechanism and a corresponding fin box, with a notch and pin securing mechanism.
Figure 48:
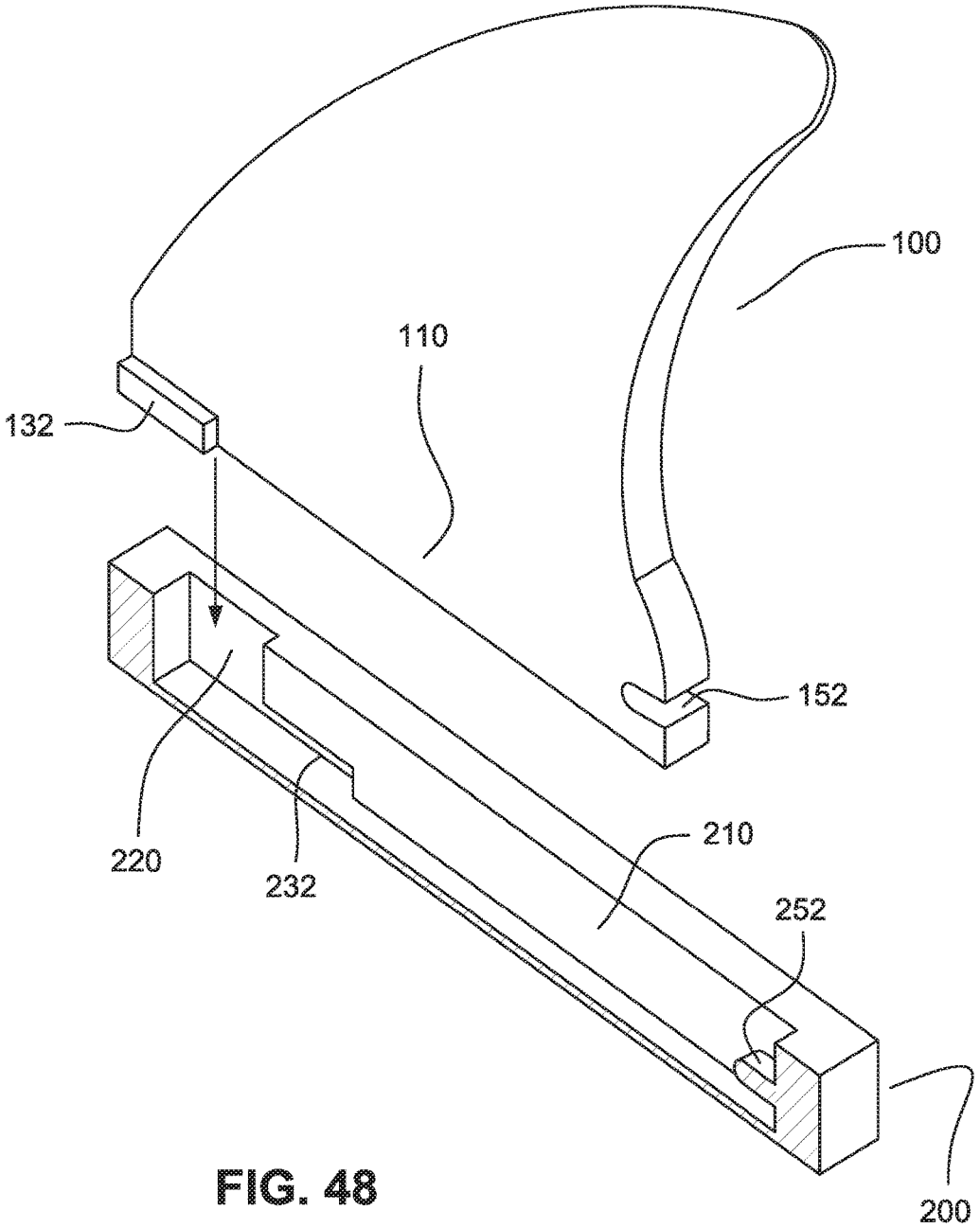
FIG. 48 is a right-side perspective view of a fin with a single fin attachment mechanism with a cross sectional view of the corresponding fin box, with a notch and pin securing mechanism.
Figure 49:
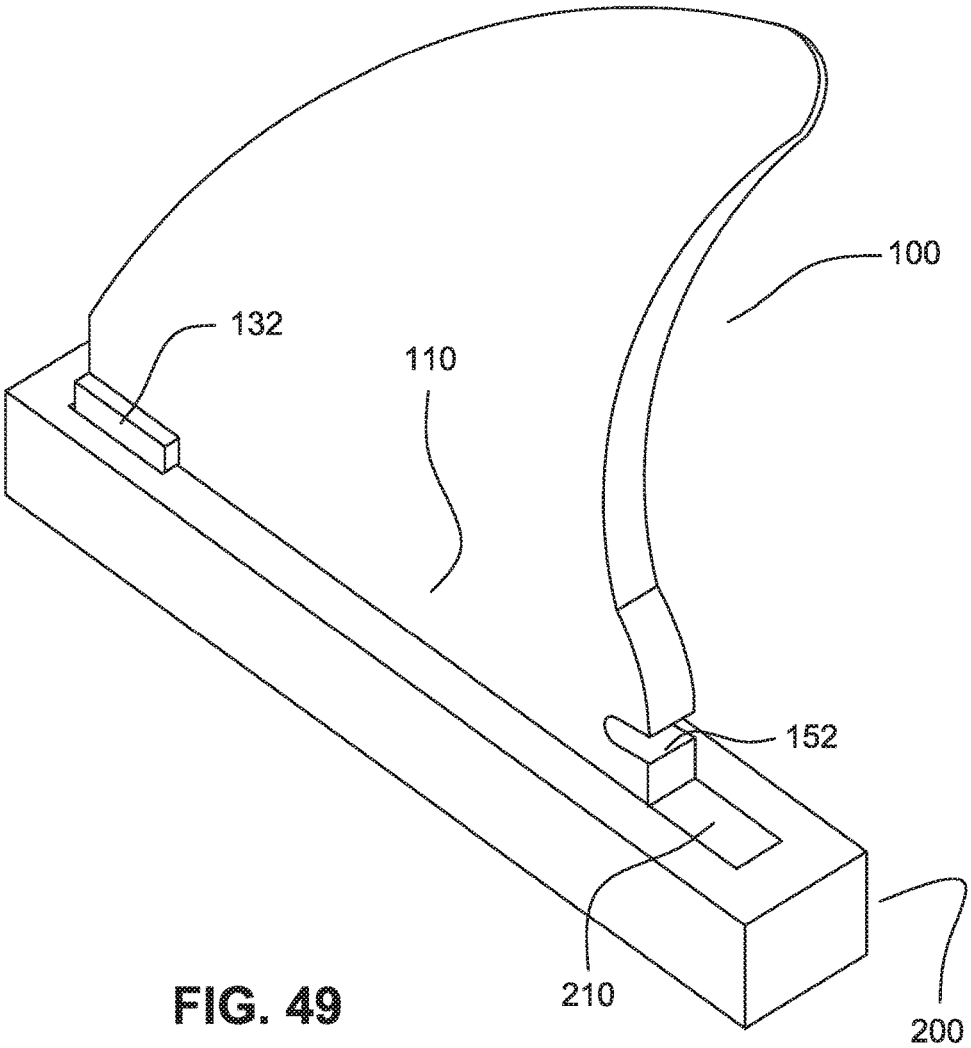
FIG. 49 is a right-side perspective view of a fin with a notch and pin securing mechanism, showing the interaction with fin box before initiation of the fin insertion sequence.
Figure 50A:
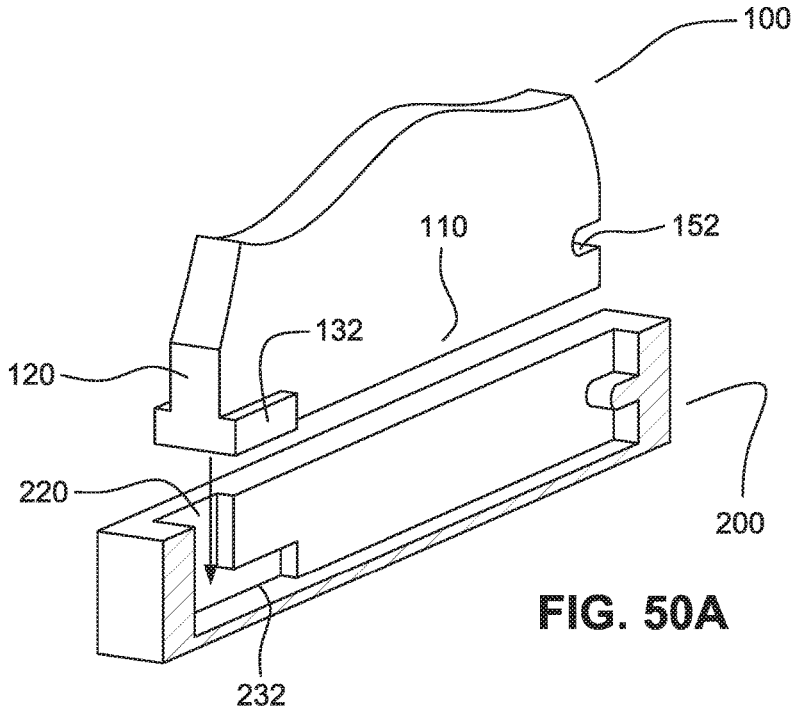
FIG. 50A is a left-side perspective view of a fin with a notch and pin securing mechanism and a single fin attachment mechanism, oriented to be slideably received by the fin box shown in cross section, shown just prior to the initiation of the fin insertion sequence.
Figure 50B:
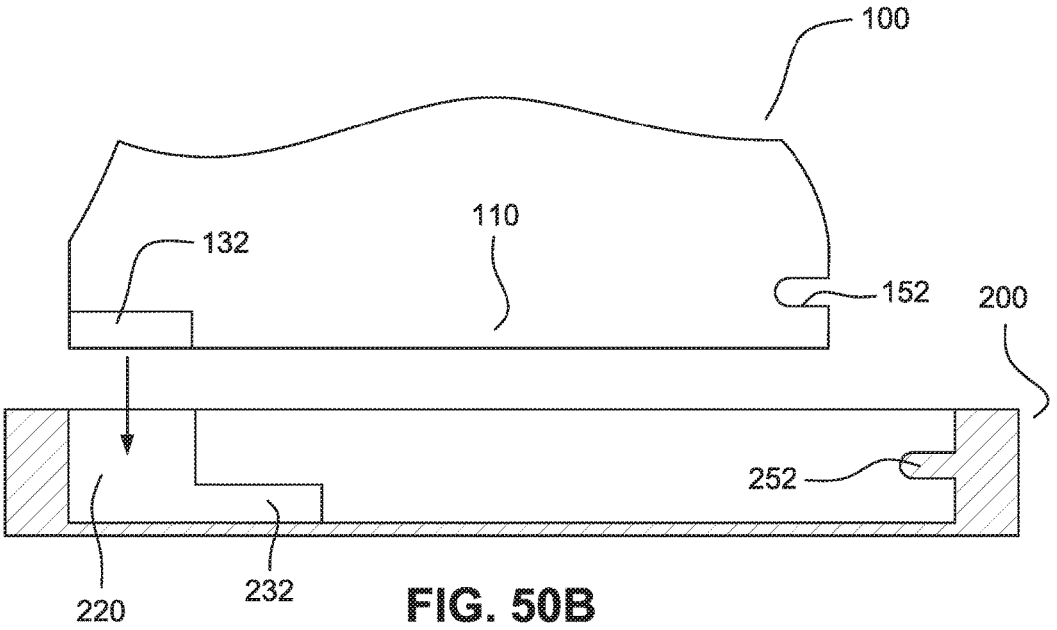
FIG. 50B is a side elevation view of a fin with a notch and pin securing mechanism and a single fin attachment mechanism oriented to be slideably received by the fin box shown in cross section, just prior to the initiation of the fin insertion sequence.
Figure 51A:
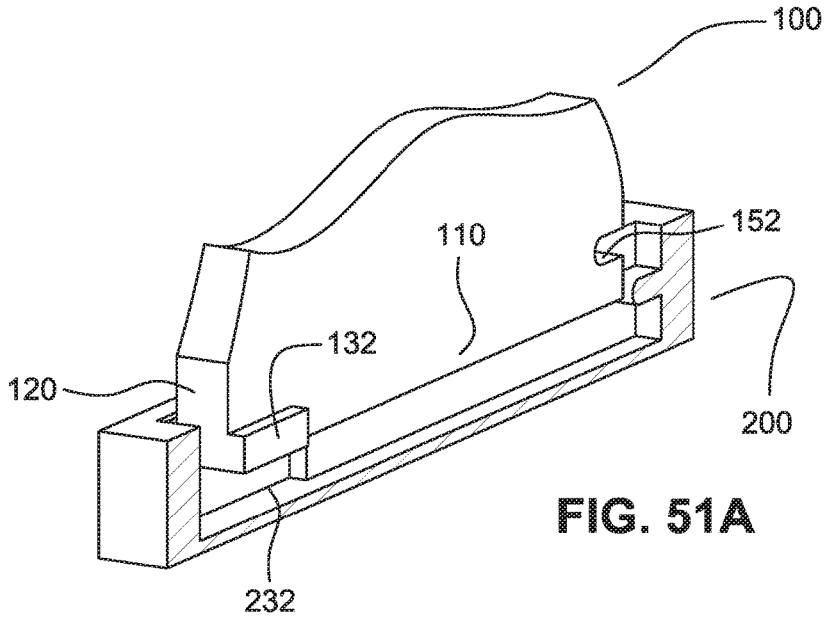
FIG. 51A is a left-side perspective view of a fin with a notch and pin securing mechanism and a single fin attachment mechanism configured within a cross sectional fin box, the fin shown in an intermediate step of the fin insertion sequence.
Figure 51B:
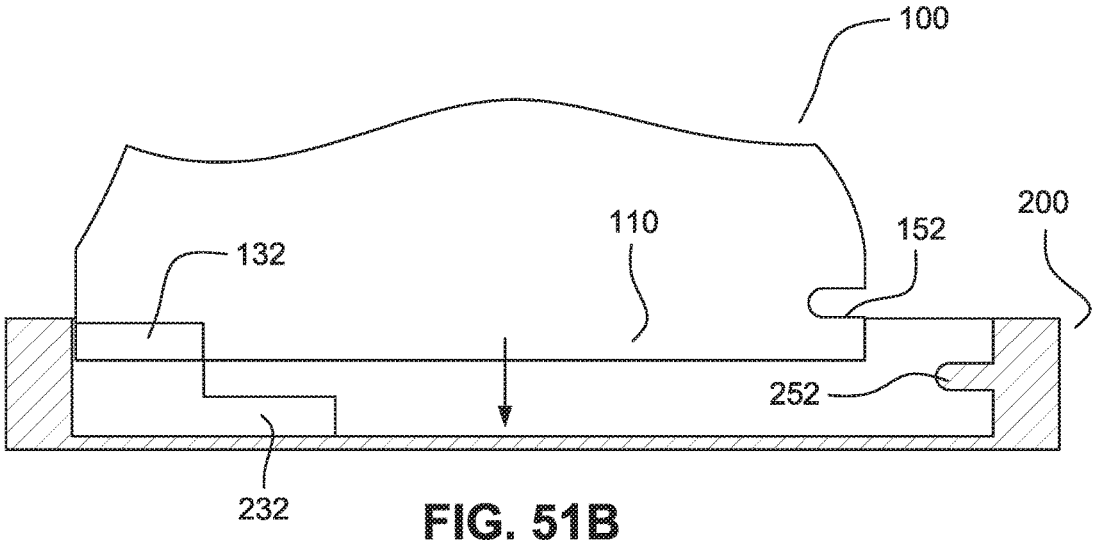
FIG. 51B is a side elevation view of a fin with a notch and pin securing mechanism and a single fin attachment mechanism configured within a cross sectional fin box, the fin shown in an intermediate step of the fin insertion sequence.
Figure 52A:
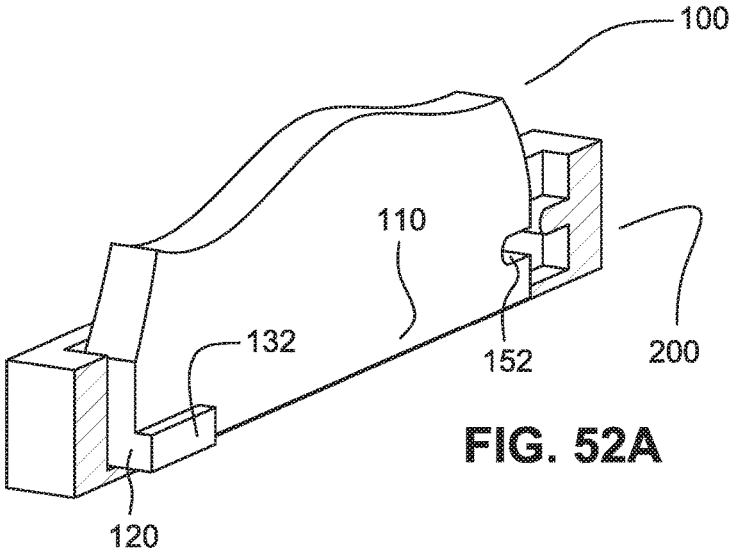
FIG. 52A is a left-side perspective view of a fin with a notch and pin securing mechanism and a single fin attachment mechanism configured within a cross sectional fin box, the fin shown in an intermediate step of the fin insertion sequence.
Figure 52B:
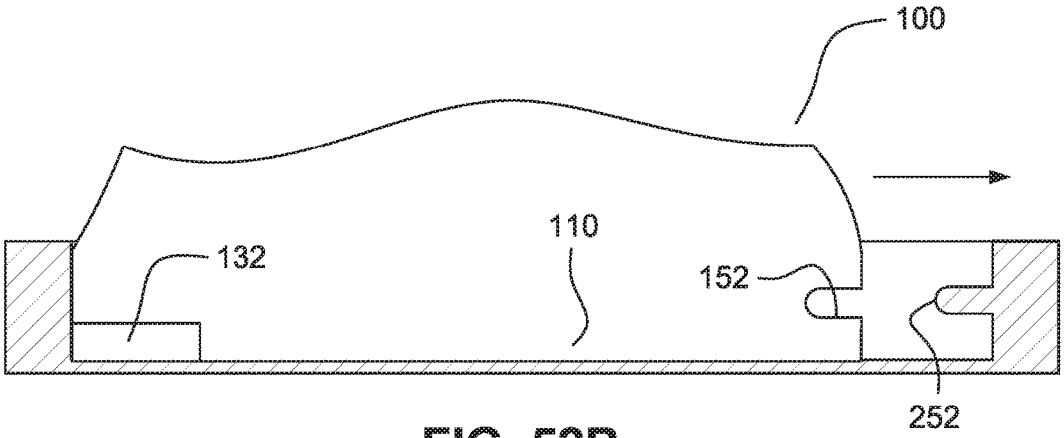
FIG. 52B is a side elevation view of a fin with a notch and pin securing mechanism and a single fin attachment mechanism configured within a cross sectional fin box, the fin shown in an intermediate step of the fin insertion sequence.
Figure 53A:
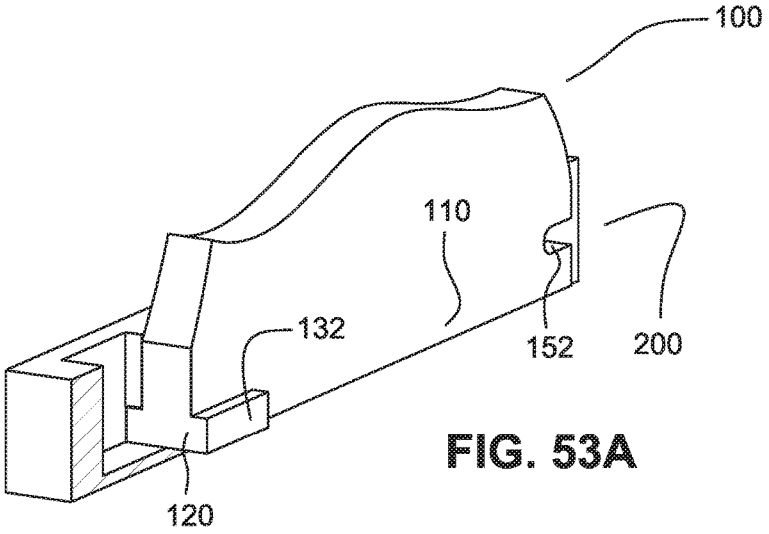
FIG. 53A is a left-side perspective view of a fin with a notch and pin securing mechanism and a single fin attachment mechanism configured within a cross sectional fin box, the fin shown fully inserted and secure with the lateral extensions and securing mechanisms positioned within the fin box following the steps of the fin insertion sequence.
Figure 53B:
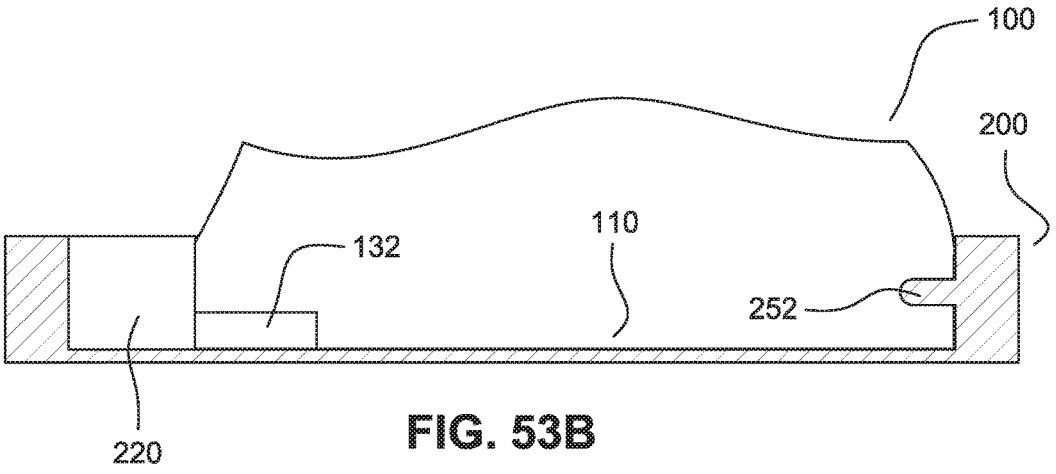
FIG. 53B is a side elevation view of a fin with a notch and pin securing mechanism and a single fin attachment mechanism configured within a cross sectional fin box, the fin shown fully inserted and secure with the lateral extensions and securing mechanisms positioned within the fin box following the steps of the fin insertion sequence.

Numerous securing mechanisms may be used to secure or maintain fin position. In addition to the friction fit, device curvature, and detent described previously (e.g. in combination with a small ridge or divot), FIG. 47 shows a fin system with a fin 100 comprising a fin base 110 with an additional notch 152 feature to secure the fin 100 within the fin box 200. The notch 152 of the fin base, forming an area absent from the base, is dimensioned to be filled by a shape complement when the fin 100 and fin base 110 is slideably received in the fin box 200, following the prescribed insertion sequence. In some envisioned embodiments, the complementary structure may be referred to as a pin 252, and may be in the shape of a pin, slat or any shape that complements the shape of the notch 152. The pin 252 is clearly visible in the cross-sectional view of FIG. 48 and further secures the fin base 110 within the box 200. FIG. 49 shows the position of the fin 100 and fin box 200 prior to the initiation of the insertion sequence. FIGS. 50A, 51A, 52A and 53A provide cross-sections of the fin box 200 and show the steps of the insertion sequence from a left-side perspective view, while 50B, 51B, 52B and 53B provide cross-sectional views of the same sequence from a side elevation view. Upon completion of the insertion sequence, as shown in FIGS. 53A and 53B, the lateral extension tab 132 has been slid rearward into the lateral groove 232 of the fin box 200 securing at least one end of the fin 100, and pin 252 of the fin box 200 is received in the notch 152 of the fin 100, further securing the rear of the fin base 110.

Figure 54:
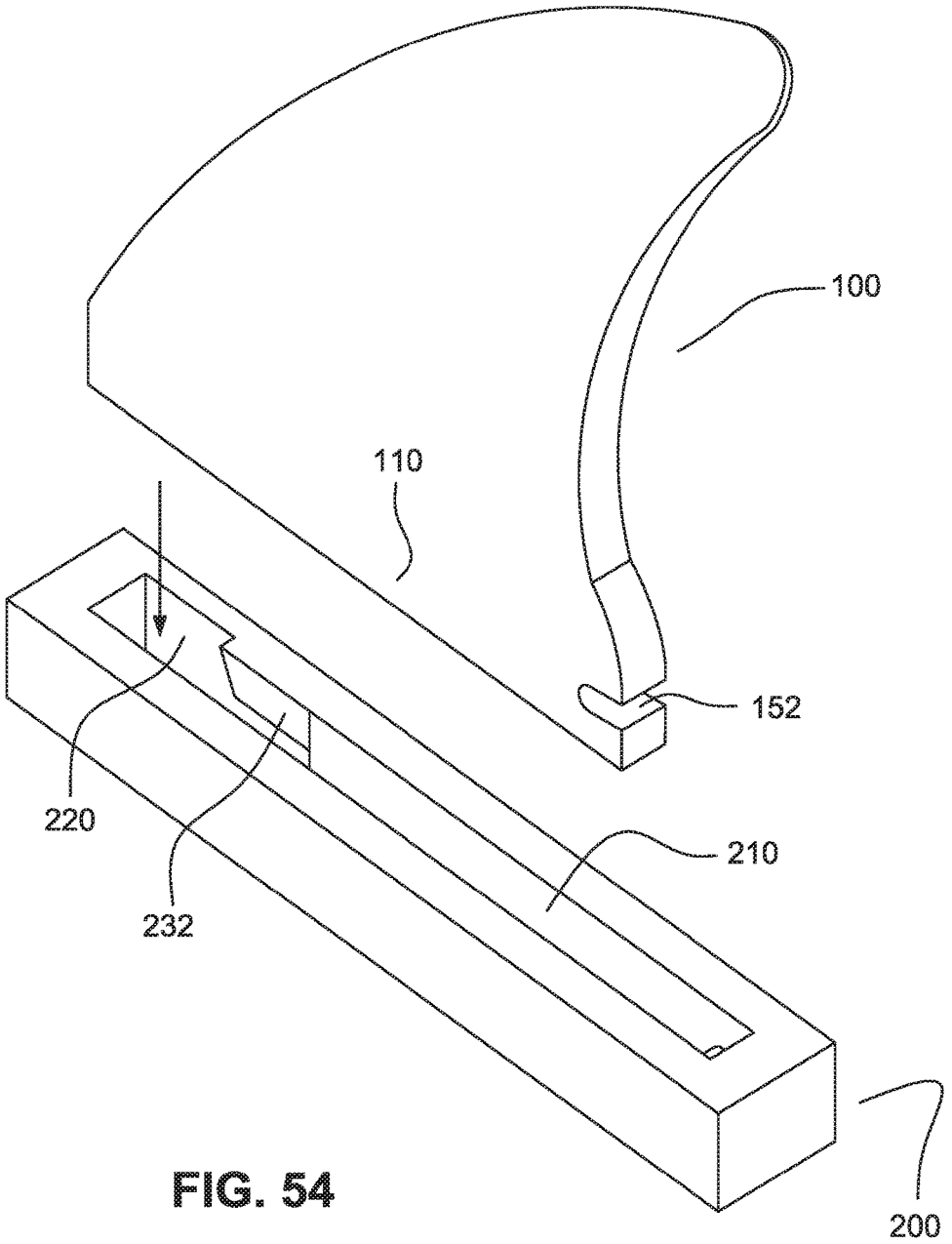
FIG. 54 is a right-side perspective view of a fin with a single fin attachment mechanism and a corresponding fin box, with a notch and pin securing mechanism.
Figure 55:
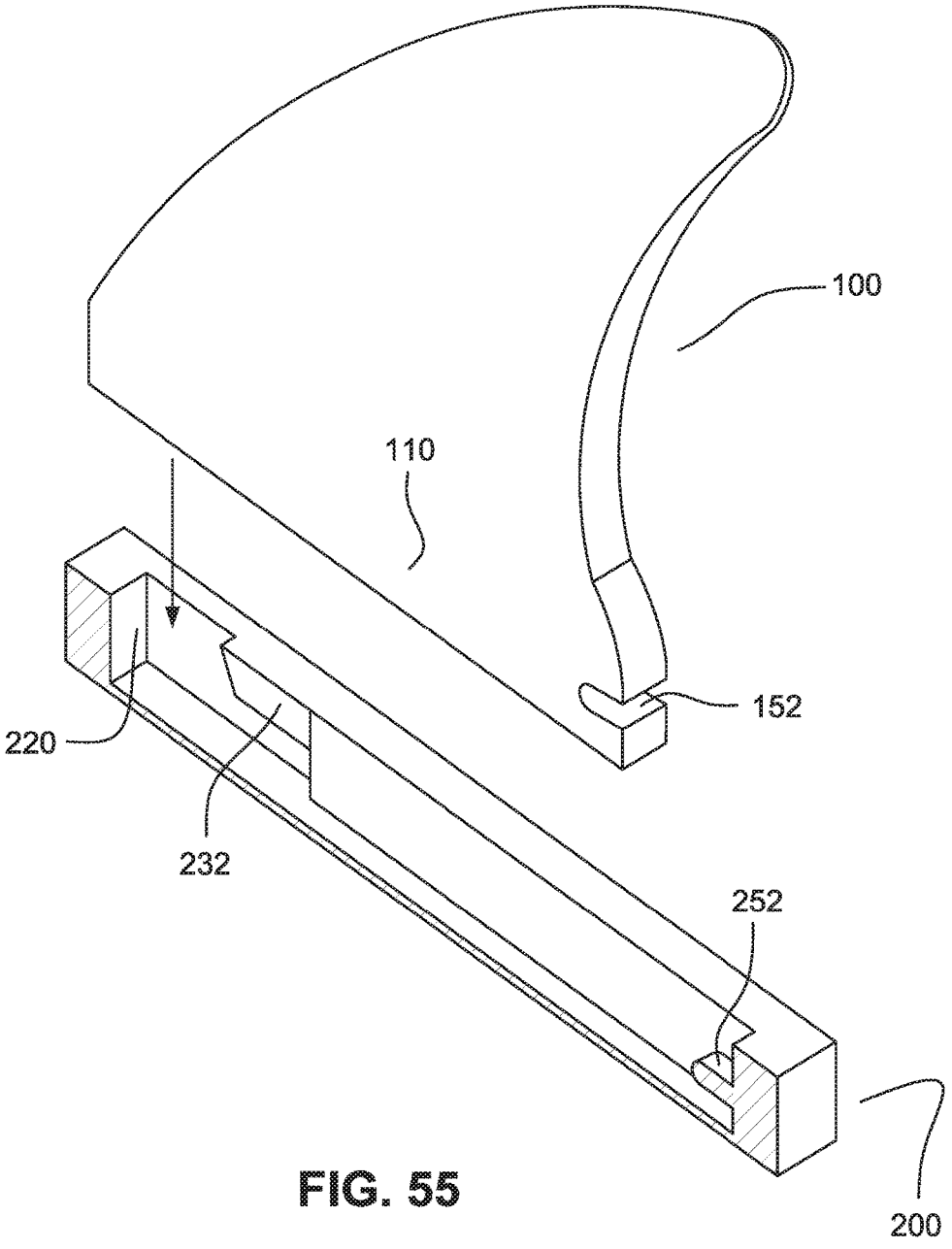
FIG. 55 is a right-side perspective view of a fin with a single fin attachment mechanism with a cross sectional view of the corresponding fin box, with a notch and pin securing mechanism.
Figure 56:
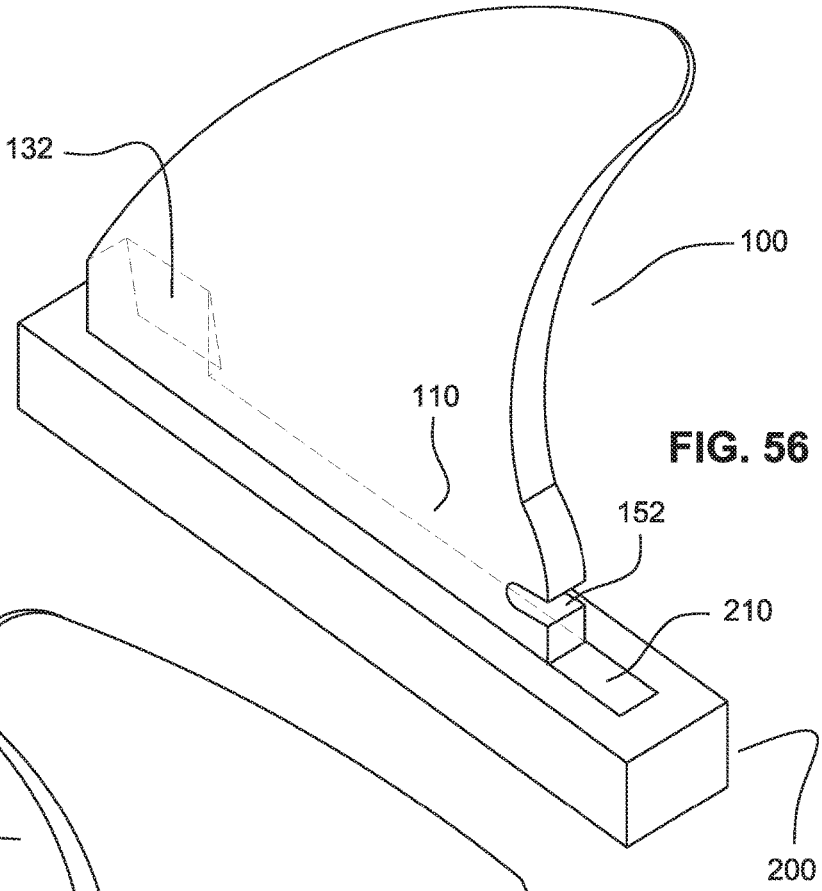
FIG. 56 is a right-side perspective view of a fin with a notch and pin and tapered fin base securing mechanism, showing the interaction with fin box before initiation of the fin insertion sequence.
Figure 57:
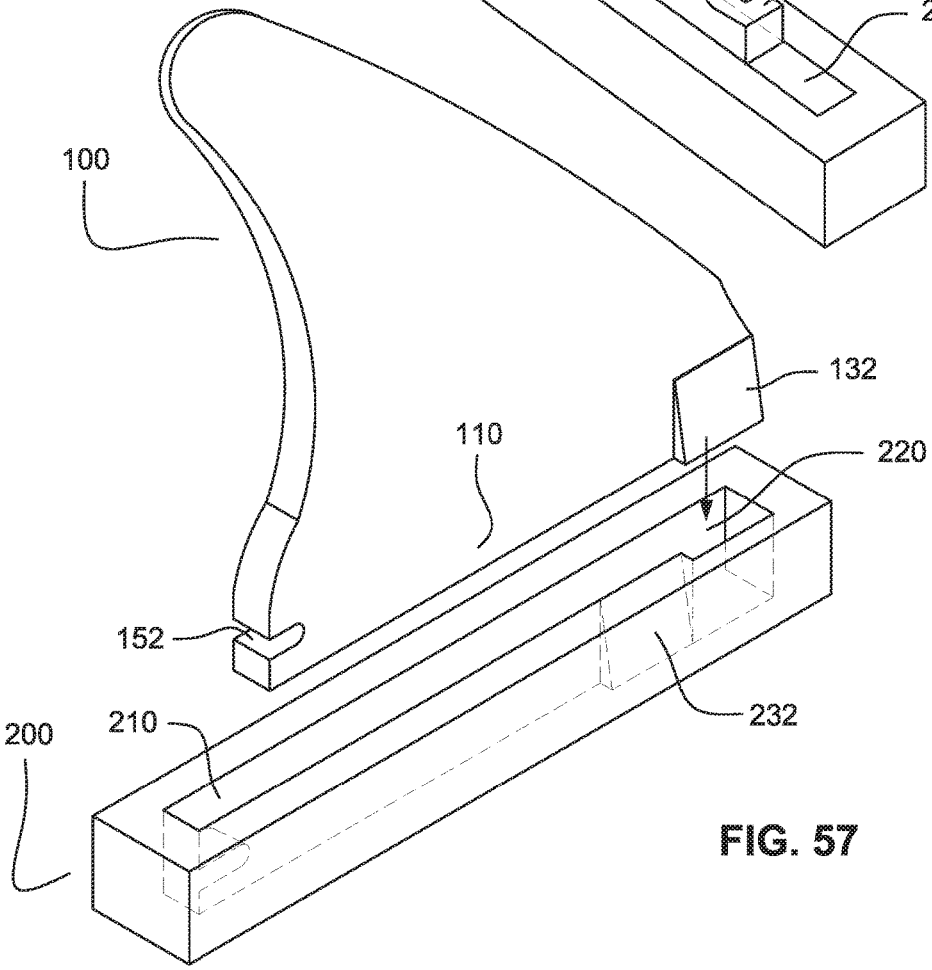
FIG. 57 is a left-side perspective view of a fin with the notch and pin and tapered fin base securing mechanism of the previous figure, showing the reverse angle and the interaction with fin box before initiation of the fin insertion sequence.
Figure 58A:
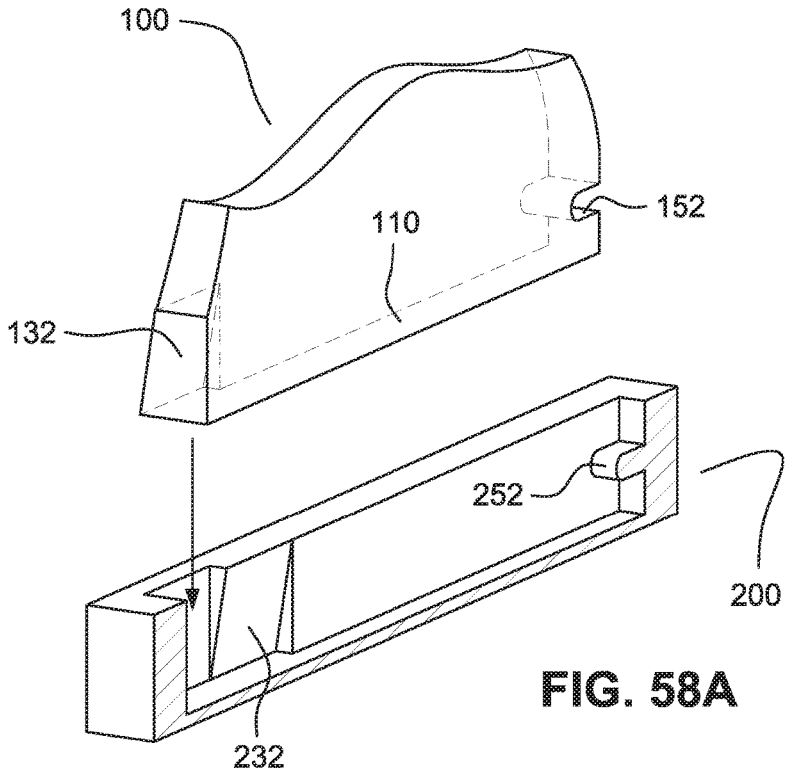
FIG. 58A is a left-side perspective view of a fin with a notch and pin and tapered fin base securing mechanism and a single fin attachment mechanism, oriented to be slideably received by the fin box shown in cross section, shown prior to the initiation of the fin insertion sequence.
Figure 58B:
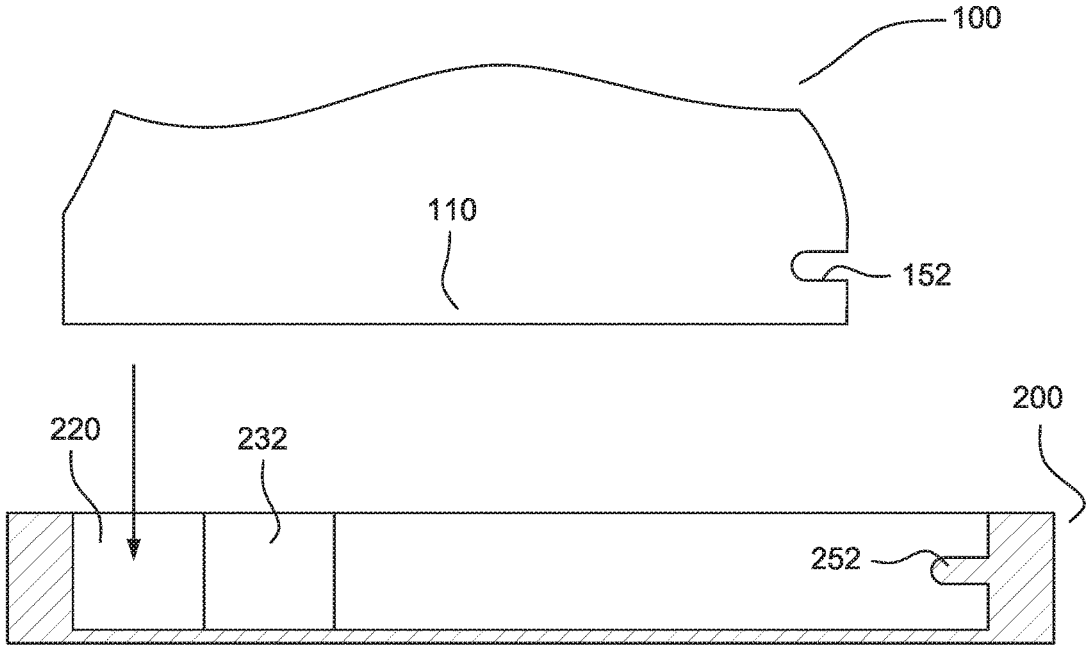
FIG. 58B is a side elevation view of a fin with a notch and pin and tapered fin base securing mechanism and a single fin attachment mechanism oriented to be slideably received by the fin box shown in cross section, prior to the initiation of the fin insertion sequence.
Figure 59A:
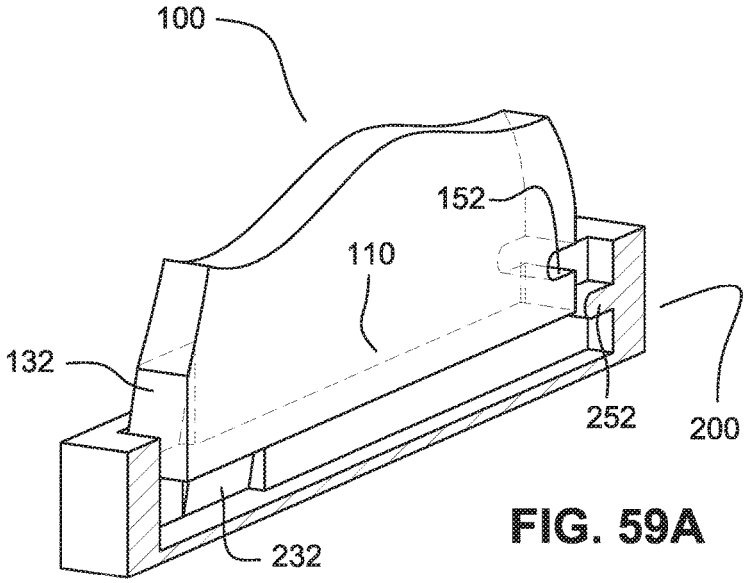
FIG. 59A is a left-side perspective view of a fin with a notch and pin and tapered fin base securing mechanism and a single fin attachment mechanism configured within a cross sectional fin box, the fin shown in an intermediate step of the fin insertion sequence.
Figure 59B:
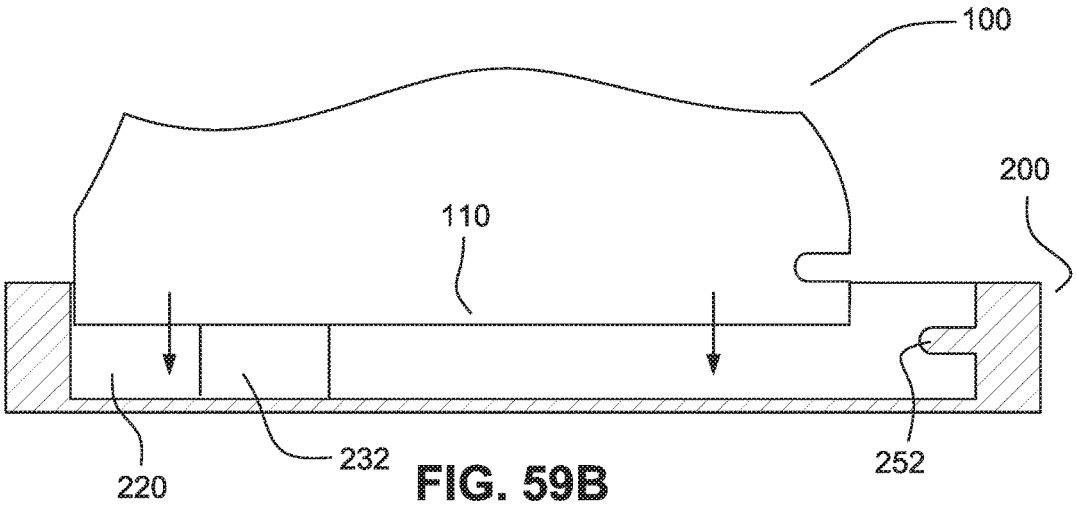
FIG. 59B is a side elevation view of a fin with a notch and pin and tapered fin base securing mechanism and a single fin attachment mechanism configured within a cross sectional fin box, the fin shown in an intermediate step of the fin insertion sequence.
Figure 60A:
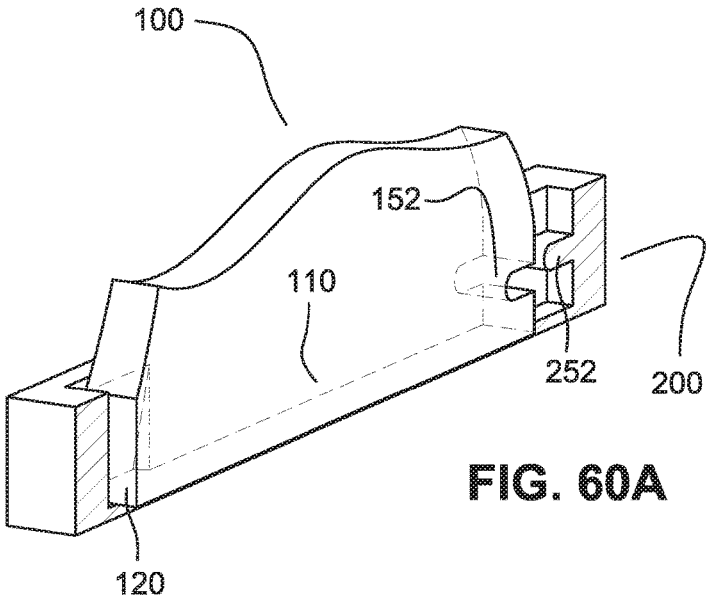
FIG. 60A is a left-side perspective view of a fin with a notch and pin and tapered fin base securing mechanism and a single fin attachment mechanism configured within a cross sectional fin box, the fin shown in an intermediate step of the fin insertion sequence.
Figure 60B:
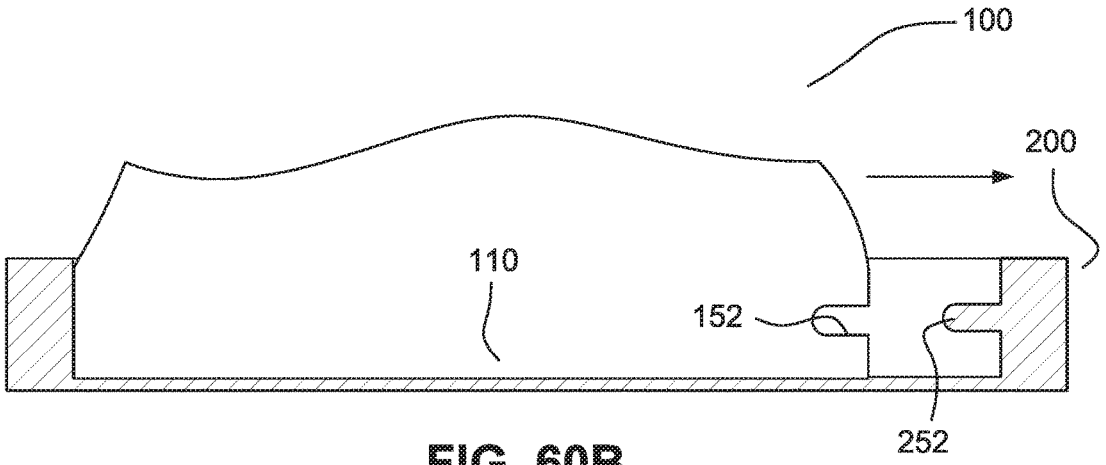
FIG. 60B is a side elevation view of a fin with a notch and pin and tapered fin base securing mechanism and a single fin attachment mechanism configured within a cross sectional fin box, the fin shown in an intermediate step of the fin insertion sequence.

In a further envisioned embodiment, fin 100 or fin box 200 with a tapered configuration may be use to further secure the fin within the fin box. As with any of the securing mechanisms described herein, the tapered configuration may be used as an alternative or in combination with other desired features. As such, FIG. 54 shows a fin with a fin base with an optional notch feature, as described above. In addition, the fin base 110 also comprises a taper or cut-out lateral extension tab 132, which may be slideably received by a tapered lateral groove 232 that is located along at least one wall of the fin box 200, as a part of the elongated slot 210. This single-sided taper can be seen in the cross-section shown in FIG. 55. FIGS. 56 and 57, on the other hand, shows the corresponding shape of the lateral extension 132 of the fin base 110 that is configured to be slideably received in the tapered groove 232 along the length of the elongated slot 210. As the maximum width of the fin base 110 is equal to the width of the vertical access slot 220, but is greater than the width of the elongated slot 210, once the fin is secured in its final rearward position, the fin 100 may not be extracted from the fin box 200 without reversing the steps of the insertion sequence.

Figure 61A:
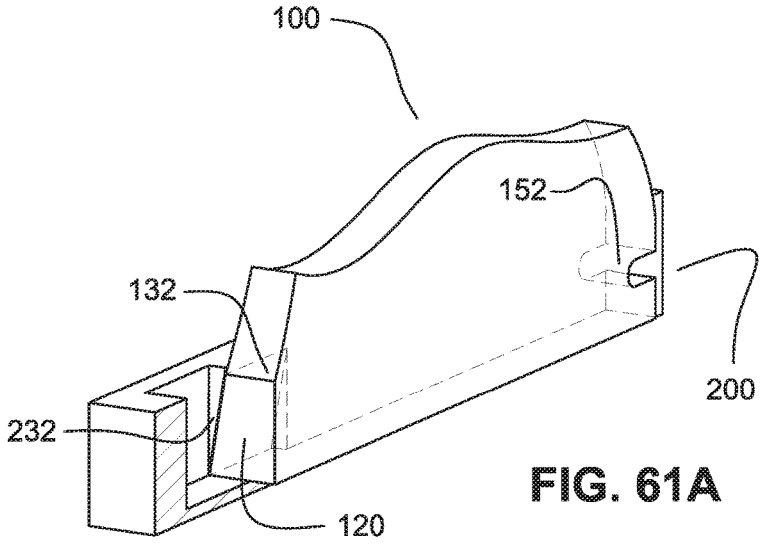
FIG. 61A is a left-side perspective view of a fin with a notch and pin and tapered fin base securing mechanism and a single fin attachment mechanism configured within a cross sectional fin box, the fin shown fully inserted and secure with the lateral extensions and securing mechanisms positioned within the fin box following the steps of the fin insertion sequence.
Figure 61B:
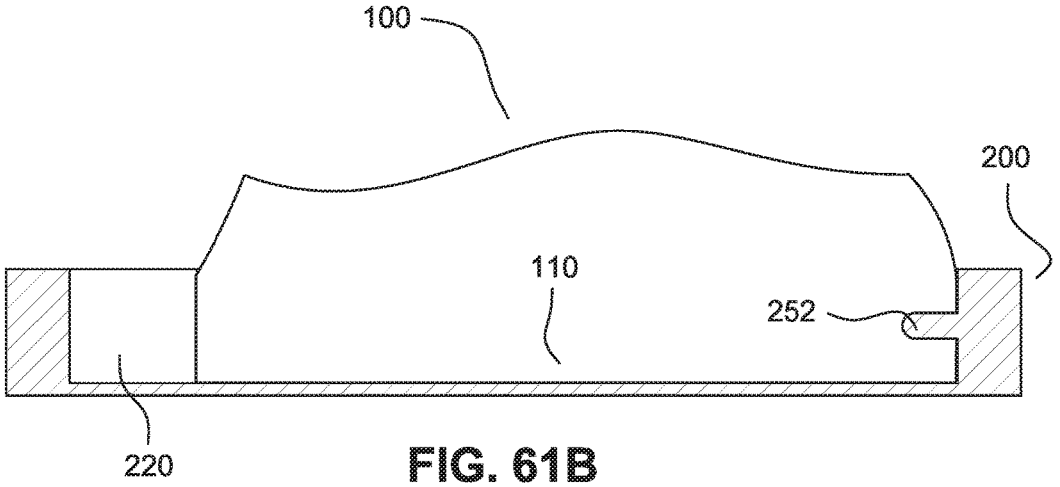
FIG. 61B is a side elevation view of a fin with a notch and pin and tapered fin base securing mechanism and a single fin attachment mechanism configured within a cross sectional fin box, the fin shown fully inserted and secure with the lateral extensions and securing mechanisms positioned within the fin box following the steps of the fin insertion sequence.

FIGS. 58A, 59A, 60A and 61A provide cross-sections of the fin box 200 and show the steps of the insertion sequence from a left-side perspective view, while 58A, 59A, 60A and 61A provide cross-sectional views of the same sequence from a side elevation view. Upon completion of the insertion sequence, as shown in FIGS. 61A and 61B, the lateral extension tab 132 has been slid rearward into the taper of the lateral groove 232 of the fin box 200, securing the fin base 110. In addition, the optional pin 252 of the fin box 200 is received in the notch 152 of the fin, further securing the rear of the fin base 110.

In a further embodiment, it is envisioned that the lateral extension tab 132 of the forward fin attachment mechanism 120 of the fin base 110 is further tapered in a longitudinal manner. The taper being smallest at the forward end of the fin base 110.

Figure 62:
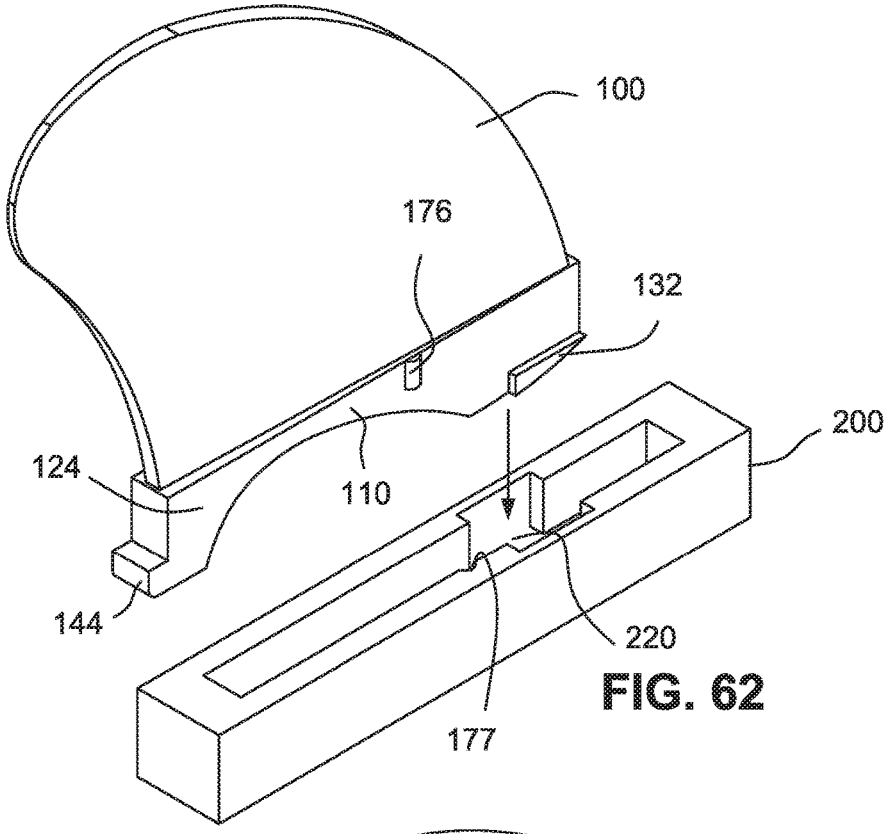
FIG. 62 is a right-side perspective view of a fin with multiple fin attachment mechanisms, and a longitudinally tapered forward fin attachment mechanism and a rear longitudinal tab shown with a corresponding fin box with a single vertical access slot.
Figure 63:
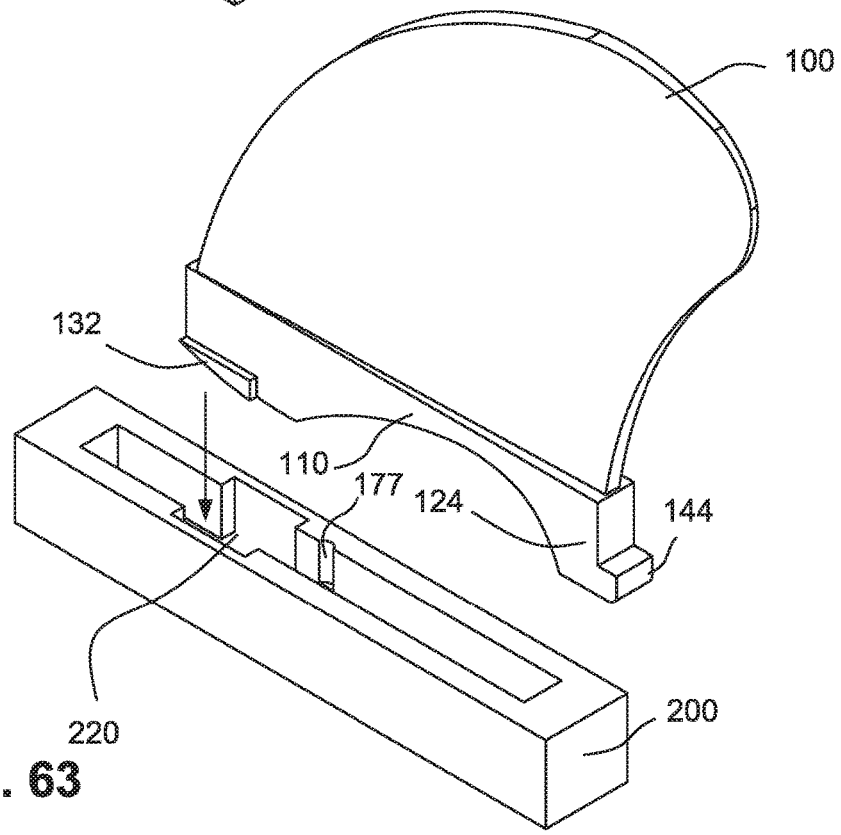
FIG. 63 is the reverse perspective view of the previous figure of a fin with multiple fin attachment mechanisms and a longitudinally tapered forward fin attachment mechanism and a rear longitudinal tab shown together with a corresponding fin box with a single vertical access slot.
Figure 64A:
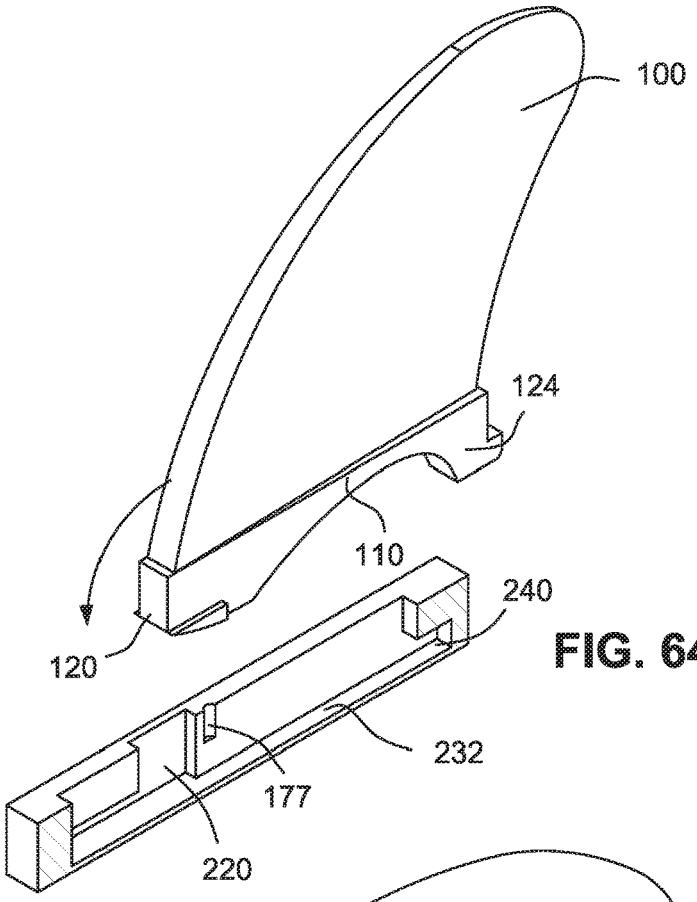
FIG. 64A is a left-side perspective view of a fin with multiple fin attachment mechanisms a longitudinally tapered forward fin attachment mechanism and a rear longitudinal tab, shown with the corresponding F in box with a single vertical access slot
Figure 64B:
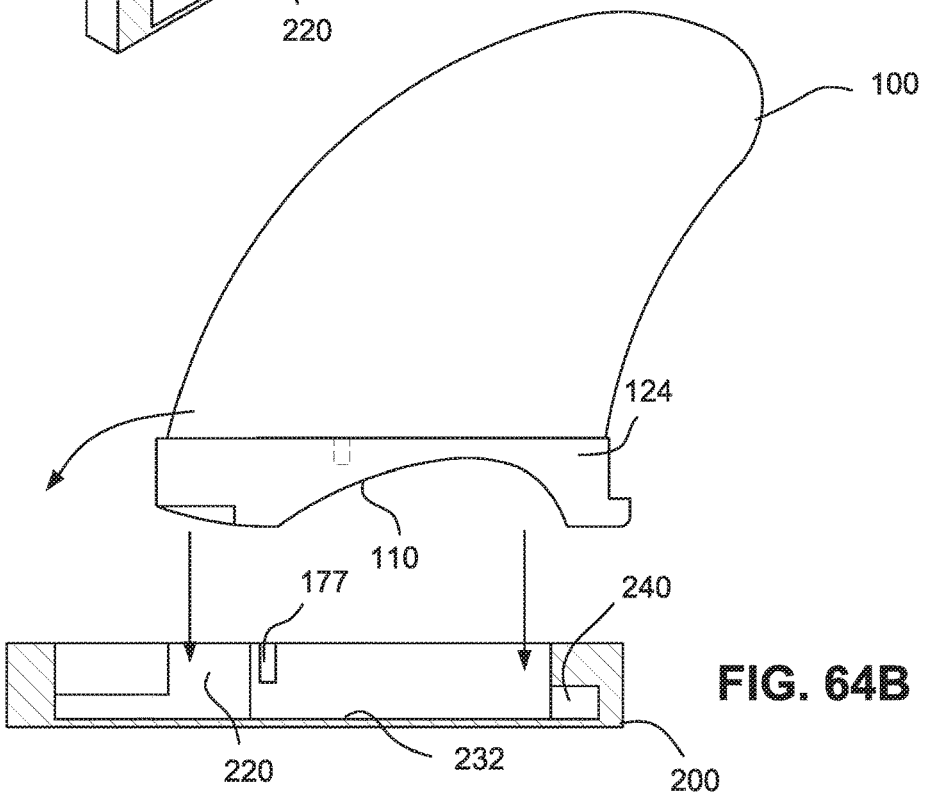
FIG. 64B is a side elevation view of a fin with multiple fin attachment mechanisms, a longitudinally tapered forward fin attachment mechanism and a rear longitudinal tab oriented to be slideably received in sequential order by the fin box shown in cross section, the fin shown in an alignment step of the fin insertion sequence.
Figure 65A:
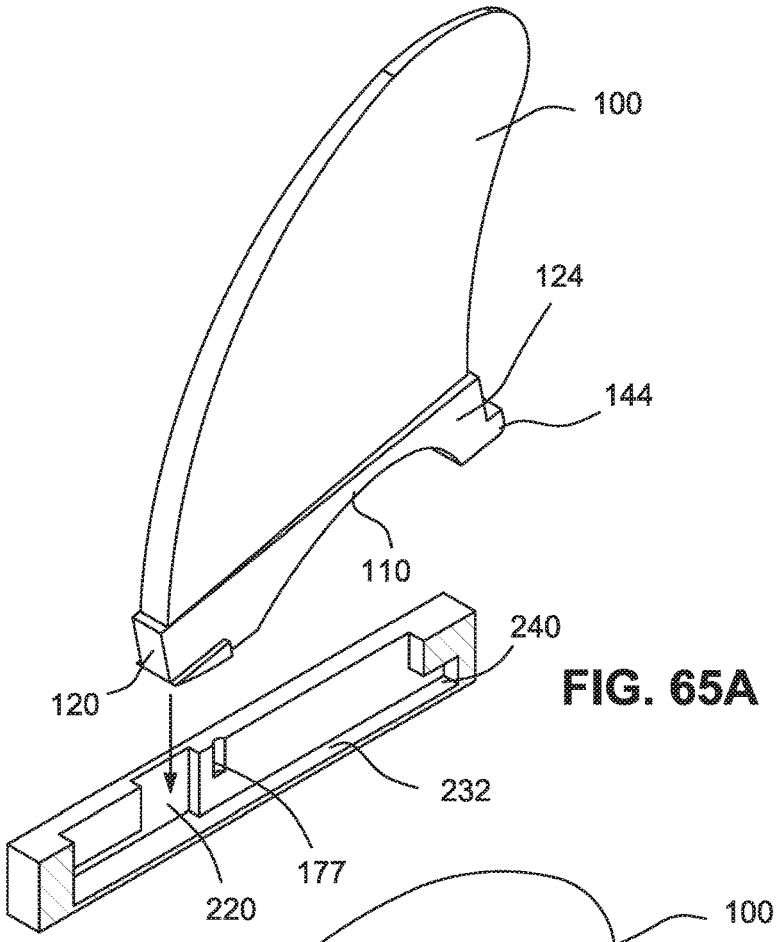
FIG. 65A is a left-side perspective view of a fin with multiple fin attachment mechanisms a longitudinally tapered forward fin attachment mechanism and a rear longitudinal tab shown with the fin rotated at a forward angle to the corresponding fin box with a single vertical access slot.
Figure 65B:
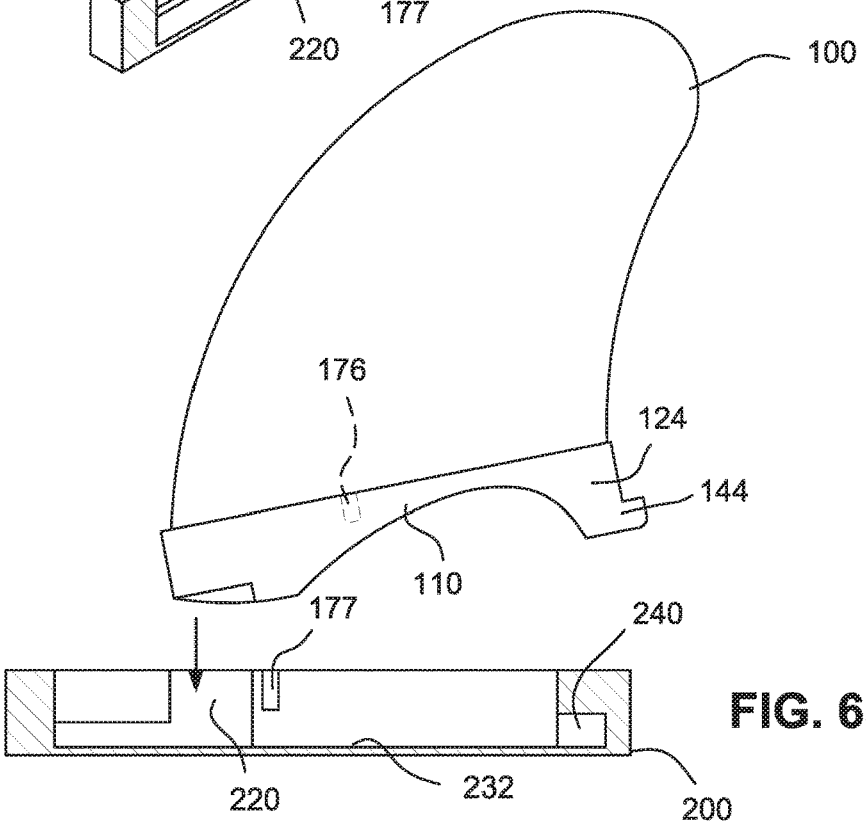
FIG. 65B is a side elevation view of a fin with multiple fin attachment mechanisms a longitudinally tapered forward fin attachment mechanism and a rear longitudinal tab, rotated at a forward angle showing the insertion angle of the forward fin attachment mechanism into the single vertical access slot in sequential order by the fin box shown in cross section, the fin shown in an alignment step of the fin insertion sequence.
Figure 66:
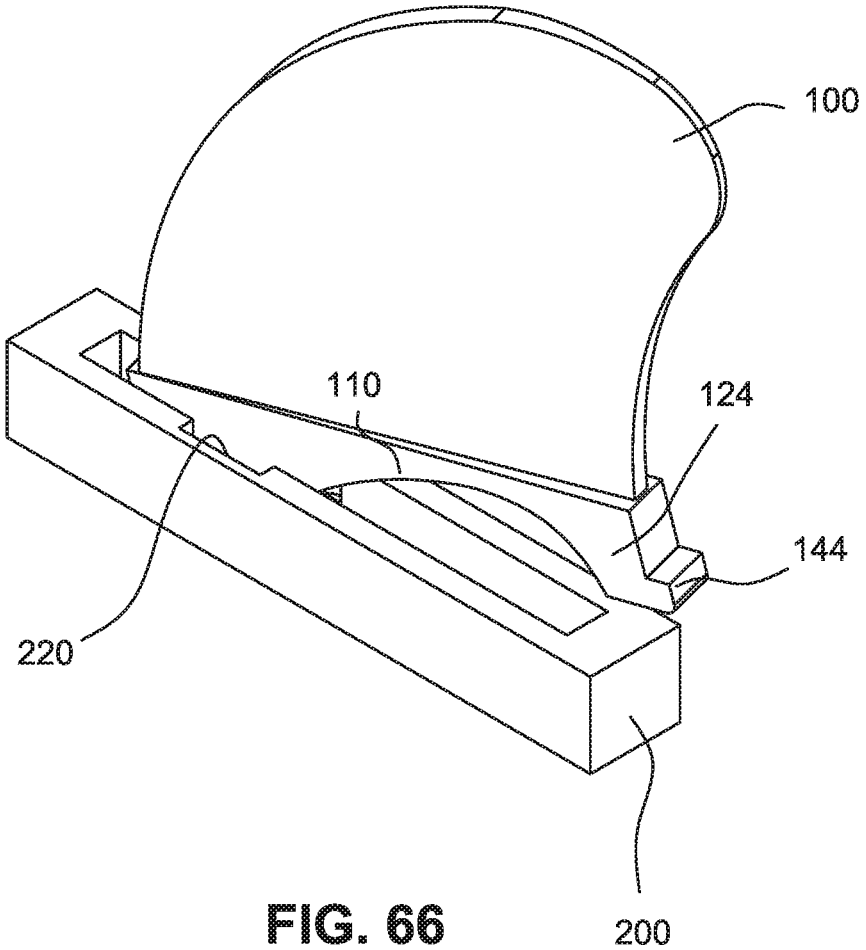
FIG. 66 is a perspective view of a fin with multiple fin attachment mechanisms a longitudinally tapered forward fin attachment mechanism and a rear longitudinal tab, rotated at a forward angle showing the forward fin attachment mechanism inserted into the single vertical access slot, the fin shown in a first step of the fin insertion sequence.
Figure 67A:
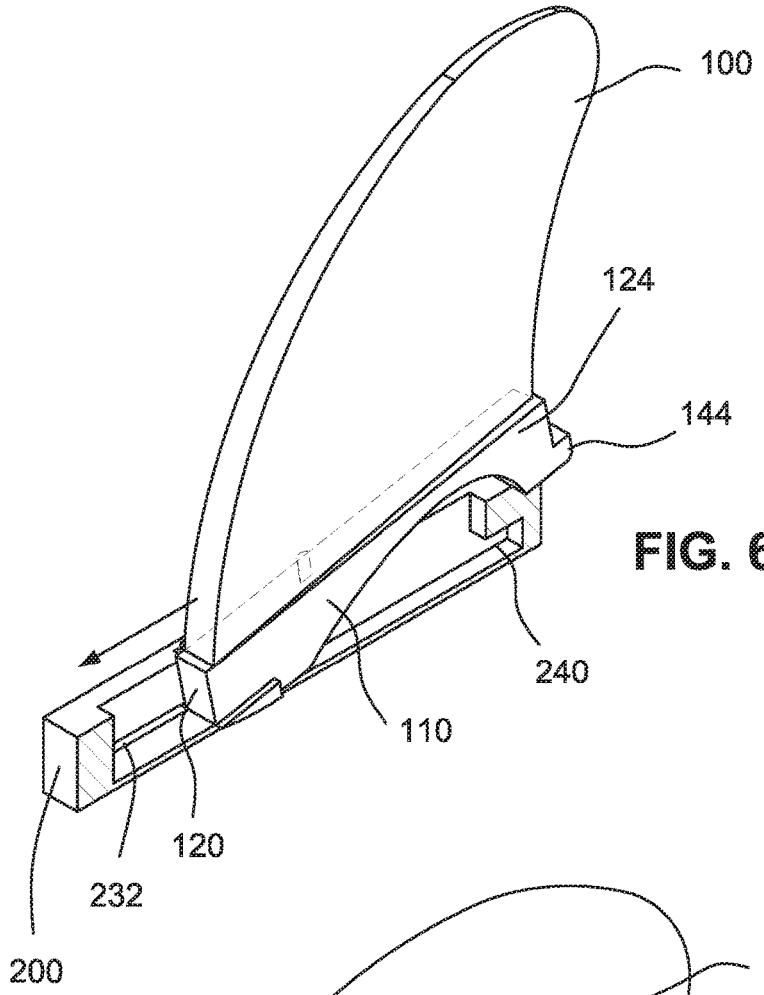
FIG. 67A is a left-side perspective view of a fin with multiple fin attachment mechanisms a longitudinally tapered forward fin attachment mechanism and a rear longitudinal tab shown with the fin moved forward in sequential order by the fin box shown in cross section, the fin shown in an intermediate step of the fin insertion sequence.
Figure 67B:
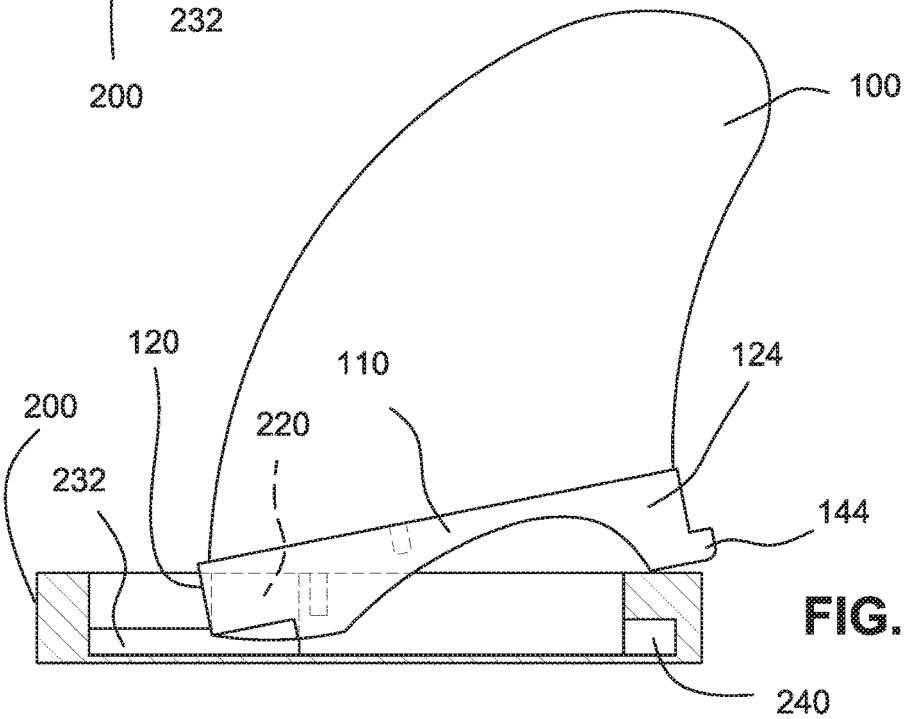
FIG. 67B is a side elevation view of a fin with multiple fin attachment mechanisms a longitudinally tapered forward fin attachment mechanism and a rear longitudinal tab showing the forward fin attachment mechanism moving in a forward direction away from the single vertical access slot of a fin box in a sequential order by the fin box shown in cross section, the fin shown in an intermediate step of the fin insertion sequence.
Figure 68A:
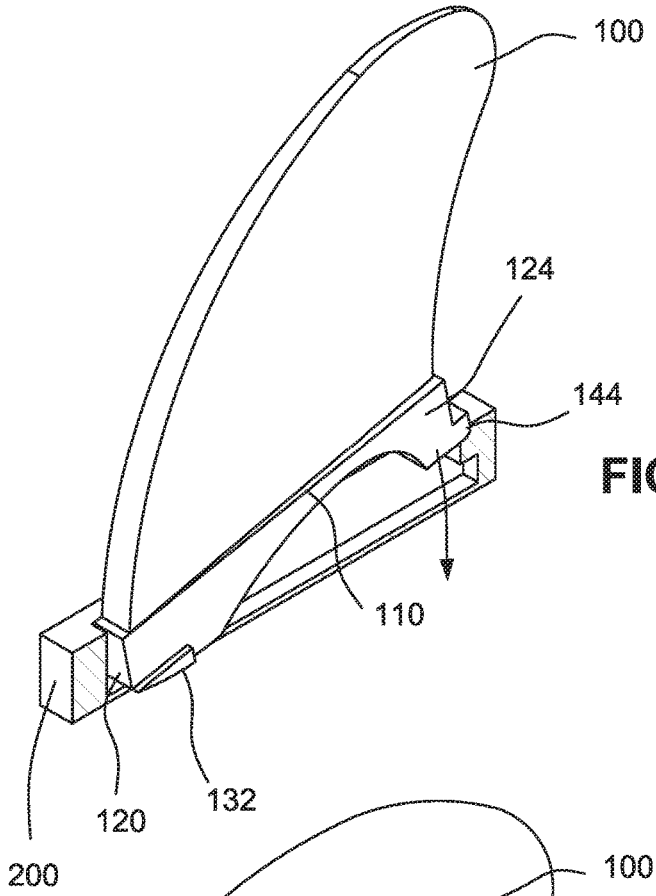
FIG. 68A is a left-side perspective view of a fin with multiple fin attachment mechanisms a longitudinally tapered forward fin attachment mechanism and a rear longitudinal tab oriented to be slideably received in sequential order by the fin box shown in cross section, the fin shown in an SECOND intermediate step of the fin insertion sequence.
Figure 68B:
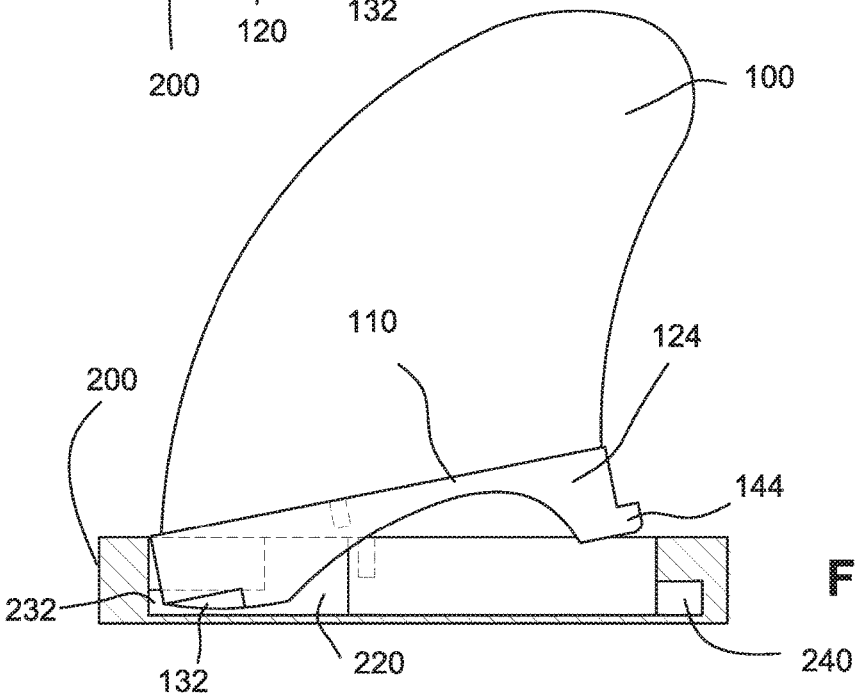
FIG. 68B is a side elevation view of a fin with multiple fin attachment mechanisms a longitudinally tapered forward fin attachment mechanism and a rear longitudinal tab showing the rear longitudinal tab moving down into the fin box in sequential order by the fin box shown in cross section, the fin shown in a second intermediate step of the fin insertion sequence.
Figure 69A:
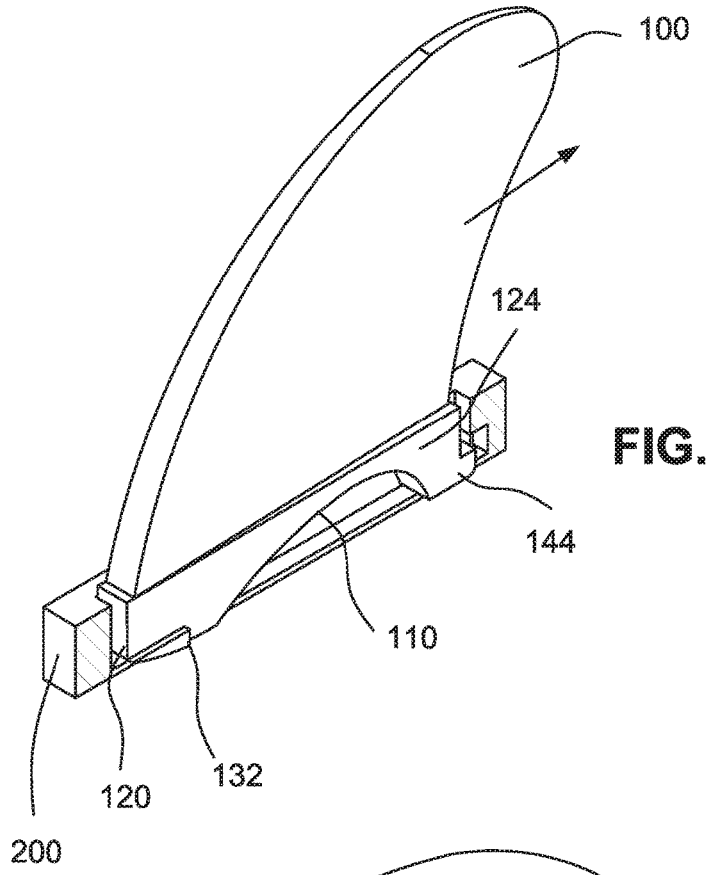
FIG. 69A is a left-side perspective view of a fin with multiple fin attachment mechanisms a longitudinally tapered forward fin attachment mechanism and a rear longitudinal tab fully inserted into the fin box in a sequential order by the fin box shown in cross section, the fin shown in a third intermediate step of the fin insertion sequence.
Figure 69B:
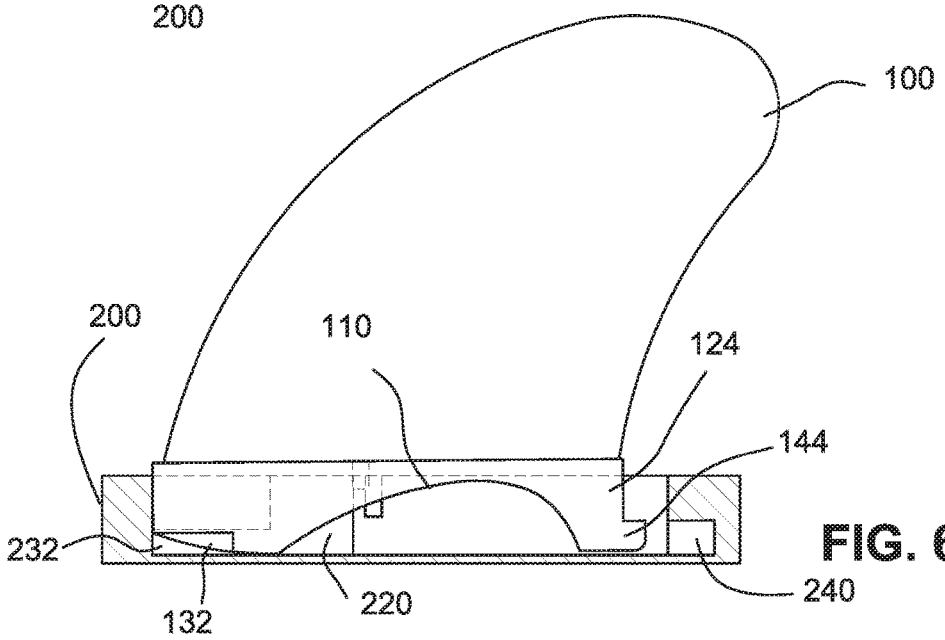
FIG. 69B is a side elevation view of a fin with multiple fin attachment mechanisms a longitudinally tapered forward fin attachment mechanism and a rear longitudinal tab showing both fin attachment mechanisms fully inserted into the fin box and moving toward the rear of the fin box, the rear longitudinal tab aligned to enter a rear longitudinal slot in the rear wall of the fin box slideably received in sequential order by the fin box shown in cross section, the fin shown in the third intermediate step of the fin insertion sequence.
Figure 70A:
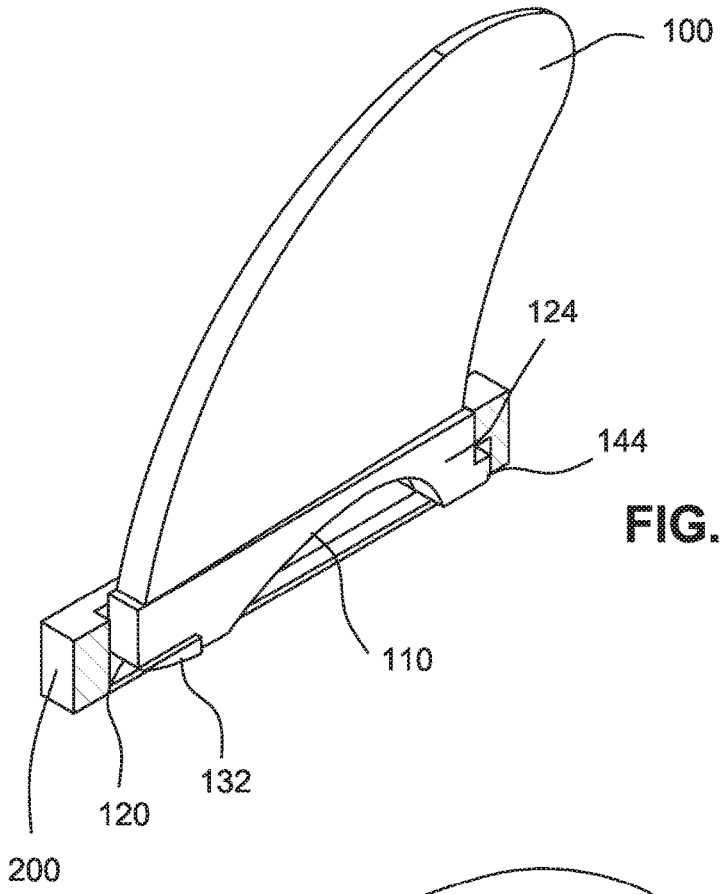
FIG. 70A is a left-side perspective view of a fin with multiple fin attachment mechanisms a longitudinally tapered forward fin attachment mechanism and a rear longitudinal tab oriented to be slideably received in sequential order by the fin box shown in cross section, the fin shown fully inserted and secure following the steps of the fin insertion sequence.
Figure 70B:
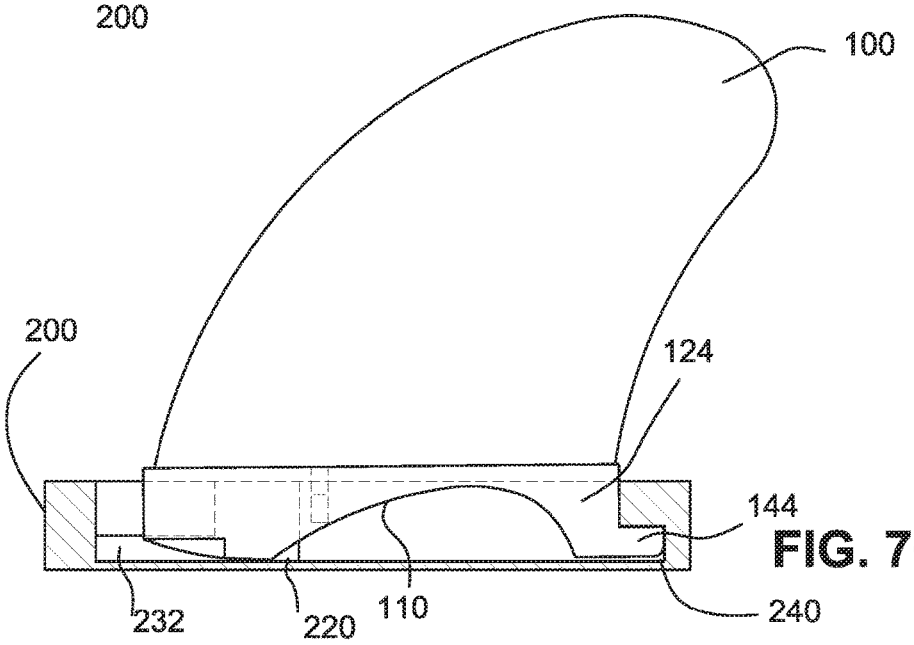
FIG. 70B is a side elevation view of a fin with multiple fin attachment mechanisms a longitudinally tapered forward fin attachment mechanism and a rear longitudinal tab showing both fin attachment mechanisms fully inserted into the rear of the fin box with the forward fin attachment mechanism securely held in the lateral grooves and the rear longitudinal tab entering a rear longitudinal slot in the rear wall of the fin box in sequential order by the fin box shown in cross section, the fin shown fully inserted and secure following the steps of the fin insertion sequence.
Figure 71:
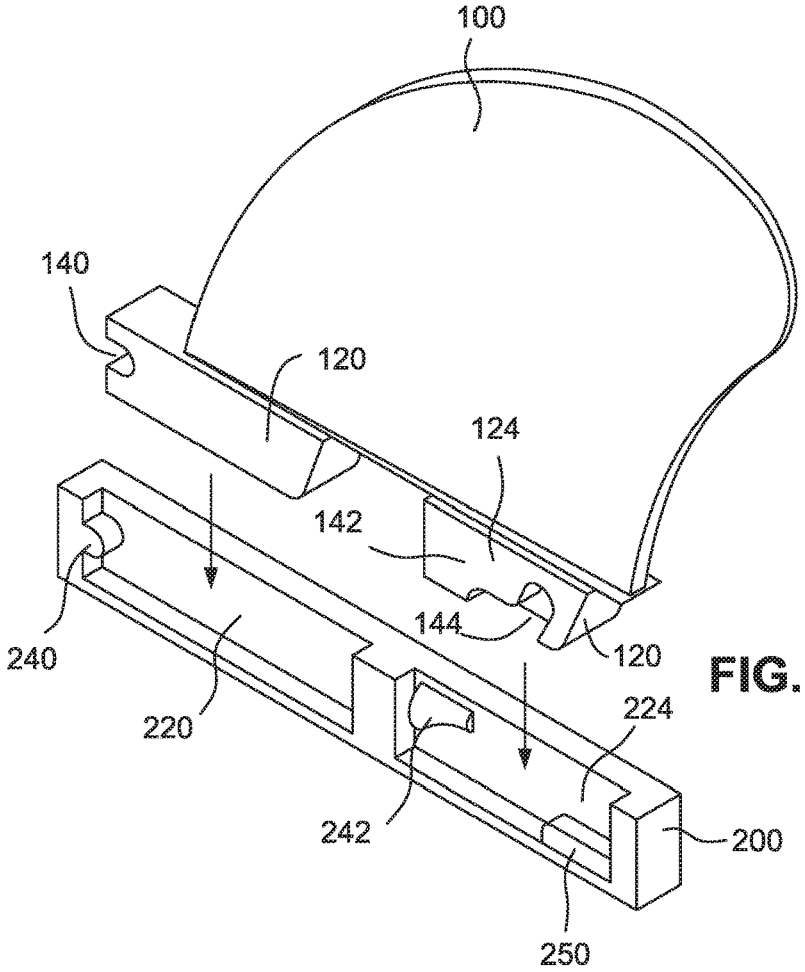
FIG. 71 is a left-side perspective view of a fin with multiple fin attachment mechanisms with multiple detents and groove securing features, shown together with a corresponding fin box with a forward and rear vertical access slot.
Figure 72:
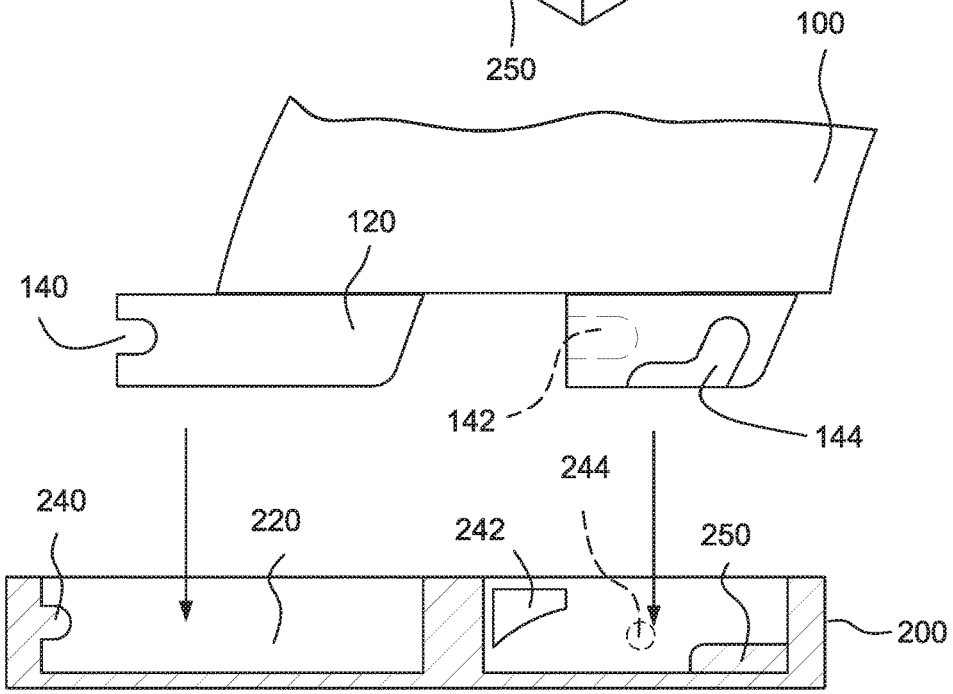
FIG. 72 is a right-side perspective view of a fin with multiple fin attachment mechanisms, with multiple detents and groove securing features, shown together with a cross-sectional view of the corresponding fin box, with a forward and rear vertical access slot.
Figure 73A:
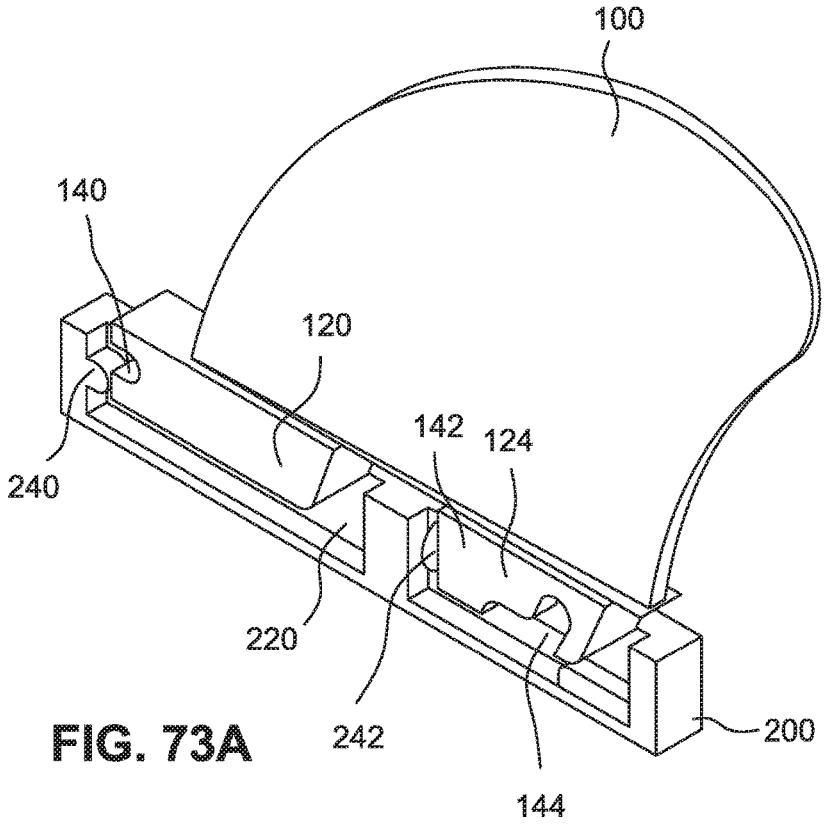
FIG. 73A is a right-side perspective view of a fin with multiple fin attachment mechanisms, with multiple detents and groove securing features, shown together with a cross-sectional view of the corresponding fin box, with a forward and rear vertical access slot.
Figure 73B:
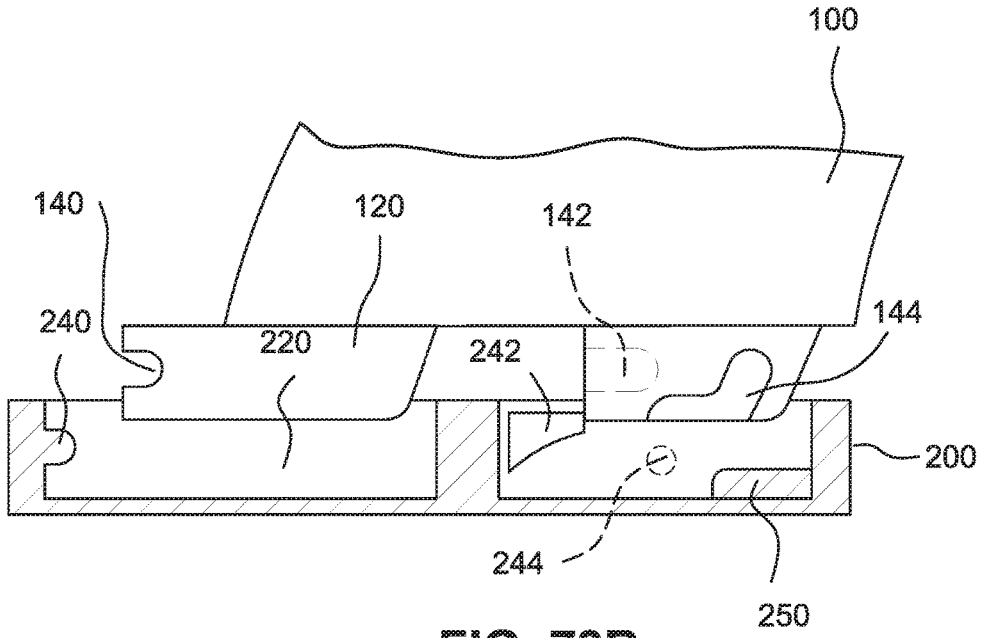
FIG. 73B is a side elevation view of a fin with multiple fin attachment mechanisms, with multiple detents and groove securing features interacting with a corresponding fin box with a forward and rear vertical access slot, with forward and rear fin attachment mechanisms at an initial step of a fin insertion sequence
Figure 74A:
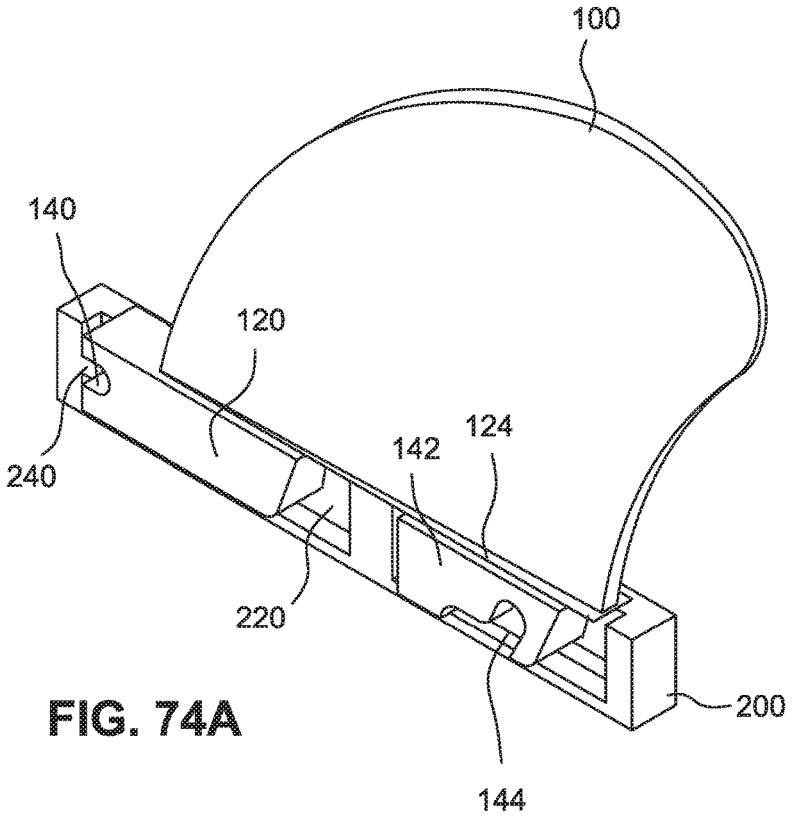
FIG. 74A is a right-side perspective view of a fin with multiple fin attachment mechanisms, with multiple detents and groove securing features, shown together with a cross-sectional view of the corresponding fin box, with a forward and rear vertical access slot, showing in an intermediate step of a fin insertion sequence.
Figure 74B:
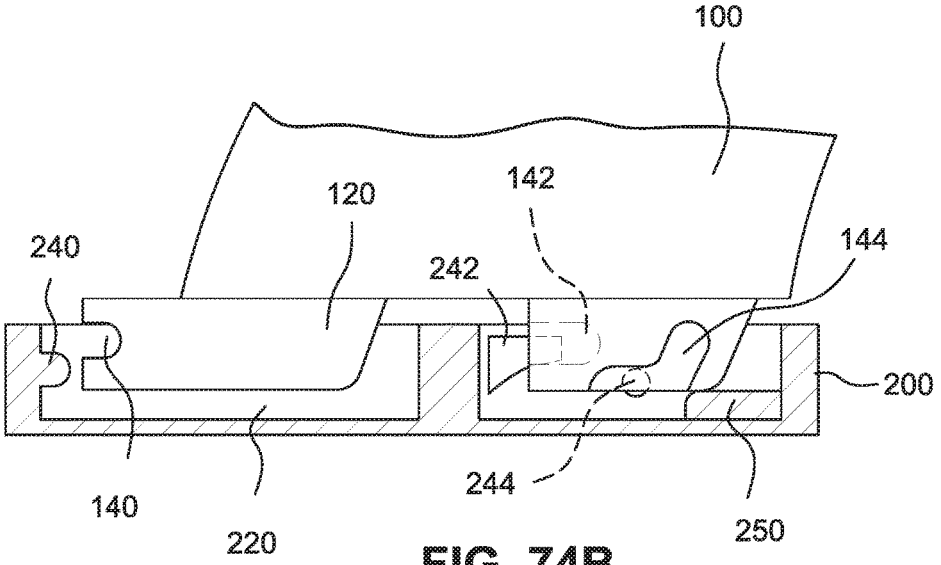
FIG. 74B is a side elevation view of a fin with multiple fin attachment mechanisms, with multiple detents and groove securing features interacting with a corresponding fin box with a forward and rear vertical access slot, with the fin moved in a longitudinal direction in a forward direction at an intermediate step of a fin insertion sequence
Figure 75A:
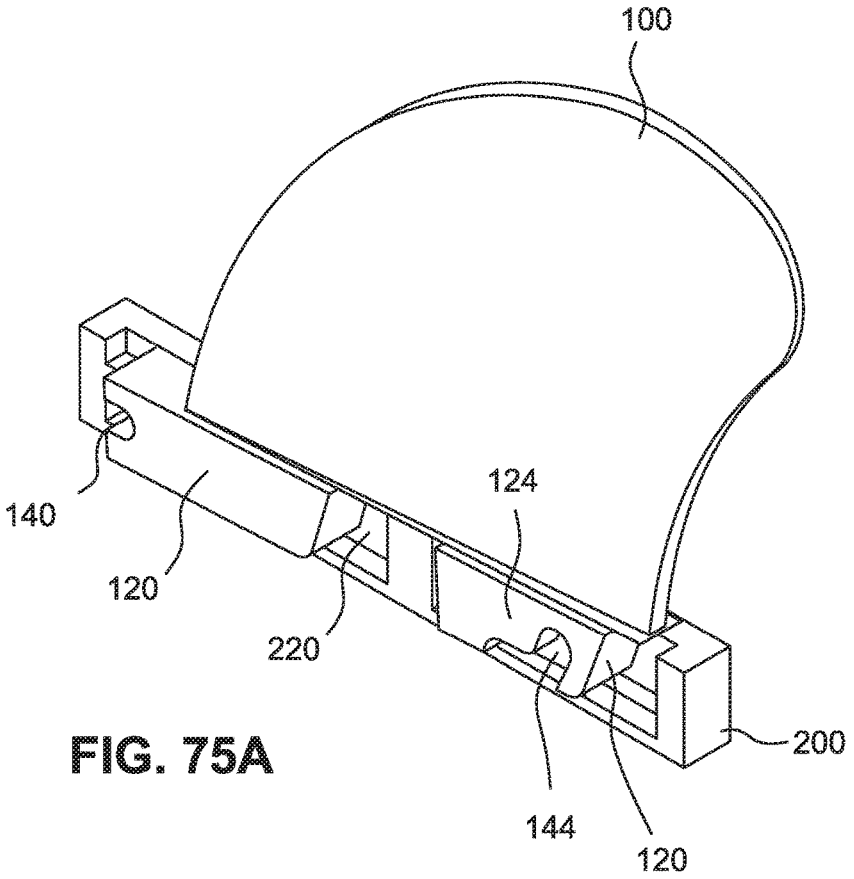
FIG. 75A is a right-side perspective view of a fin with multiple fin attachment mechanisms, with multiple detents and groove securing features interacting with a corresponding fin box with a forward and rear vertical access slot, showing a second intermediate step of a fin insertion sequence.
Figure 75B:
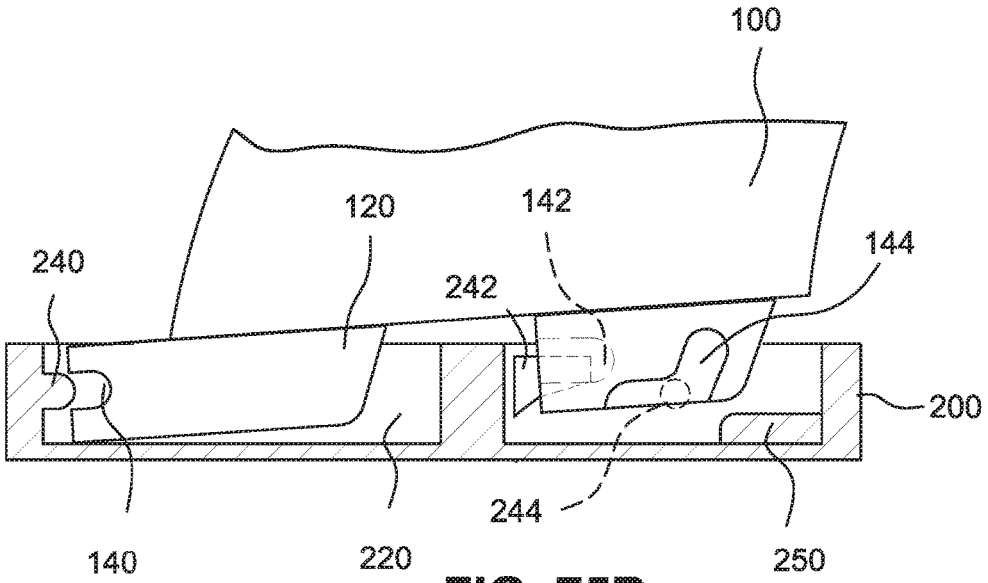
FIG. 75B is a side elevation view of a fin with multiple fin attachment mechanisms, with multiple detents and groove securing features interacting with a corresponding fin box with a forward and rear vertical access slot, with the fin moved further in a forward longitudinal direction and vertically into the vertical access slots, at a second intermediate step of a fin insertion sequence.
Figure 76A:
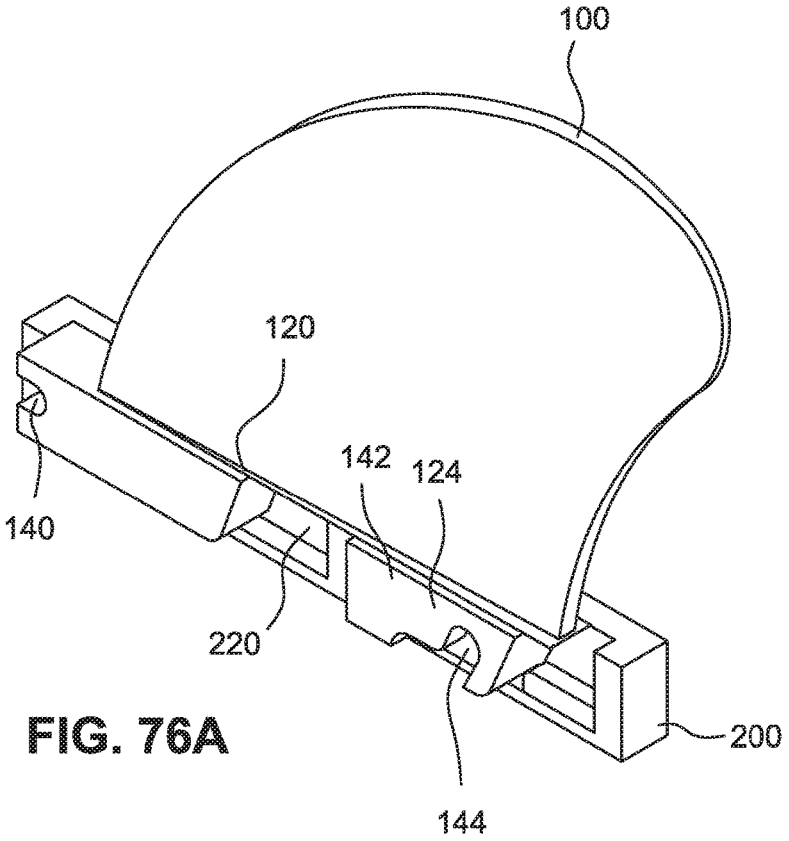
FIG. 76A is a right-side perspective view of a fin with multiple fin attachment mechanisms, with multiple detents and groove securing features, interacting with a corresponding fin box with a forward and rear vertical access slot, showing the multiple detents and groove securing features of the fin secured following the final steps of a fin insertion sequence.
Figure 76B:
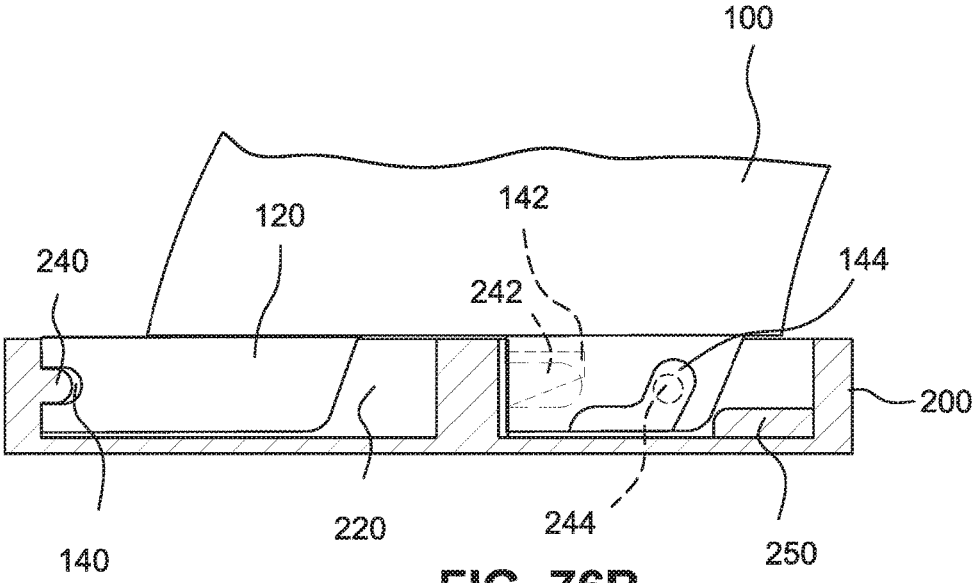
FIG. 76B is a side elevation view of a fin with multiple fin attachment mechanisms, with multiple detents and groove securing features interacting with a corresponding fin box with a forward and rear vertical access slot, showing both forward and rear fin attachment mechanisms of the fin and their associated multiple detents and groove securing features secured following the final steps of a fin insertion sequence.

FIGS. 62 and 63 show a single rear fin mechanism 124 with a longitudinal extension tab 144. In this combination, the fin 100 is rotated forward with respect to the fin box 200 and the forward fin attachment mechanism with the tapered tab 132 enters the fin box 200 via the vertical access slot 220. The forward fin attachment mechanism is then moved forward within the lateral groove 232 in the sides of the elongated slot until the rear fin attachment mechanism is able to access the elongated slot in a sequential order. With both fin attachment mechanisms inserted within the elongated slot, the fin 100 is then moved longitudinally in a rearward direction to secure the forward lateral extension tab 132 and allow the longitudinal extension tab 144 of the rear fin attachment mechanism 124 to be secured within the longitudinal groove 240 located in the rear wall of the elongated slot of the fin box 200.

In a further embodiment, it is envisioned that the fin attachment mechanisms and associated elongated slot have multiple detents and grooves.

Specifically, in at least one embodiment, lowering the fin attachment mechanisms 120 and 124 into the vertical access slots 220, 224 of the elongate slot, enables the longitudinal groove 142 in the front section of the rear fin attachment mechanism 124 to be vertically aligned with the rear end of a tapered longitudinal detent 242 which is located along the lateral wall of the rear vertical access slot 224, by moving the fin forward the groove 142 engages the tapered detent 242.

At the same time a groove 144 in the opposite side of the rear fin attachment 124 engages a rear pin 244 that partially extends laterally from the side wall of the rear vertical access slot 224

Moving the fin further forward will force the fin lower into the elongated slot as the groove 142 further engages the tapered detent 242 the rear lateral pin 244 moves toward the rear of the groove 144 in the rear fin attachment mechanism 124, at this stage a lateral notch 140 located at the forward end of the forward fin attachment mechanism is approximate to a complimentary lateral pin 240 located in the front wall of the fin box the rear fin tab is pressed down against the upward pressure from the tension pad 250 in the rear of the fin box to enable the fin to move further forward and for the forward notch 140 to engage the lateral pin 240, at the same time the partial lateral pin 244 in the rear vertical access slot moves up into the upper section of the lateral groove 144 locking the fin in a longitudinal direction, assisted by the forward pressure from the tension pad 250 and a vertical configuration by the interaction of the forward notch 140 and pin 240.

The features and mechanisms presented for use in this disclosure are applicable to one or more water crafts or vessels, including knee boards, body boards, surf boards, paddle boards, water skis, wake boards, sailboards and other wave, motor, paddle or self-propelled water craft vehicles. Accordingly, the present invention should not be interpreted as being limited to details and elements precisely as shown and described above, but instead by the scope of the appended claims.

While at least one exemplary embodiment of the present invention(s) is disclosed herein, modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A fin system for releasibly securing a fin to a water craft the system comprising:

a fin box with an elongated slot open at a first surface of the fin box and extending a depth inward towards a closed base opposite the first surface and the elongated slot including opposing sidewalls extending from the first surface to the closed base, at least one elongated groove in at least one of the sidewalls which is adjacent the closed base of the fin box;

at least one access slot in at least one of the sidewalls of the fin box, wherein the at least one access slot is open at one end to the first surface and extends to the elongated slot towards the closed base, and the at least one access slot is open to the at least one elongated groove; and a fin with a fin base dimensioned to be slideably received by the elongated slot of the fin box, wherein the fin base includes a forward tab projecting outward from a forward region of the fin base and a rear tab projecting outward from a rear region of the fin base, wherein the forward tab and the rear tab are dimensioned to be received first by the at least one access slot and received subsequently by the at least one elongated groove, and wherein at least one of the forward tab and rear tab is tapered along a direction parallel to the at least one elongated groove;

wherein the tapered at least one of the forward tab or the rear tab has, along the direction parallel to the at least one elongated groove, a narrow end and a thick end, wherein the thick end has a thickness substantially the same as a width of the at least one elongated groove.

2. The fin system of claim 1, wherein the fin box is configured to seat in a core of the water craft.

3. The fin system of claim 1, wherein the rear tab is tapered such that a forward end of the rear tab forms a leading edge.

4. The fin system of claim 1, wherein the access slot is a single vertical access slot.

5. The fin system of claim 1, wherein the access slot is at a rear end of the elongated slot, and the fin box further includes a forward access slot aligned with a forward region of the elongated slot.

6. The fin system of claim 1, wherein the fin base has bottom edge with a curvature dimensioned to bias the fin base away from the closed base of the fin box.

7. The fin system of claim 1, wherein one or more tension pads are positioned between the fin base and the elongated slot to increase a contact force between the fin base and fin box.

8. The fin system of claim 1, one or more detents and corresponding grooves are included in the fin base and elongated slot.

9. The fin system of claim 1, wherein one or more sides of the fin base are dimensioned with a reverse-taper such that the width of the fin base is greater than the width of the elongated slot.

10. A fin system for releasibly securing a fin to a water craft the system comprising:

a fin box with an elongated slot of substantially uniform width extending from a first surface of the fin box, the elongated slot having opposing sidewalls each having a depth extending inward towards a closed base of the fin box;

an elongated groove in at least one of the opposing sidewalls, wherein the elongated groove is proximate the closed base of the fin box; and at least one access slot in at least one of the opposing side walls of the fin box, open to the first surface, extending to and open to the elongated slot, a fin with a fin base dimensioned to be slideably received by the elongated slot of the fin box;

a forward tab projecting from a forward region of the fin base and configured to slide through the at least one access slot and subsequently slide through the elongated groove during insertion of the fin into the elongated slot;

a rear tab projecting from a rear region of the fin base and configured to slide through the at least one access slot and subsequently slide through the elongated groove during insertion of the fin into the elongated slot;

wherein at least one of the forward tab and rear tab is tapered along a direction parallel to the elongated groove and has, along the direction, a narrow end and a thick end; and wherein the thick end of the tapered tab has a thickness commensurate with a width of the at least one elongated groove.

11. The fin system of claim 10 wherein the at least one access slots is a single vertical access slot.

12. The fin system of claim 10, wherein the fin base has a curvature configured to bias the fin base away from the closed base of the fin box.

13. The fin system of claim 10, further comprising one or more tension pads between the fin base and elongated slot and positioned to bias the fin base against the fin box.

14. The fin system of claim 10, further comprising one or more detents on the fin base or a wall of the fin box and one or more grooves configured to receive the one or more detents on the wall or the fin base.

15. The fin system of claim 10, further comprising one or more pins on an end surface of the fin base or an end wall of the elongated slot and notches configured to receive the one or more pins on the end wall or end surface.

16. A fin configured to be releasibly secured to a fin box in a water craft, the fin comprising:

a fin portion configured to extend outward from the water craft and provide directional control as the watercraft and fin move through water;

a fin base dimensioned to be slideably received by an elongated slot of the fin box, wherein the elongated slot includes opposing sidewalls, at least one of the opposing sidewalls includes at least one access slot extending from an exposed surface of the fin box towards a closed based of the fin box, and an elongated groove separated from the exposed surface and open to the at least one access slot;

a forward tab projecting from a forward region of the fin base and configured to slide through the at least one access slot in the fin box, and subsequently slide through the elongated groove in the fin box during insertion of the fin based into the elongated slot;

a rear tab projecting from a rear region of the fin base and configured to slide through the at least one access slot and subsequently slide through the elongated groove during insertion of the fin into the elongated slot;

wherein at least one of the forward tab and rear tab is tapered along a direction parallel to the elongated groove such that along the direction the tab has a narrow end and a thick end; and wherein the thick end of the tapered tab has a thickness which forms a snug fit with the elongated groove.

* * * * *